US008646194B2

(12) United States Patent
Podd

(10) Patent No.: US 8,646,194 B2
(45) Date of Patent: Feb. 11, 2014

(54) LIGHTING DEVICE

(76) Inventor: George O. Podd, Lake Forest, IL (US)

( * ) Notice: Subject to any disclaimer, the term of this patent is extended or adjusted under 35 U.S.C. 154(b) by 0 days.

(21) Appl. No.: 12/930,832

(22) Filed: Jan. 18, 2011

(65) Prior Publication Data

US 2013/0099698 A1 Apr. 25, 2013

Related U.S. Application Data

(63) Continuation-in-part of application No. 12/927,611, filed on Nov. 17, 2010, now abandoned, and a continuation-in-part of application No. 12/821,944, filed on Jun. 23, 2010, now abandoned, and a continuation of application No. 11/803,722, filed on May 15, 2007, now abandoned, and a continuation of application No. 11/444,174, filed on May 31, 2006, now abandoned, and a continuation-in-part of application No. 11/259,909, filed on Oct. 27, 2005, now abandoned.

(51) Int. Cl.

| | |
|---|---|
| ***G09F 13/04*** | (2006.01) |
| ***G09F 13/22*** | (2006.01) |
| ***G09F 13/18*** | (2006.01) |
| ***G09F 21/04*** | (2006.01) |
| ***A47G 1/17*** | (2006.01) |

(52) U.S. Cl.

USPC ..... 40/578; 40/544; 40/546; 40/593; 40/564; 40/760; 40/661.09; 40/797; 40/791; 362/806; 362/249.12

(58) Field of Classification Search

USPC ..... 40/578, 544, 546, 593, 564, 760, 40/661.09, 797, 791; 362/251, 806, 362/249.12

See application file for complete search history.

(56) References Cited

U.S. PATENT DOCUMENTS

| | | | | |
|---|---|---|---|---|
| 5,390,436 | A * | 2/1995 | Ashall | 40/546 |
| 5,718,497 | A * | 2/1998 | Yokoyama et al. | 362/625 |
| 5,957,564 | A * | 9/1999 | Bruce et al. | 362/84 |
| 6,783,259 | B1 * | 8/2004 | Macedonio | 362/249.12 |
| 7,065,909 | B2 * | 6/2006 | Snyder | 40/544 |

* cited by examiner

*Primary Examiner* — Syed A Islam
(74) *Attorney, Agent, or Firm* — Christopher J. Scott

(57) ABSTRACT

A light film apparatus having an illuminated graphics panel with at least two segments that can be individually powered. A controller manages a power which is delivered from a power supply to each of the segments, so that each of the segments is either powered on, powered off or powered to an intermediate level. With the independent control of power to the different segments, it is possible to create a three-dimensional appearance of a moving image from a generally two-dimensional panel arrangement. A housing can be mounted so that the graphics panel abuts or is closely mounted to a mounting surface.

13 Claims, 77 Drawing Sheets

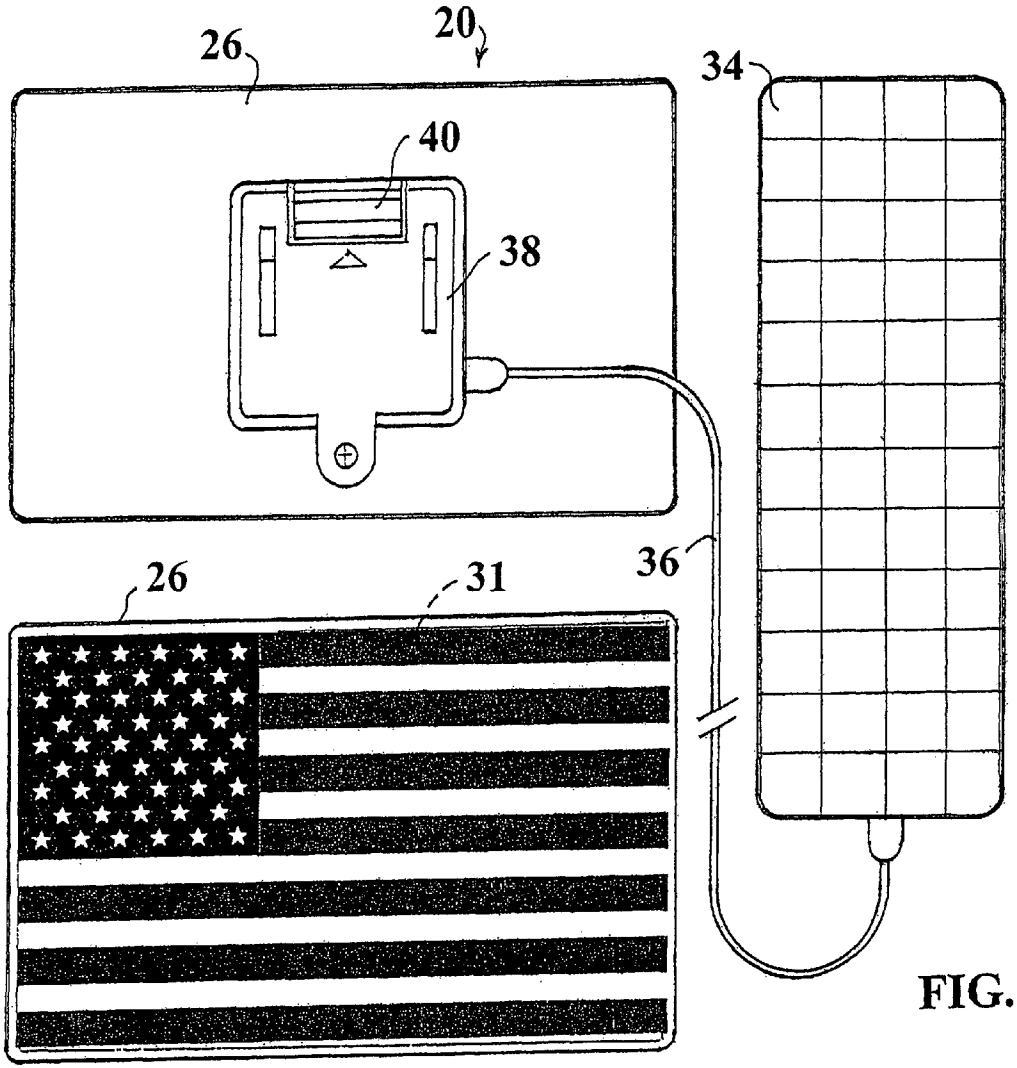
FIG. 12
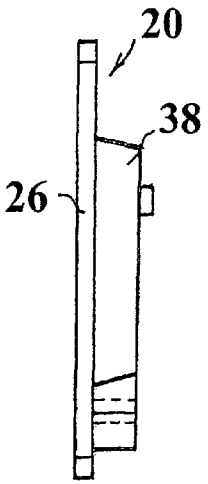
FIG. 13
20
FIG. 11

A. POWER-OFF

B. POWER-ON

B1. BRIGHTNESS LEVEL?
PROGRAM CHECKS POSITION OF BRIGHTNESS SWITCH & SETS EL OUTPUT TO LOW, MEDIUM, OR HIGH POWER.

B2. MODE?
PROGRAM CHECKS POSITION OF MODE SWITCH & SETS EL ANIMATION TO 1 OF 6 PRE-PROGRAMMED SEQUENCES.

B3. RUN ANIMATION SEQUENCE
EL ANIMATION LOOPS CONTINUOUSLY UNTIL POWER IS TURNED OFF.

C. POWER-AUTO

C1. AFTER DUSK?
PROGRAM CHECKS AMBIENT LIGHT LEVEL VIA PHOTO CELL OR SIMILAR SENSOR

C2. BRIGHTNESS LEVEL?
PROGRAM CHECKS POSITION OF BRIGHTNESS SWITCH & SETS EL OUTPUT TO LOW, MEDIUM, OR HIGH POWER.

C3. MODE?
PROGRAM CHECKS POSITION OF MODE SWITCH & SETS EL ANIMATION TO 1 OF 6 PRE-PROGRAMMED SEQUENCES.

C4. RUN ANIMATION SEQUENCE
EL ANIMATION LOOPS FOR PRESET AMOUNT OF TIME (EX: 30 SECONDS), THEN STOPS.

C5. MOTION SENSOR INPUT?
IF NO, UNIT SHUTS DOWN (DRAWS MINIMAL CURRENT) UNTIL ACTIVITY FROM MOTION SWITCH (SPRING SWITCH, MERCURY SWITCH, BALL BEARING SWITCH OR OTHER).

FIG. 25B

A. POWER-OFF

B. POWER-ON

B1. BRIGHTNESS LEVEL?
PROGRAM CHECKS POSITION OF BRIGHTNESS SWITCH & SETS EL OUTPUT TO LOW, MEDIUM, OR HIGH POWER.

B2. MODE?
PROGRAM CHECKS POSITION OF MODE SWITCH & SETS EL ANIMATION TO 1 OF 6 PRE-PROGRAMMED SETTINGS.

B3. RF INPUT?
PROGRAM CHECKS FOR RF INPUT, AND ADJUSTS EL BRIGHTNESS AND/OR ANIMATION SEQUENCE AS INDICATED BY SIGNAL.

B4. RUN EL ANIMATION SEQUENCE.
EL ANIMATION LOOPS CONTINUOUSLY UNTIL SETTING SWITCH IS MOVED, RF INPUT VARIES, OR POWER IS TURNED OFF.

C. POWER-AUTO

C1. AFTER DUSK?
PROGRAM CHECKS AMBIENT LIGHT LEVEL VIA PHOTO CELL OR SIMILAR SENSOR.

C2. BRIGHTNESS LEVEL?
PROGRAM CHECKS POSITION OF BRIGHTNESS SWITCH & SETS EL OUTPUT TO LOW, MEDIUM, OR HIGH POWER.

C3. MODE?
PROGRAM CHECKS POSITION OF MODE SWITCH & SETS EL ANIMATION TO 1 OF 6 PRE-PROGRAMMED SETTINGS.

C4. RF INPUT?
PROGRAM CHECKS FOR RF INPUT, AND ADJUSTS EL BRIGHTNESS AND ANIMATION SETTING AS INDICATED BY SIGNAL.

C5. RUN EL ANIMATION SEQUENCE.
EL DISPLAY ANIMATES AS PER LEVEL AND MODE SETTINGS.

C6. SENSOR INPUT?
IF NO, UNIT SHUTS DOWN (DRAWS MINIMAL CURRENT) UNTIL ACTIVITY FROM MOTION SWITCH OR RF INPUT.

FIG. 26B

A. POWER-OFF

B. POWER-ON

B1. BRIGHTNESS LEVEL?
PROGRAM CHECKS POSITION OF BRIGHTNESS SWITCH & SETS EL OUTPUT TO LOW, MEDIUM, OR HIGH POWER.

B2. MODE?
PROGRAM CHECKS POSITION OF MODE SWITCH & SETS EL ANIMATION TO 1 OF 6 PRE-PROGRAMMED SEQUENCES.

B3. RUN ANIMATION SEQUENCE.
EL ANIMATION LOOPS CONTINUOUSLY UNTIL POWER IS TURNED OFF.

B4. SOUND INPUT LEVEL?
PROGRAM ASSIGNS VARIABLE BASED ON INTENSITY OF SOUND INPUT TO MICROPHONE.

B5. EL ANIMATION
EL SEGMENTS LIGHT UP IN REACTION TO AUTO SOUND INTENSITY (EX: LOUDER NOISE = MORE LIGHTED PANELS).

C. POWER-AUTO

C1. AFTER DUSK?
PROGRAM CHECKS AMBIENT LIGHT LEVEL VIA PHOTO CELL OR SIMILAR SENSOR.

C2. BRIGHTNESS LEVEL?
PROGRAM CHECKS POSITION OF BRIGHTNESS SWITCH & SETS EL OUTPUT TO LOW, MEDIUM, OR HIGH POWER.

C3. MODE?
PROGRAM CHECKS POSITION OF MODE SWITCH & SETS EL ANIMATION TO 1 OF 6 PRE-PROGRAMMED SEQUENCES.

C4. RUN ANIMATION SEQUENCE.
EL ANIMATION LOOPS FOR PRESET AMOUNT OF TIME (EX: 30 SECONDS), THEN STOPS.

C5. SOUND INPUT?
PROGRAM ASSIGNS VARIABLE BASED ON INTENSITY OF SOUND INPUT LEVEL. IF NO SOUND FOR X SECONDS, UNIT WILL GO TO POWER SAVE MODE.

C6. EL ANIMATION.
EL SEGMENTS LIGHT UP IN REACTION TO SOUND INTENSITY (EX: LOUDER NOISE = MORE LIGHTED PANELS).

C7. MOTION SENSOR INPUT?
UNIT SHUTS DOWN (DRAWS MINIMAL CURRENT) UNTIL ACTIVITY FROM MOTION SWITCH (EX: CAR ACCELERATES, BRAKES, OR TURNS).

FIG. 27B

A. POWER-OFF

B. POWER-ON

B1. BRIGHTNESS LEVEL?
PROGRAM CHECKS POSITION OF BRIGHTNESS SWITCH & SETS EL OUTPUT TO LOW, MEDIUM, OR HIGH POWER.

B2. MODE?
PROGRAM CHECKS POSITION OF MODE SWITCH & SETS EL ANIMATION TO 1 OF 6 PRE-PROGRAMMED SEQUENCES.

B3. RUN ANIMATION SEQUENCE.
EL ANIMATION RUNS ONCE, THEN LOOPS.

B4. RUN EL IDLE ANIMATION
EL PANELS ARE LIGHTED MINIMALLY, WAITING FOR REACTION FROM ACCELERATION SENSORS (EX: 1 SEGMENT OF FLAME GRAPHIC IS LIGHTED WHILE CAR IS AT STANDSTILL.)

B5. INPUT FROM MOTION SENSOR?
PROGRAM ASSIGNS VARIABLE BASED ON LEVEL OF ACCELERATION. EX: IF CAR BRAKES, VARIABLE INCREASES IN REACTION TO DECELERATION.

B6. EL ANIMATION
ADDITIONAL EL SEGMENTS LIGHT UP IN REACTION TO BRAKING INTENSITY (EX: FASTER STOP = MORE LIGHTED PANELS).

C. POWER-AUTO

C1. AFTER DUSK?
PROGRAM CHECKS AMBIENT LIGHT LEVEL VIA PHOTO CELL OR SIMILAR SENSOR.

C2. BRIGHTNESS LEVEL?
PROGRAM CHECKS POSITION OF BRIGHTNESS SWITCH & SETS EL OUTPUT TO LOW, MEDIUM, OR HIGH POWER.

C3. MODE?
PROGRAM CHECKS POSITION OF MODE SWITCH & SETS EL ANIMATION TO 1 OF 6 PRE-PROGRAMMED SEQUENCES.

C4. RUN ANIMATION SEQUENCE.
EL ANIMATION LOOPS FOR PRESET AMOUNT OF TIME (EX: 30 SECONDS), THEN STOPS.

C5. RUN EL IDLE ANIMATION
EL PANELS ARE LIGHTED MINIMALLY, WAITING FOR REACTION FROM ACCELERATION SENSORS (EX: 1 SEGMENT OF FLAME GRAPHIC IS LIGHTED WHILE CAR IS COASTING).

C6. INPUT FROM MOTION SENSOR?
PROGRAM ASSIGNS VARIABLE BASED ON LEVEL OF ACCELERATION. EX: IF CAR BRAKES, VARIABLE INCREASES IN REACTION TO DECELERATION.

C7. EL ANIMATION.
ADDITIONAL EL SEGMENTS LIGHT UP IN REACTION TO BRAKING INTENSITY (EX: FASTER STOP = MORE LIGHTED PANELS).

C8. ACCELERATION SENSOR INPUT?
UNIT SHUTS DOWN (DRAWS MINIMAL CURRENT) UNTIL ACTIVITY FROM MOTION SWITCH (EX: CAR ACCELERATES OR BRAKES).

FIG. 28B

A. POWER-OFF

B. POWER-ON

B1. BRIGHTNESS LEVEL?
PROGRAM CHECKS POSITION OF BRIGHTNESS SWITCH & SETS EL OUTPUT TO LOW, MEDIUM, OR HIGH POWER.

B2. MODE?
PROGRAM CHECKS POSITION OF MODE SWITCH & SETS EL ANIMATION TO 1 OF 6 PRE-PROGRAMMED SEQUENCES.

B3. RUN ANIMATION SEQUENCE.
EL ANIMATION RUNS ONCE, THEN LOOPS.

B4. RUN EL IDLE ANIMATION
EL PANELS ARE LIGHTED MINIMALLY, WAITING FOR REACTION FROM ACCELERATION SENSORS (EX: SOCCER BALL GRAPHIC IS LIGHTED- APPEARS IN CENTER OF WINDOW.)

B5. INPUT FROM ACCELERATION SENSORS ?
PROGRAM ASSIGNS VARIABLES BASED ON LEVEL OF ACCELERATION. EX: IF CAR BRAKES OR TURNS, VARIABLE CHANGES TO REFLECT TURNING/STOPPING FORCES.

B6. EL ANIMATION
VARYING EL SEGMENTS LIGHT UP IN REACTION TO AUTO MOVEMENT. (EX: SOCCER BALL APPEARS TO MOVE RIGHT-LEFT OR UP-DOWN IN REACTION TO AUTO).

C. POWER-AUTO

C1. AFTER DUSK?
PROGRAM CHECKS AMBIENT LIGHT LEVEL VIA PHOTO CELL OR SIMILAR SENSOR.

C2. BRIGHTNESS LEVEL?
PROGRAM CHECKS POSITION OF BRIGHTNESS SWITCH & SETS EL OUTPUT TO LOW, MEDIUM, OR HIGH POWER.

C3. MODE?
PROGRAM CHECKS POSITION OF MODE SWITCH & SETS EL ANIMATION TO 1 OF 6 PRE-PROGRAMMED SEQUENCES.

C4. RUN ANIMATION SEQUENCE.
EL ANIMATION LOOPS FOR PRESET AMOUNT OF TIME (EX: 30 SECONDS), THEN STOPS.

C5. RUN EL IDLE ANIMATION
EL PANELS ARE LIGHTED MINIMALLY, WAITING FOR REACTION FROM ACCELERATION SENSORS (EX: SOCCER BALL GRAPHIC IS LIGHTED- APPEARS IN CENTER OF WINDOW.)

C6. INPUT FROM ACCELERATION SENSORS?
PROGRAM ASSIGNS VARIABLES BASED ON LEVEL OF ACCELERATION. EX: IF CAR BRAKES OR TURNS, VARIABLES CHANGE TO REFLECT TURNING/STOPPING FORCES.

C7. EL ANIMATION.
VARYING EL SEGMENTS LIGHT UP IN REACTION TO AUTO MOVEMENT. (EX: SOCCER BALL APPEARS TO MOVE RIGHT-LEFT OR UP-DOWN IN REACTION TO AUTO).

C8. ACCELERATION SENSOR INPUT?
UNIT SHUTS DOWN (DRAWS MINIMAL CURRENT) UNTIL ACTIVITY FROM MOTION SWITCH (EX: CAR ACCELERATES, BRAKES OR TURNS).

FIG. 29B

Note: Battery Saver can be internal or external setting at factory or by user.

LIGHTING DEVICE

This Provisional U.S. Patent Application is related to and a continuation-in-part patent application of U.S. patent application Ser. No. 11/803,722, filed 15 May 2007, to which priority is claimed, which is a continuation-in-part patent application of U.S. patent application Ser. No. 11/444,174, filed 31 May 2006, to which priority is claimed, which is a continuation-in-part patent application of U.S. patent application Ser. No. 11/259,909, filed 27 Oct. 2005, to which priority is claimed, and this Patent Application also claims priority to U.S. Provisional Patent Application Ser. No. 60/623,754, filed 29 Oct. 2004, and to U.S. Provisional Patent Application Ser. No. 60/724,476, filed 7 Oct. 2005, and the entire teachings and the full disclosure of each of the above-identified U.S. Patent Applications and U.S. Provisional Patent Applications are by reference hereto incorporated into and made a part of this specification and this Provisional U.S. Patent Application.

BACKGROUND OF THE INVENTION

1. Field of the Invention

This invention relates generally to a light or a lighting device, such as a light film device, particularly an illuminated graphics panel that can be positioned on or near a window or glass surface, such as on a vehicle.

2. Discussion of Related Art

Electroluminescent lamps or devices have been used for signage. There are known methods for manufacturing EL lamps or devices.

One conventional emergency exit sign uses an EL lamp in combination with a pilot light which is connected to the EL lamp by way of a photoelectric link. The photoelectric link monitors the brightness of the EL lamp and keeps on the pilot light as long as the EL lamp is lit. Illumination provided by the EL lamp may be less than the illumination of background brightness, making it difficult to tell by looking at the EL lamp whether or not the EL lamp is energized. Thus, the pilot light provides a point of illumination that can be easier to detect than whether the EL lamp is lit. This particular combination can be useful for building inspectors that check the operational status of an exit sign.

SUMMARY OF THE INVENTION

There is a need to enhance visibility of graphic elements in different places, for many safety reasons and marketable applications. For example, enhanced visibility of graphic elements on vehicles may help overcome low visibility driving conditions, such as snow, rain, darkness and/or fog. With increased visibility of specific graphic elements on a vehicle, other motorists can better see dedicated information, particularly in adverse weather conditions or low visibility driving conditions. The light film device of this invention can be used in any suitable or desirable situation or format, such as a safety signal, a public service symbol including symbols of the Department of Transportation, the Military, the National Guard, the Police and the Fire Departments, a construction sign, a zone authority, a help/warning message, and many other marketable applications, including zone parking passes for major events, promotional icons, vehicle brand logos and advertising messages.

There is also a need for a product according to this invention, to address and satisfy specific criteria for practical or real world use. In one embodiment of this invention, this is achieved by integrating illuminated graphic panels with sensors, a dim switch or sensor and a control module, which can be programmed and/or assembled to operate within specific parameters of a dedicated driving or usage environment.

A light film device according to embodiments of this invention can include an electroluminescent (EL) panel integrated or combined with a translucent graphics panel, a light sensor, a motion sensor, a time sensor and/or dim settings. The light film device can be mounted to a structure or surface, such as a vehicle window or a building window, to allow theme graphics, such as words, logos and/or symbols, to be highly visible, for example during low visibility weather and/or driving conditions.

There is a need to provide specific operating criteria, in certain situations. Issues should be addressed for real world or marketplace product applications.

In other embodiments according to this invention, the light film device can be used to display the appearance of a moving image. For example, a light film device of this invention can be used to display a dynamic or moving flag, to give the appearance that the flag is blowing in the wind. The creation or animation of a moving image can be accomplished with an EL panel having two or more segments that are positioned adjacent with respect to each other. A controller can be used to vary power delivered to each segment. For example, each segment can be individually controlled to dim, brighten, pulse off and on, switch off and/or switch on, for different desired effects.

In some instances, product according to this invention, when introduced into the marketplace, should conform to local regulations, such as a variety of U.S. Federal and U.S. State transportation regulations regarding lumen output levels, animation effects and product positioning or placement on a vehicle. A dim switch or control feature may allow a lumen output level to be adjusted to within or to not exceed one or more set regulations. This feature or adjustment can occur manually or automatically. A mode switch feature can ensure that a final use falls within or meets regulations. The product configuration may allow mounting on a side window or a back window of a vehicle, for example, depending on an intended use.

A product of this invention may be easy to use, require low maintenance and operate within control module settings and functional parameters. For example, a motion sensor, a light sensor and/or a timer switch can be used to make all necessary or desired adjustments, so that the user does not have to use or address the on/off switch once a desired operational mode is set. The user may have an option to change a mode setting. A battery recharge capability, particularly if automatic, allows the user to not be concerned with replacing or manually recharging batteries. A removable battery module provides a simple battery replacement operation. A flexible mounting adaptation and a DC adaptor with a control module allows easy installation. A battery pack does not require auto wiring operation for easier installation.

A product according to this invention can be manufactured and operate within a range of reasonable costs, based on potential market applications. An interchangeable translucent graphic panel and layer assembly allows the EL component to be standardized as white backlight. Thus, custom printing of clear plastic sheet material minimizes the cost, the inventory and the production time. Sensors optimize product function, provide a user-friendly product and prolong battery life during use. There can be a battery recharge capability with, for example a solar panel option, to prolong battery life. A vehicle DC port and adapter/control module allows use of the device without batteries.

With a product according to this invention, consumers may obtain value added attributes of increased visibility for their specific needs. Also, the consumer is able to use the light film device of this invention, if necessary within legal vehicle guidelines, and benefit from improved user features and cost effective operation. The light film device of this invention can include a static or constant display or illumination and/or a dynamic or animated graphic display or illumination, and can also include two or more graphics panels. The light film device of this invention can be used for any suitable application other than vehicular applications, such as for signage in a home window or in a business or store-front window.

BRIEF DESCRIPTION OF THE DRAWINGS

Features of this invention can be better understood when this specification is read in view of the drawings, wherein:

FIG. 11 is a front view of a light film device, according to another embodiment of this invention;

FIG. 12 is a rear view of the light film device, as shown in FIG. 11, operatively connected to a solar panel;

FIG. 13 is a side view of the light film device, as shown in FIG. 11;

DETAILED DESCRIPTION OF THE INVENTION

Figure 17:
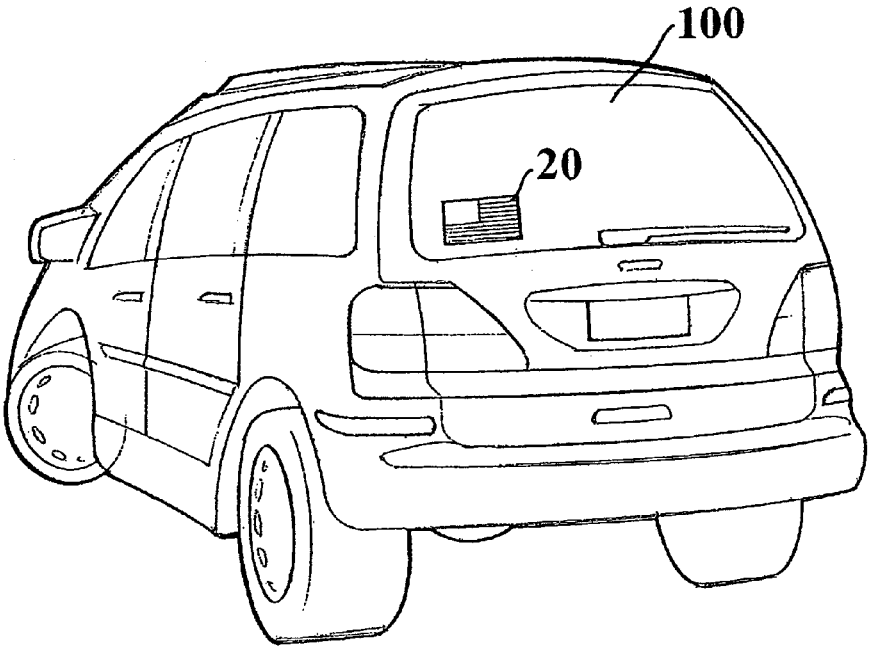
FIG. 17 is a perspective view of a light film device mounted to a vehicle window, according to one embodiment of this invention.

This invention provides a light film device including a light film component, a control module and in certain embodiments a solar power unit and/or a battery. FIGS. 1-19 show a light film device, according to certain embodiments of this invention. The light film device can be mounted with respect to a window, such as vehicle window 100 shown in FIG. 17, to display desired graphics for marketing applications, safety applications and/or emergency situations, for example. The light film device of this invention can provide highly visible graphics that other motorists and/or pedestrians or bystanders will be able to see in adverse weather conditions and/or adverse driving conditions, for example. The light film device of this invention can be used for a variety of applications including, but not limited to, safety signals, public service symbols, such as the Department of Transportation, the Military, the National Guard, the Police and the Fire Department logos or plaques, construction locations and workers, zone authorities, help/warning messages, and other suitable informational and/or marketable applications, such as zone parking passes for major events, promotional icons, vehicle brand logos, animated images, dynamic images, wave images, and advertising messages.

Throughout this specification and in the claims, the phrase illuminated graphics panel, the phrase electroluminescent display device, the phrase electroluminescent display, the phrase electroluminescent device and the phrase electroluminescent element, the phrase light emitting diode (LED), the phrase lighting device, the phrase lighting apparatus, as well as other similar phrases, are intended to be interchangeable with each other. The phrase illuminated graphics panel or any of the other interchangeable phrases each is intended to relate to a lighting device that includes panel shaped elements or segments which can be lit by any suitable light supply or source. The phrase illuminated graphics panel and the interchangeable phrases are also intended to relate to and include currently available EL lighting devices, as well as EL devices or other suitable lighting devices that may become available.

In certain embodiments of this invention, the illuminated graphics panel may be designed and/or manufactured with light emitting diode (LED) technology, which can provide cost savings. Any suitable type of LED can be used, including but not limited to a pointing LED, a wide beam LED, a side firing LED and/or an organic LED (OLED). For example, it may be possible to diffuse LED lights into panels, dedicated panels and/or dedicated panel segments, which can be of any suitable material and have any suitable dimensions, cross section and/or shape.

In one embodiment of this invention, a pocket approach or arrangement can use molded plastic opaque walls, when viewed from a top direction to see a shape of particular artwork segments that can partition off LED lighted segments, such as with walls, panels and/or structural baffles. An LED structure can be mounted on, with respect to and/or directly to a board, such as wired, soldered or otherwise electrically connected and/or mounted to a PC board, and positioned near, for example beneath each segment. The LED structure can be pressed into or otherwise positioned or mounted with respect to a pocketed light diffuser, for example a clear or translucent etched plastic, in a desired shape of the segment.

In another embodiment according to this invention, to accomplish an evenly distributed lighting, segments of the wall structure can be molded into different shapes, such as art shapes. The segment shapes can be injection molded plastic, for example, with or without etching to provide a textured outer surface which can but need not be back painted with a white or non-white paint or other similar material. LED structures can be fixed, mounted and/or positioned adjacent or near an edge of the segment, to distribute light into the segment. Edge lighting can help implement different intricate or complex graphic designs.

When the illuminated graphics panel of this invention is constructed with LED structures, the overall dimensions will typically be greater than a similar product manufactured with one or more EL elements 28. The LED structure requires increased segment material to more evenly distribute light for each graphic segment, which can result in added thickness of the panel to achieve better light distribution, depending upon the particular use. However, if costs associated with the LED technology are or become low enough, there can be a significant market demand for the LED technology.

Figures 1, 2:
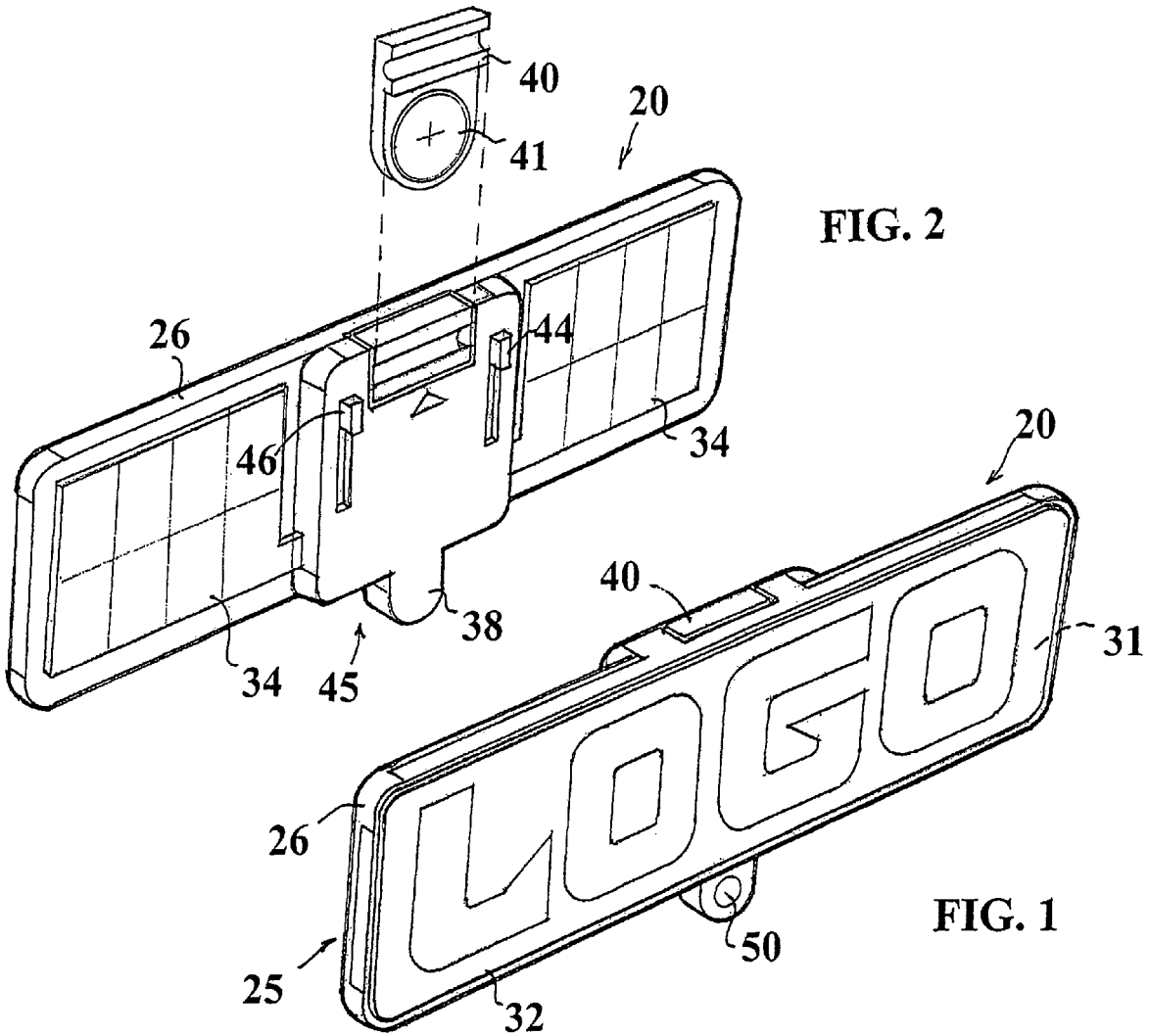
FIG. 1 is a perspective front view of a light film device having a graphic display area and a light sensor location, according to one embodiment of this invention.
FIG. 2 is a perspective rear view of the light film device as shown in FIG. 1, including solar panels and a removable battery module.
Figure 3:
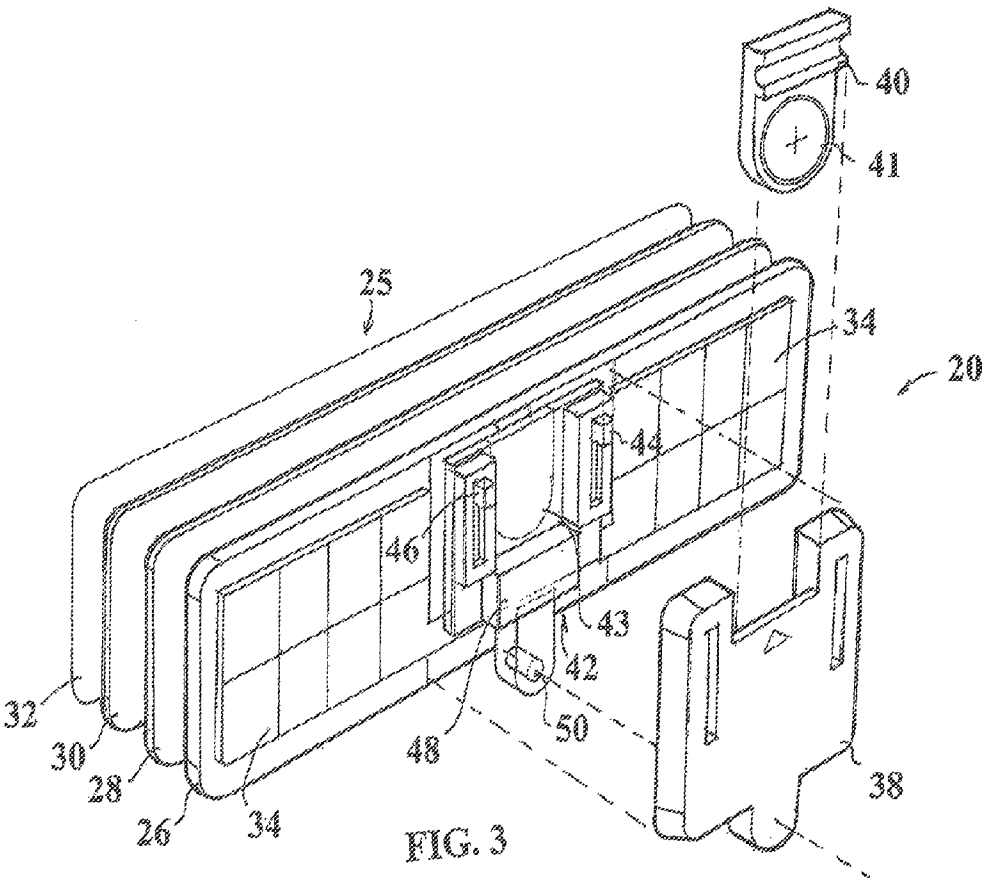
FIG. 3 is an exploded perspective rear view of a light film device, according to one embodiment of this invention.
Figure 7:
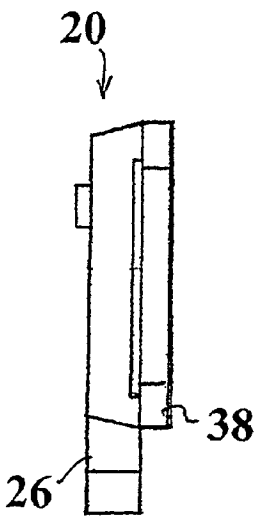
FIG. 7 is a side view of the light film device, as shown in FIG. 3.
Figure 5:
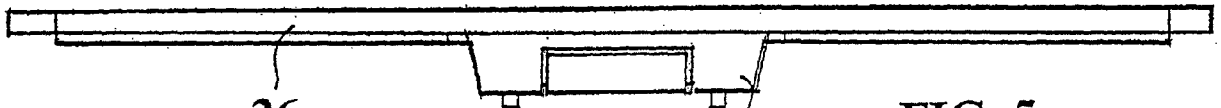
FIG. 5 is a top view of the light film device, as shown in FIG. 3.

In one embodiment of this invention, such as shown in FIGS. 1-7, light film device 20 comprises light film component 25. Light film component 25 comprises frame or housing 26 for mounting or containing housing elements of light film component 25. Housing 26 can have any suitable shape and/or size to properly house one or more elements of light film component 25. An electroluminescent (EL) element 28, a translucent element 30 and an adhesion element 32 are positioned, arranged or configured in a layered, sandwiched or surface-to-surface relationship and are securely housed within and/or connected to housing 26, according to embodiments similar to that as shown in FIGS. 1-3. Preferably but not necessarily, each element surface or another suitable portion of each element is positioned with respect to a surface or another suitable portion of an adjacent element of light film component 25. For example, elements of light film component 25 can be in surface-to-surface contact with adjacent or nearby elements of light film component 25. An interchangeable panel, such as a tinted translucent panel, can be positioned to mount between EL element 28 and the surface to which housing 26 is mounted, such as window 100. An interchangeable translucent graphic panel having a layered assembly allows EL element 28 to be standardized, for example as white backlight, and thus custom printing on clear plastic sheet material can be used to reduce costs, inventory and/or production time.

In certain embodiments of this invention, the elements of light film device 20 can have any suitable overall and/or cross-sectional shape and/or can be configured in any suitable relationship. It is possible to provide a layered configuration wherein each element layer is laminated, such as during manufacture or construction, to preferably but not necessarily produce an apparatus or device having a relatively slim design. It is also possible to provide a backer plate configuration, wherein elements are integrated with, affixed to and/or connected to a backer plate, such as an injection molded backer plate. It is also possible to provide a backer housing configuration, wherein elements are integrated with, affixed to and/or connected to a module, such as an injection molded module. In each configuration, subassemblies can be mounted at any suitable location to dedicated or available surfaces, including any suitable vehicle surface.

EL element 28 of this invention may comprise any suitable conventional EL element available in the marketplace. In one embodiment of this invention, EL element 28 comprises at least one panel. For example, EL element 28 may include at least one white color or non-color panel that extends along at least a portion of a front surface or area of housing 26. EL element 28 can comprise other color panels in addition to or in lieu of the at least one white color or non-color panel, any of which is suitable to back light graphics panel 31. Preferably but not necessarily, EL element 28 covers all or substantially an entire area of the front surface or area of housing 26. In certain embodiments of this invention, EL element 28 can be produced or printed with any suitable graphic, which may eliminate the need for element 30.

In certain embodiments of this invention, EL element 28 can have a plurality of segments, each of which can be individually controlled. Control module 42 can emit an output signal to any one or more of the different segments of the EL element 28. With the independent control of each segment, many different complex static or dynamic graphics can be displayed with light film device 20 of this invention.

Figure 8:
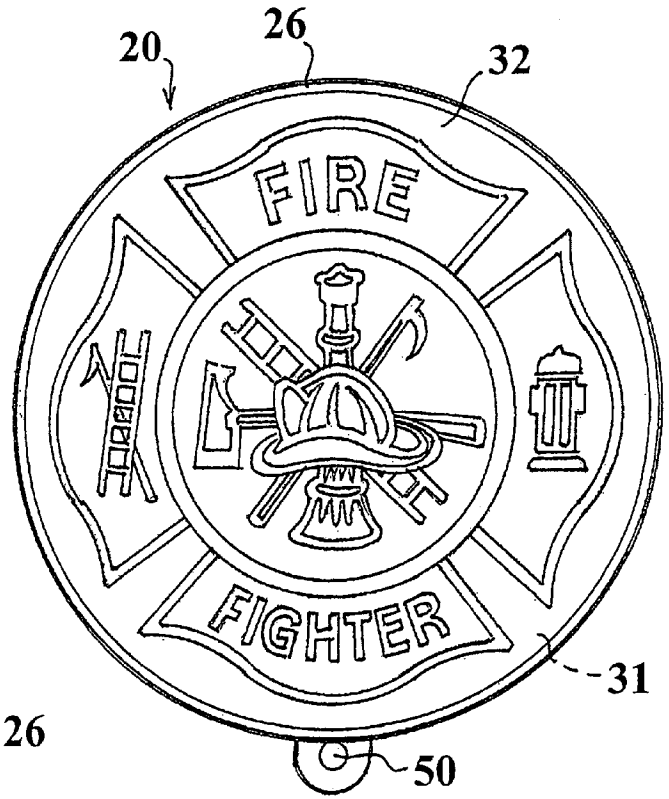
FIG. 8 is a front view of a light film device, according to another embodiment of this invention.
Figure 10:
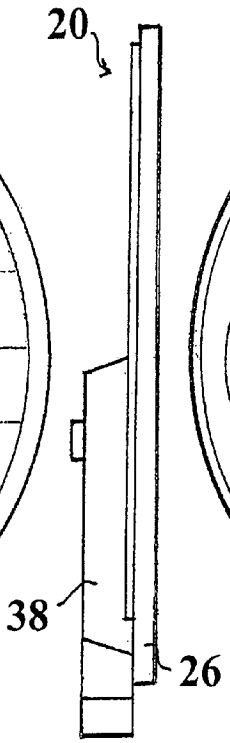
FIG. 10 is a side view of the light film device, as shown in FIG. 8.
Figure 9:
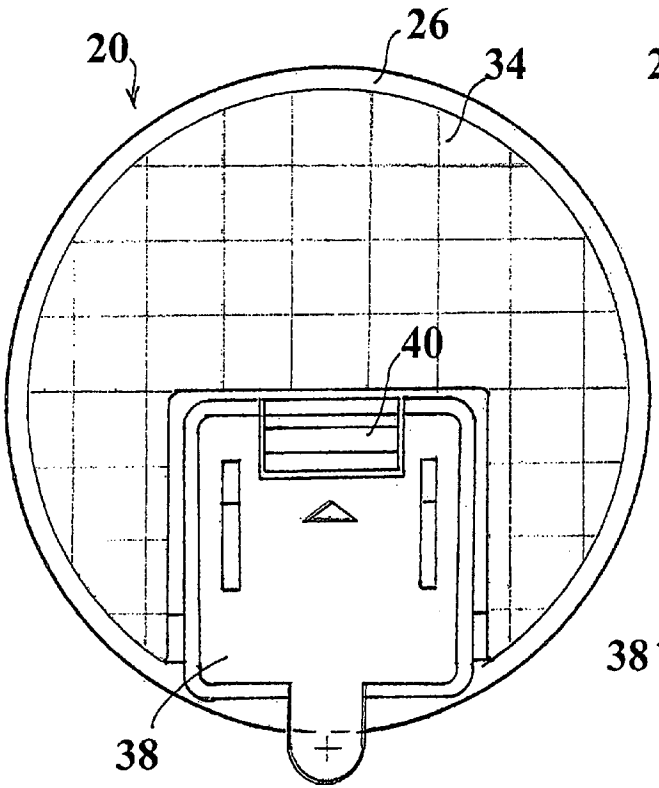
FIG. 9 is a rear view of the light film device, as shown in FIG. 8.
Figure 16:
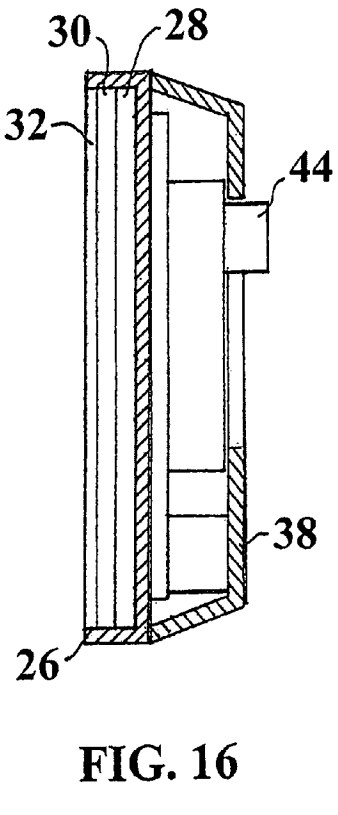
FIG. 16 is a sectional view of the light film device of FIG. 4, taken along section line C-C shown in FIG. 4.
Figure 15:
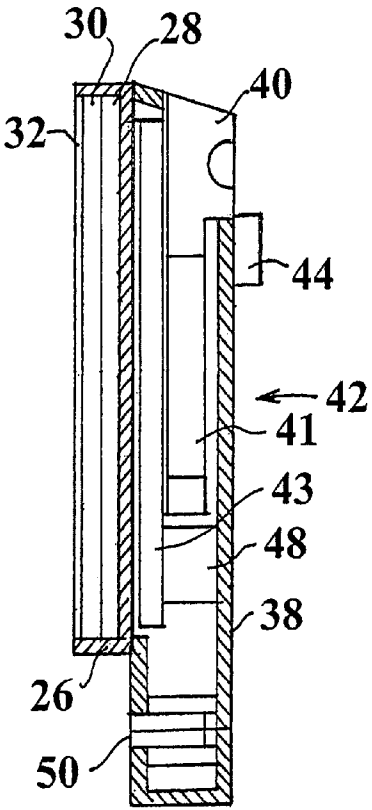
FIG. 15 is a sectional view of the light film device of FIG. 4, taken along section line B-B shown in FIG. 4.
Figure 14:
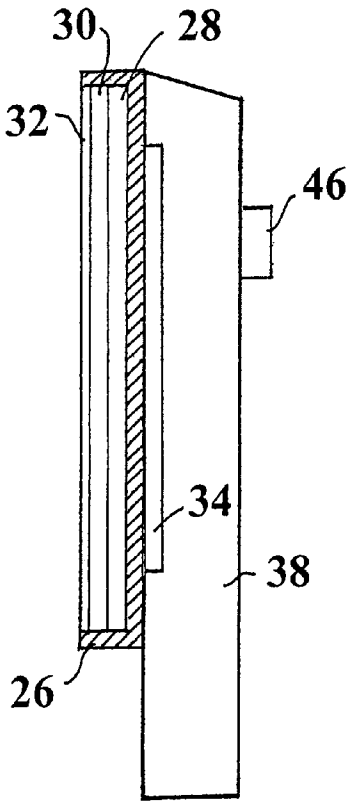
FIG. 14 is a sectional view of the light film device of FIG. 4, taken along section line A-A shown in FIG. 4.

As shown in FIG. 3, element 30 may or may not be translucent and is positioned in a relatively fixed relationship with respect to EL element 28. For example, a first surface of element 30 preferably contacts an adjacent surface of EL element 28. Element 30 may comprise a suitable or desirable graphics panel 31, such as shown in FIGS. 1 and 8. Graphics panel 31 can include any desirable graphic, such as a logo as shown in FIG. 1, a fire department plaque as shown in FIG. 8 or an American flag as shown in FIG. 11, for example. Those skilled in the art will understand that element 30 can include graphics panel 31 having any desirable or suitable dimensions, cross section and/or shape. Graphics panel 31 can have any desirable number and/or configuration of graphic displays. Element 30 and/or graphics panel 31 can include any suitable film material, such as an acetate film layer, a LEXAN film layer or any other suitable clear sheet material. Preferably but not necessarily, element 30 and/or graphics panel 31 each is printed with a translucent ink, such as CMYK ink or a spot color inks.

Adhesion element 32 comprises one surface that contacts another surface of element 30, for example as suggested by FIG. 3. Adhesion element 32 includes a surface that contacts a support or mounting surface, such as a business front window, a door window or a vehicle window. Adhesion element 32 can be of any suitable clear or translucent adhesive, such as in a layer form. Adhesion element 32 may include a suitable adhesive component or layer to removably secure light film device 20 to the mounting surface so that light film device 20 is securely mounted to the mounting surface when in use, but can be selectively removed from the mounting surface without damage to adhesion element 32 and/or the mounting surface. Other suitable components, such as suction cups, brackets, other adhesives, static cling devices, screws, wire, hook-and-loop fasteners and/or any other mechanical, electrical and/or magnetic connector can be used to mount light film device 20 with respect to a mounting structure or surface.

In one embodiment of this invention, at least one solar panel 34 is operatively connected, electrically and/or mechanically, to light film component 25, for example to provide backup power and/or recharge power to a battery operated or DC powered light film device 20. Solar panel 34 can be integrated with light film component 25, can be connected to light film component 25, such as to a back surface of housing 26 as shown in FIGS. 2 and 3, and/or can be an independent component tethered to light film component 25 via a wire or cable connection 36, such as shown in FIG. 12. Preferably but not necessarily, solar panel 34 is positioned, mounted or located with respect to any suitable structural component of a vehicle, for example to optimize absorption of solar power.

In certain embodiments of this invention, solar panel 34 can be structurally, mechanically and/or electrically connected to or integrated with housing 26 so that the solar collectors rotate and/or pivot with respect to each other and/or housing 26, for example to take advantage of any moving solar energy source. Any suitable servomotor control, structural and/or electrical connection can be used to accomplish any suitable relative movement. Single or multiple solar panels 34 can be used to accomplish different physical arrangements. When light film device 20 of this invention is used in a vehicle, the moveable solar panels 34 can be programmed to manually and/or automatically move to take advantage of a solar energy source and/or to at least partially conceal solar panel 34.

Figure 4:
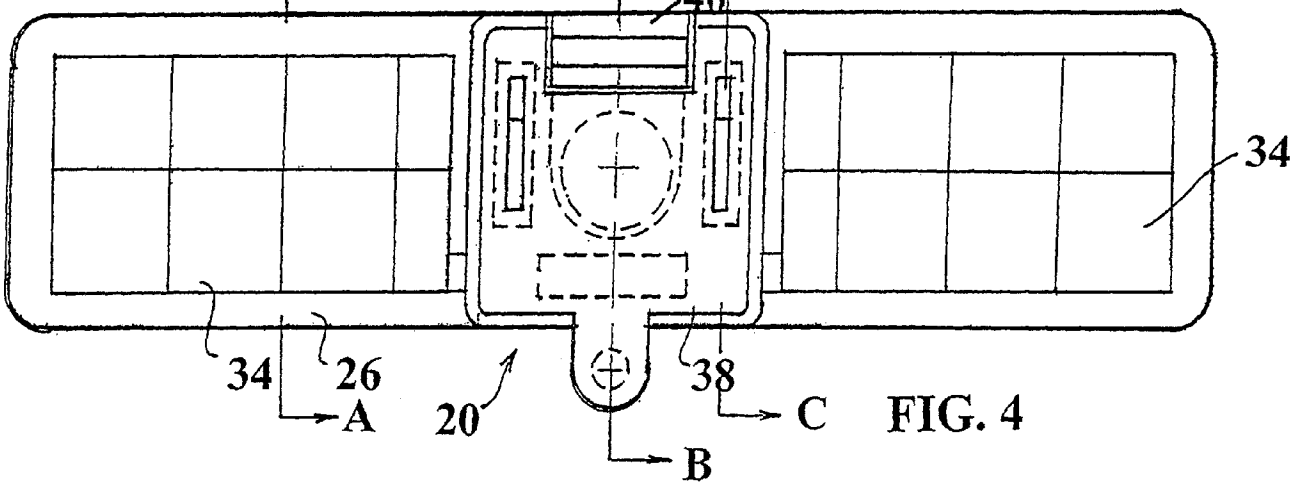
FIG. 4 is a rear view of the light film device, as shown in FIG. 3.
Figure 6:
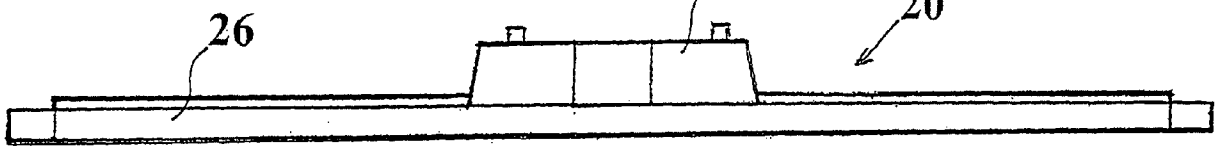
FIG. 6 is a bottom view of the light film device, as shown in FIG. 3.

Light film device 20 may comprise battery module 40 positionable or mountable with respect to housing 26 of light film component 25. In one embodiment of this invention, battery module 40 is slidably positionable between module housing 38 and light film component housing 26, such as shown in FIGS. 2-4. Battery module 40 houses a suitable battery 41, such as a lithium cell, Ni-cad rechargeable button cell or standard AAA battery, which powers control module 42. Alternatively, control module 42 can be powered by DC power via power ports located within a vehicle, or even by another suitable voltage. In one embodiment of this invention, solar panel 34 is connected to battery 41 to recharge battery 41, as necessary.

As used throughout this specification and in the claims, the phrase control module is intended to be interchangeable with the phrase control device, the phrase controller, the phrase smart module and/or any other similar phrase that describes a programmed apparatus that controls one or more functions.

In one embodiment of this invention, control module 42 is in communication with a programmed controller, such as PC board 43, which can be mounted in a relatively fixed position with respect to light film device 20. Control module 42, PC board 43 and/or another suitable control element can control or can be programmed to control the operation and management of light film device 20. Preferably, as shown in FIG. 3, at least one of a plurality of components, such as a mode switch or sensor 44, a dim switch or sensor 46, a motion switch or sensor 48 and a light switch or sensor 50, each is operatively connected to and in responsive communication with PC board 43 and/or control module 42 to operate and/or manage an output of light film device 20. Any one or more of the switches or sensors can be hard wired to control module 42 and/or can communicate in a wireless mode with control module 42, such as by using Bluetooth™ technology or another suitable communication technology or protocol. At least one of the mentioned sensors, or another suitable sensor, can each emit a sensed signal. In one embodiment of this invention, control module 42 receives the sensed signal and emits an output signal as a function of the sensed signal, to operate EL element 28 or another suitable illuminated graphics panel.

In certain embodiments of this invention, light film device 20 may include any number of the components discussed in this specification, in addition to other suitable or interchangeable components known to those skilled in the art. Mode switch 44 can comprise a multiple position switch including an off position, a motion-on position, a motion-off position, and/or a constant operation position. Mode switch 44 can be used to select a position that operates light film device 20 within any necessary regulation or limited parameter. Dim switch or sensor 46 can include settings to adjust a lumens output level, as desired, for example to conform to any local ordinance, such as vehicle regulations within a particular jurisdiction. Motion sensor 48 can comprise any suitable sensor, such as a spring-type sensor, a rocker-type sensor, an accelerometer, a speedometer, a directional sensor and/or a position sensor. Light sensor 50 preferably communicates with control module 42 to provide appropriate power for proper operation of light film device 20, depending upon the time of day and/or weather conditions, such as darkness, cloudiness, rain, snow and/or fog.

Control module 42 can be interfaced with any suitable position identifying device, such as a Global Positioning System device. As used throughout this specification and in the claims, the phrase position identifying device is intended to be interchangeable with the phrase Global Positioning System device, and is also intended to be interchangeable with any other suitable mechanical and/or electrical device that identifies a position or location of light film device 20 according to this invention. In certain embodiments of this invention, control module 42 can be programmed to adjust any controllable parameter of light film device 20, such as a lumens output level. With such adjustment capabilities, light film device 20 of this invention can be used to manually or automatically identify a position and conform to local ordinances or regulations. Some local areas may require a minimum and/or a maximum lumens output level, which control module 42 can identify and deliver as an output signal to any controllable component of light film device 20. In addition, if any local area prohibits, use of light film device 20 according to this invention, control module 42 can be programmed to automatically shut down or turn off light film device 20.

In certain embodiments of this invention, control module 42 can evaluate each sensed signal, process each sensed signal according to programmed steps, and then emit one or more output signals, each of which can include information, for example information to set a power rate at zero, partial power or full power.

In one embodiment of this invention, an internal timer switch can work or cooperate with motion switch 48 and activate at least one illumination switch to an on position, an off position or a partially powered position, after a determined time period has passed, for example a five (5) minute time period, based on a manual and/or an automatic mode determination and setting. Light film device 20 can also include a sound or noise sensor, a vibration sensor and/or a temperature sensor or switch. Additionally, various movement sensors can activate or trigger any one or more of programmed static and/or dynamic graphic animations.

Figure 18:
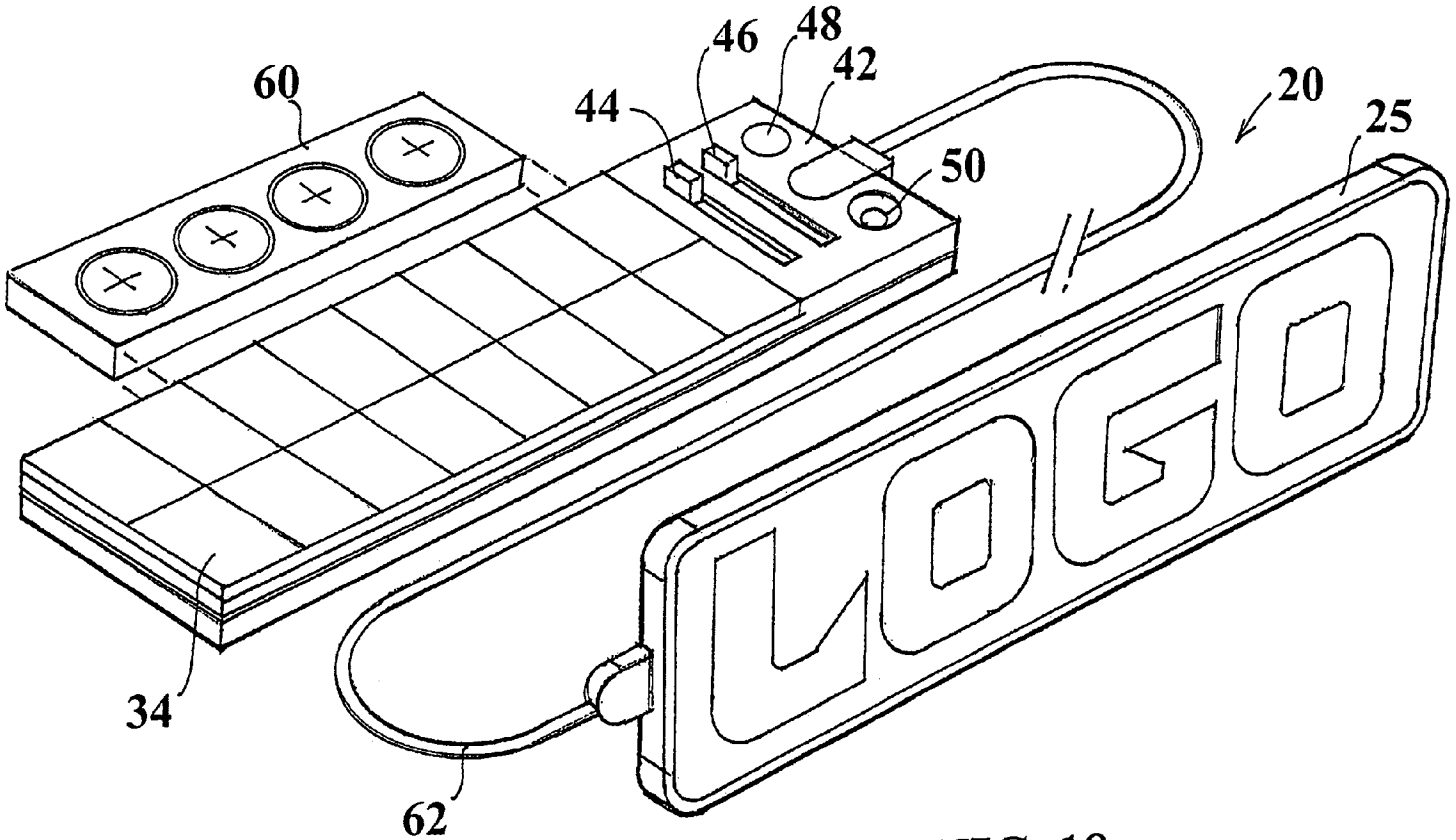
FIG. 18 is a perspective view of a light film device, including a battery pack and a solar panel, according to another embodiment of this invention.

As shown in FIG. 18, light film device 20 according to one embodiment of this invention comprises an independent or detachable control module 42, including mode switch or sensor 44, dim switch or sensor 46, motion switch or sensor 48 and light switch or sensor 50. A removable battery pack 60 and/or solar cell 34 can be connected via a connector, such as wire or cable 62 to light film component 25.

Figure 19:
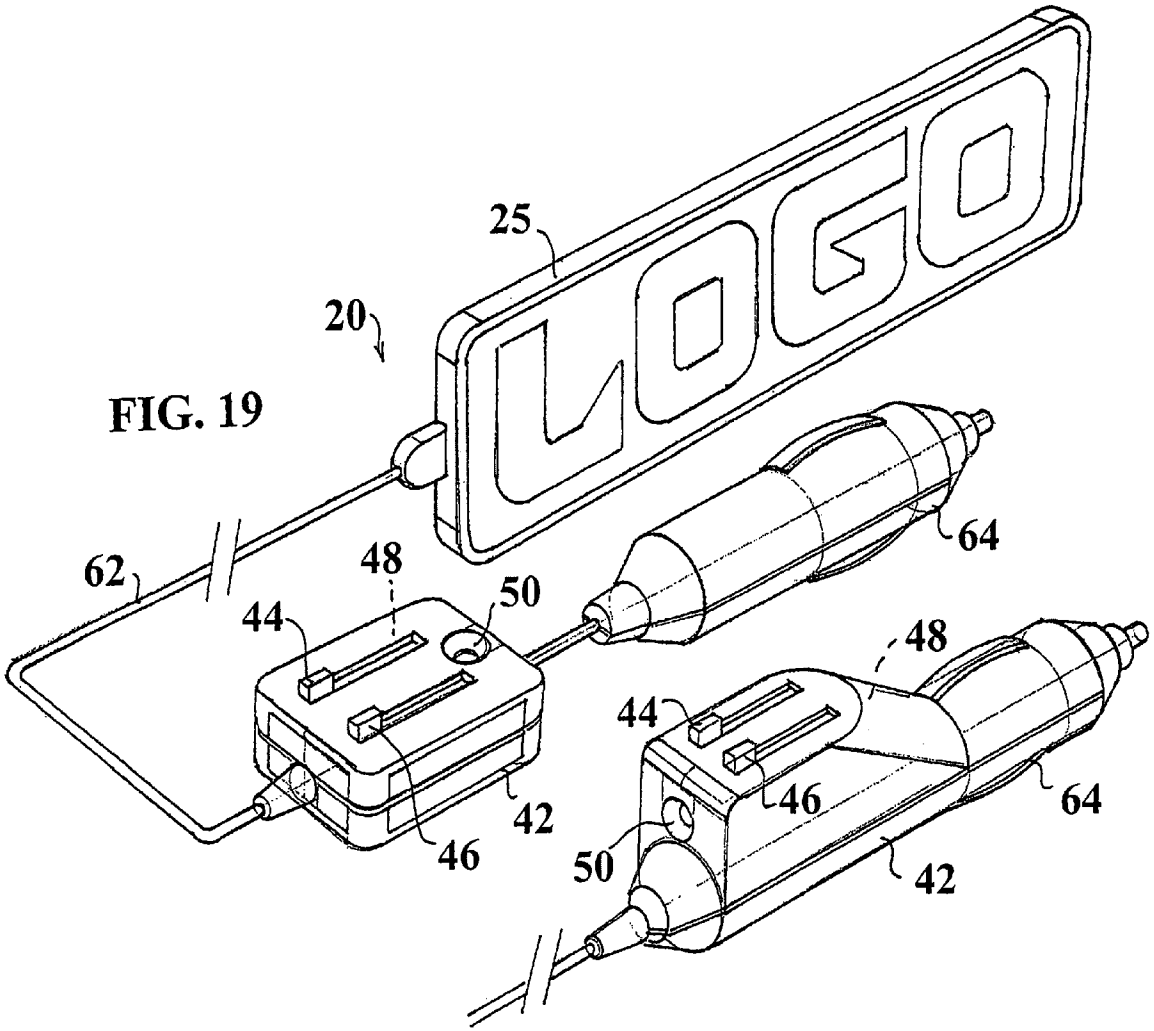
FIG. 19 is a perspective view of a light film device, showing two versions of an adapter plug, according to another embodiment of this invention.
Figure 22:
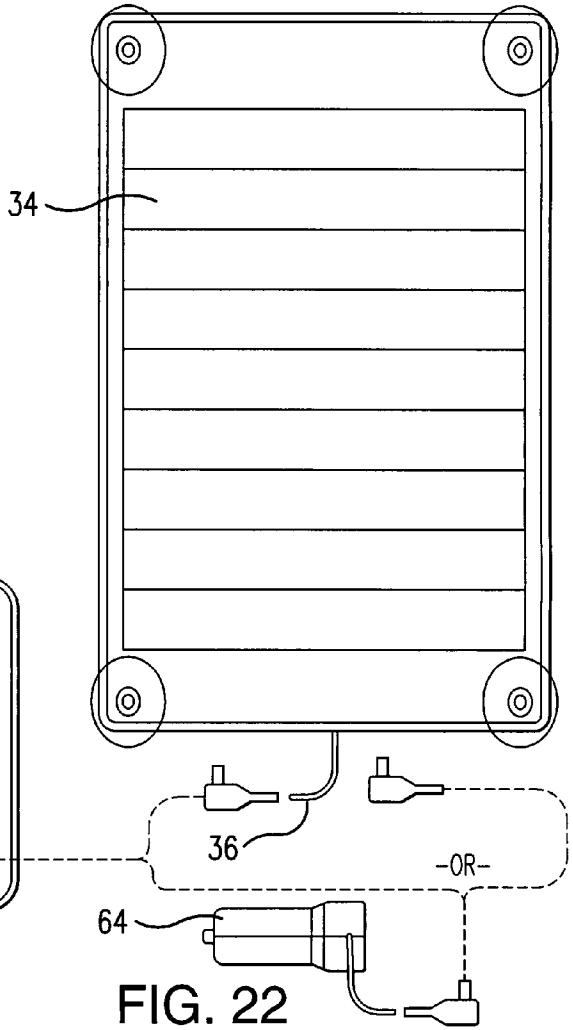
FIG. 22 is a front view of a solar panel, according to one embodiment of this invention.

As shown in FIG. 19, light film device 20 according to preferred embodiments of this invention can comprise an independent or detachable control module 42, including mode switch or sensor 44, dim switch or sensor 46, motion switch or sensor 48 and/or light switch or sensor 50, connected to or integrated with plug housing 64, for example to deliver any suitable DC or other power. In one embodiment of this invention, control module 42 can be connected in-line with wire 62, as shown in FIG. 19. The sensors and/or switches of this invention can be used to prolong battery life.

Light film device 20, according to this invention, can produce illuminated graphics, such as those that operate and function in a parameter controlled environment. An illuminated graphics panel can function within parameters defined by control module 42. EL element 28 can be an EL lighted graphics panel that functions within specific parameters, such as those defined by local ordinances or rules, by using different types of sensors and/or switches to feed input information to control module 42, which can be programmed to operate and/or manage a particular environment.

Light film device 20 of this invention can provide illuminated graphics, particularly those which operate in a user-friendly parameter controlled environment. Parameters necessary for a specific controlled environment can be met by suitably programming control module 42 to automatically, with or without a manual input, operate and/or manage the controlled environment.

Light film device 20 can be constructed to achieve specifically desired illuminated graphics in an user-friendly manner, the extent to which can be a function of the programming of control module 42. In certain embodiments of this invention, light film device 20 requires relatively little user input and can be used to achieve the display of critical information, such as safety and hazard information, as well as non-critical information, such as identifying membership in an organization or providing a graphic message. As an example of an non-critical function, housing 26 can be mounted in a rear window of a vehicle and a soccer ball can graphically move from left to right when the vehicle makes a left hand turn, or from right to left when the vehicle makes a right hand turn. Other similar non-critical messages can be communicated with light film device 20 of this invention.

Control module 42 and/or EL element 28 can be powered using a solar power cell alone or in combination with a battery power source. The solar power source can be used to automatically and/or manually recharge the battery power source. The solar power source can be part of or separate from housing 26. If separated from housing 26, the solar power source can be positioned at a different location, for example in a vehicle to optimize collection of solar rays.

Dim switch or sensor 46 can be used to automatically adjust a lumens output level in order to conform to any particular local regulations. Control module 42 can either calculate a position of light film device 20 and match the position with a stored library of lumens output level settings, for example to comply with a local ordinance, or can accommodate a manual input entry such as a zip code, to match in the stored or programmed library of values.

Light switch or sensor 50 can be used to detect the level of darkness in any particular environment and either automatically power light film device 20 or send a signal that alerts the user to power on light film device 20. Light switch or sensor 50 can be used in combination with dim switch or sensor 46 to adjust the lumens output level of light film device 20, as a function of the detected environmental conditions.

A timer can also be used in combination with motion switch or sensor 48, for example to switch on or off light film device 20, based on a particular mode setting. For example, control module 42 can be programmed to shut down power or go into a standby mode within a certain amount of time after a motion of a vehicle is no longer detected.

Any one or more of the sensors or switches of this invention can be used to send a signal to control module 42 that processes the one or more signals into a particular output signal that displays a particular graphic on EL element 28. For example, any sound, motion, temperature difference or other similar physical parameter can be processed through control module 42, to result in a graphic illustration. For example, stepping on an accelerator can result in a graphical display of a dynamic exhaust flame.

Any suitable integrated circuit board, either with or without one or more integrated circuit chips can be used in combination with or in addition to control module 42 to accomplish different programming capabilities for any input and/or output device.

Adhesion layer 32 can be of any suitable adhesive, either clear or colored, which is suitable to mount housing 26 and the associated elements with respect to a window or other suitable structure. EL element 28 can have any white or non-white color and may also comprise a back light theme graphics panel. EL element 28 may include multiple colored EL panels.

Housing 26 can be assembled in any suitable manner and can be mounted with respect to any suitable surface, including a vehicle surface.

Control module 42 may be locally mounted to housing 26 or can also be at a remote location, with wire or wireless communications, including Bluetooth™ technology or another suitable communication technology or protocol, to any device being controlled and/or sensed.

Figure 25A:
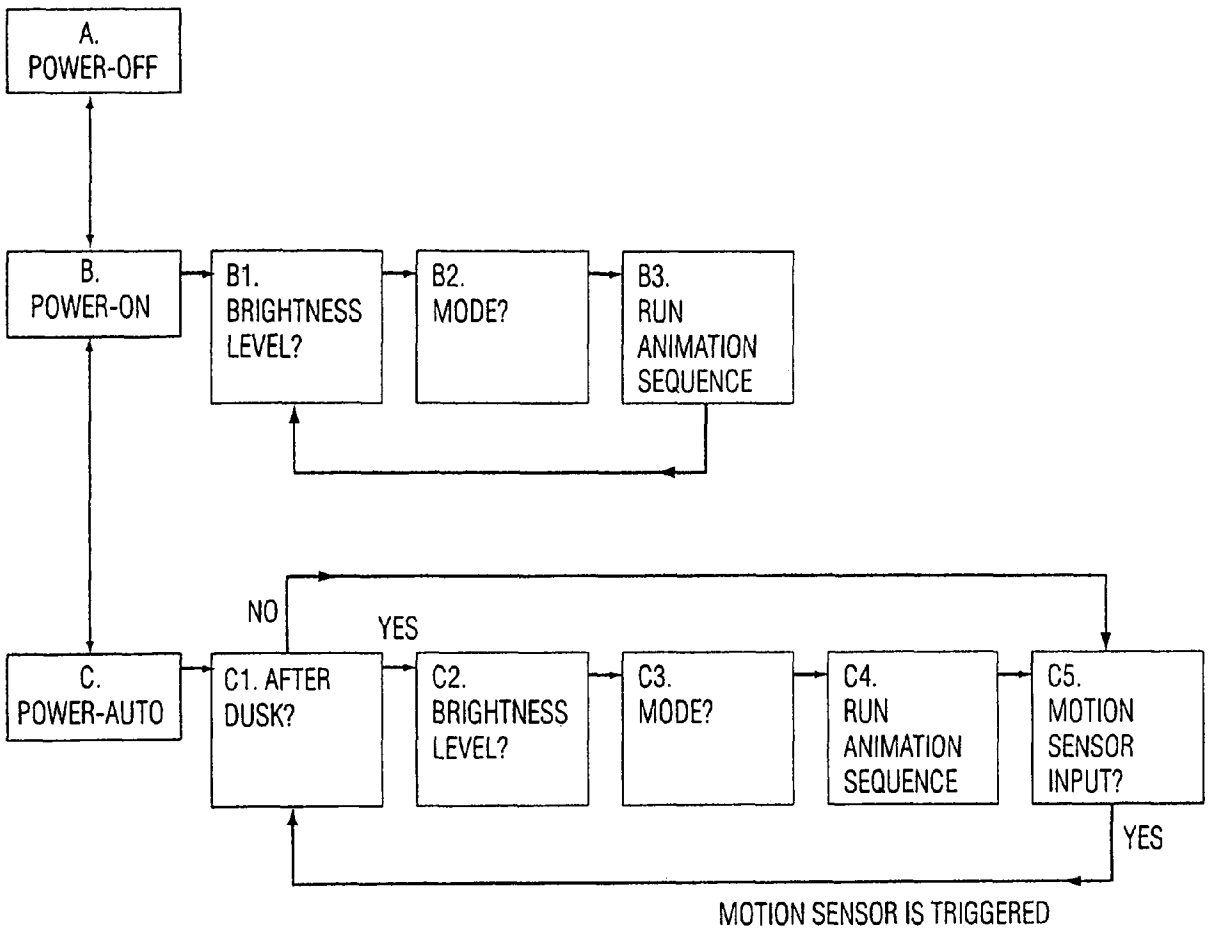
FIG. 25 is a flow chart showing program steps of light and motion control, according to one embodiment of this invention.

FIGS. 25-29 each shows a different flow chart of programmed steps for accomplishing different control modes, according to this invention. As shown in FIG. 25, EL element 28 can be activated in response to a signal received from motion switch or sensor 48. In the power-on setting, the program can check the brightness level, as set manually or automatically, for example to a level of low, medium or high power. In the power-on setting, the program then checks a position of mode switch or sensor 44. If the conditions are met, then EL element 28 displays graphics until the power is turned off.

As shown in FIG. 25, in the power-auto position, for light control, the program checks the signal received by light switch or sensor 50 and depending upon the position of mode switch or sensor 44, can run the graphics display either for a timed period or until activity is detected from motion switch or sensor 48.

Figure 21:
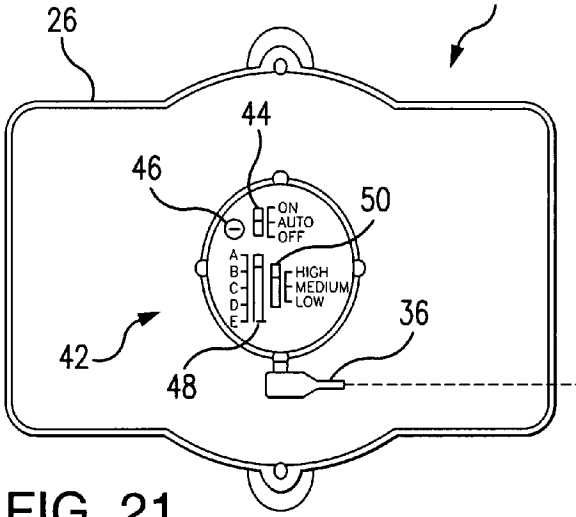
FIG. 21 is a rear view of the light film device, as shown in FIG. 20.
Figure 20:
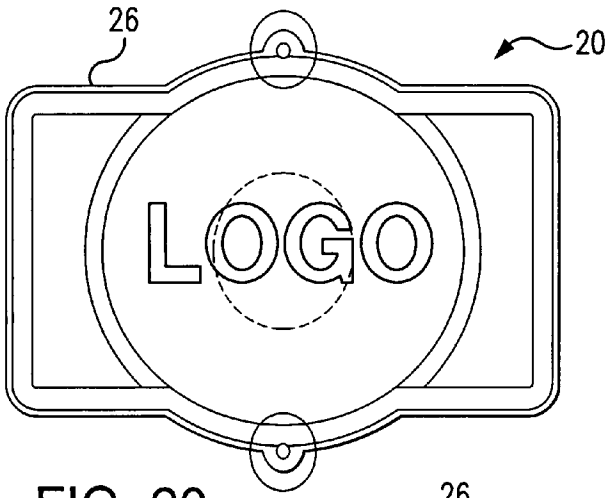
FIG. 20 is a front view of a light film device, according to another embodiment of this invention.
Figure 24:
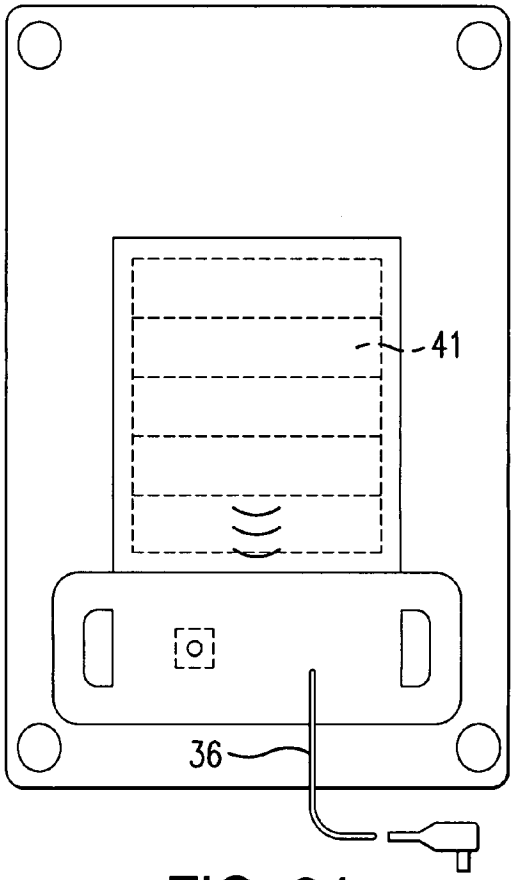
FIG. 24 is a rear view of the solar panel, as shown in FIG. 22.
Figure 23:
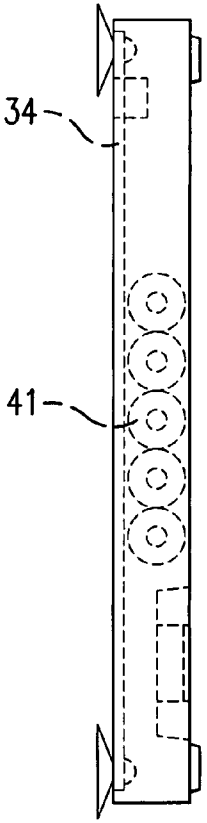
FIG. 23 is a side view of the solar panel, as shown in FIG. 22.

According to the control shown in FIG. 25, light switch or sensor 50 can automatically shut down power when an ambient light level is greater than the light level of EL element 28, for example to conserve power. The user can select one or more animation sequences programmed for delivery to EL element 28, for example by using a slide switch, such as shown in FIG. 21. FIG. 21 also shows a manual switch for selecting one of a plurality of preset levels, shown as low, medium and high, for the lumens output level.

Figure 26A:
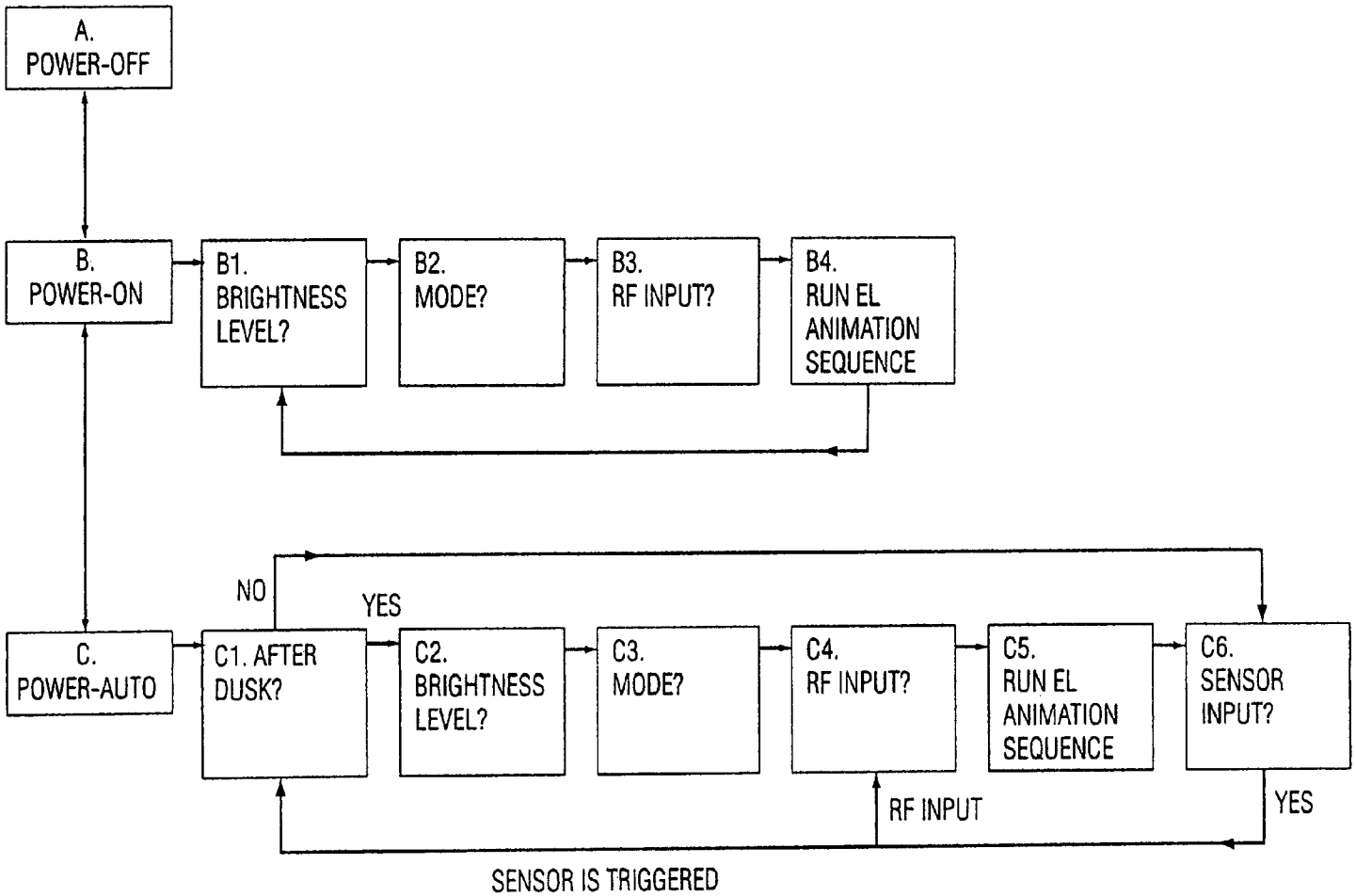
FIG. 26 is a flow chart showing program steps for light, motion and wireless control, according to one embodiment of this invention.

FIG. 26 shows another control scheme which includes a check for a wireless communication, such as a radio frequency (RF) signal. In addition to the program steps shown in FIG. 26, EL element 28 can be activated by a RF signal or by another informational signal, such as from a GPS satellite or a civil communications tower. In one embodiment of this invention, any lumens output level previously set can be overridden and/or replaced through another communication source, such as another RF input, or another GPS satellite input, or another suitable input signal. For example, an oncoming emergency vehicle can emit a signal that overrides and/or replaces the control function in order to display a warning signal to the driver or another nearby motorist.

Figure 27A:
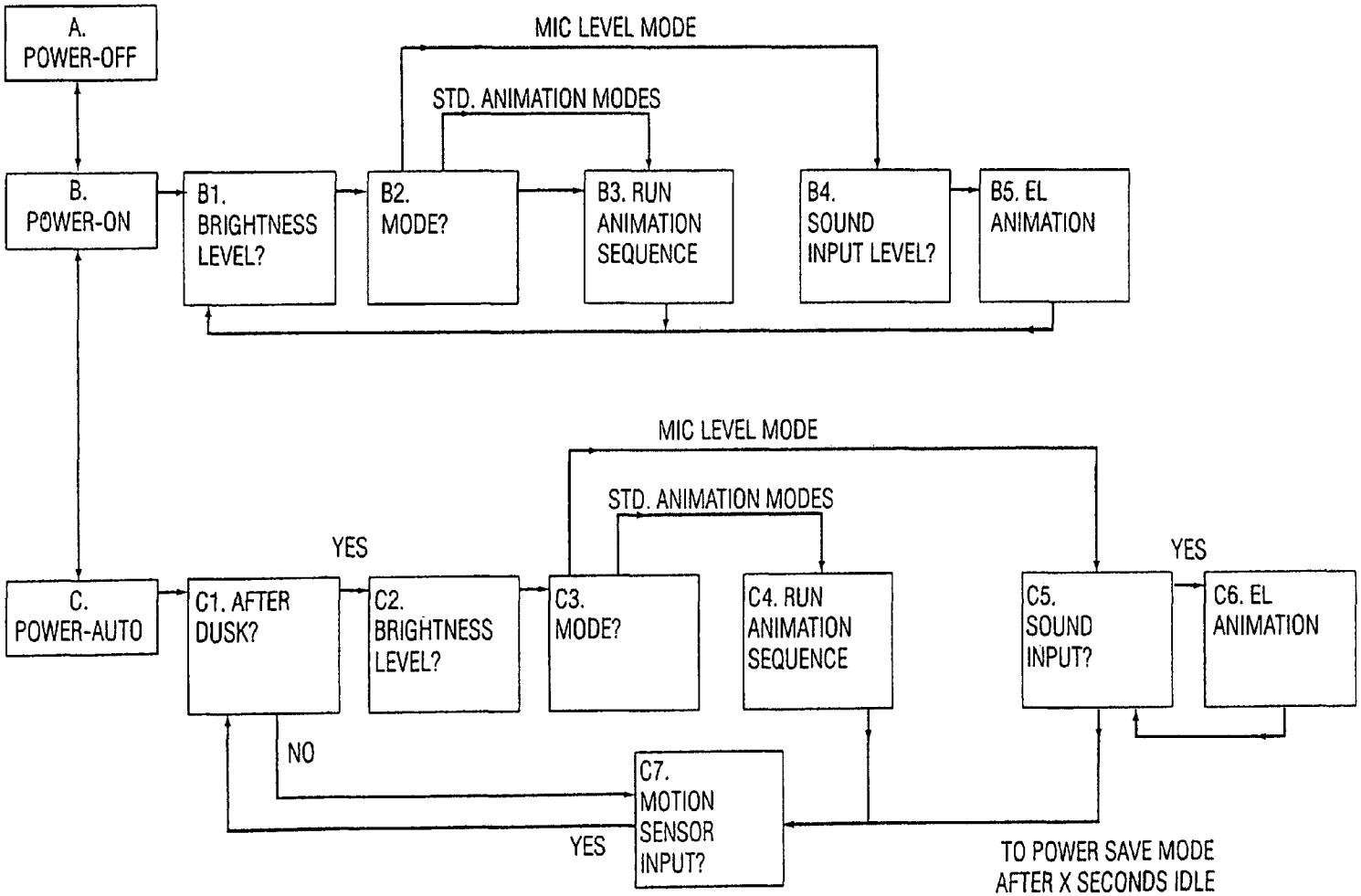
FIG. 27 is a flow chart showing program steps for light, motion and sound control, according to one embodiment of this invention.

FIG. 27 shows another control scheme according to a different embodiment of this invention, wherein a noise level sensor, such as a microphone can be used to control the output at EL element 28. A user can select different animation sequences or graphical displays, for example as a function of either a mode from the microphone or a level of output from the microphone.

Figure 28A:
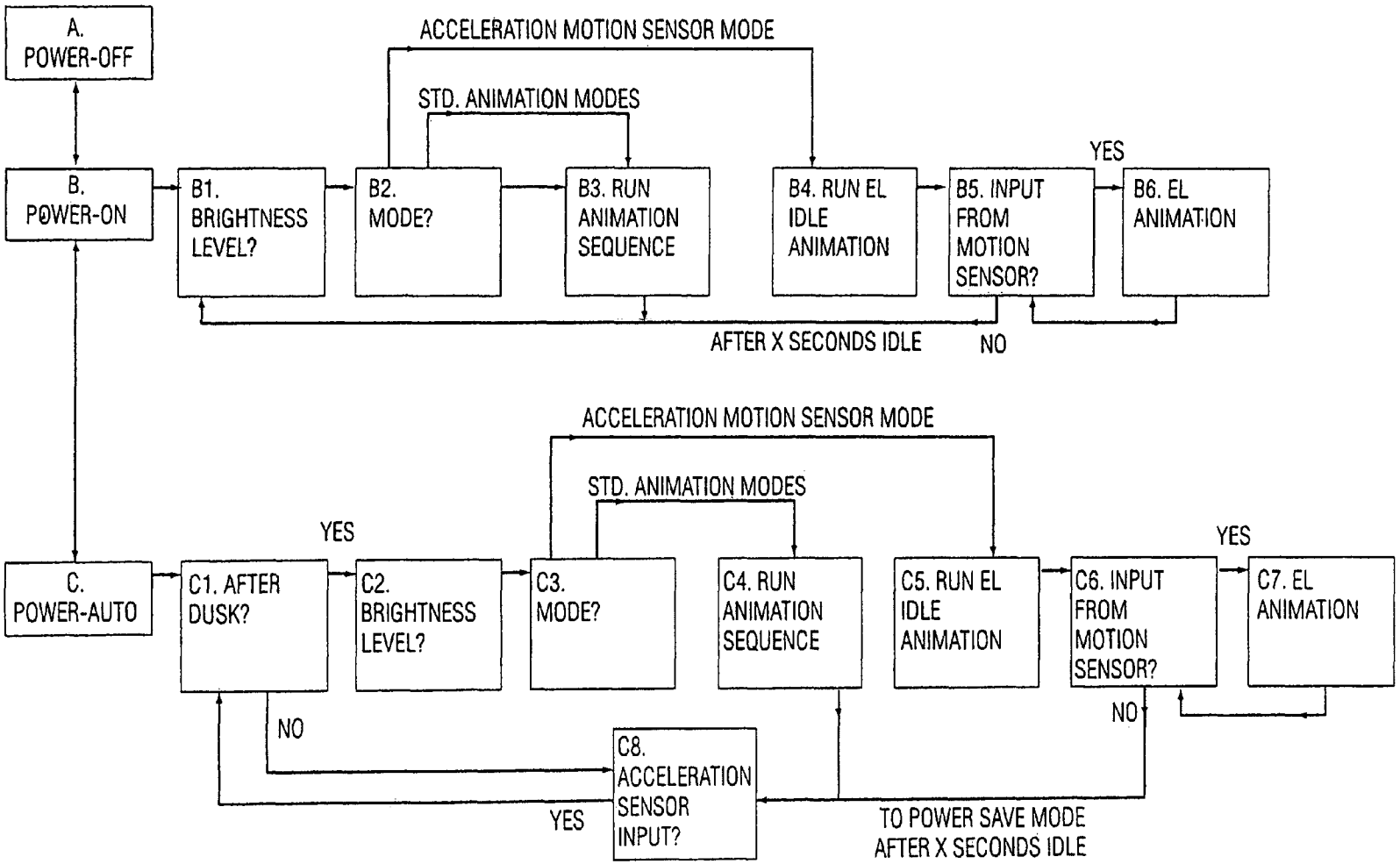
FIG. 28 is a flow chart showing program steps for light and acceleration control, according to one embodiment of this invention.

FIG. 28 shows a control scheme according to another embodiment of this invention, wherein an accelerometer is used to control the animation sequence or graphical display, for example as a function of a switch setting or a signal.

Figure 29A:
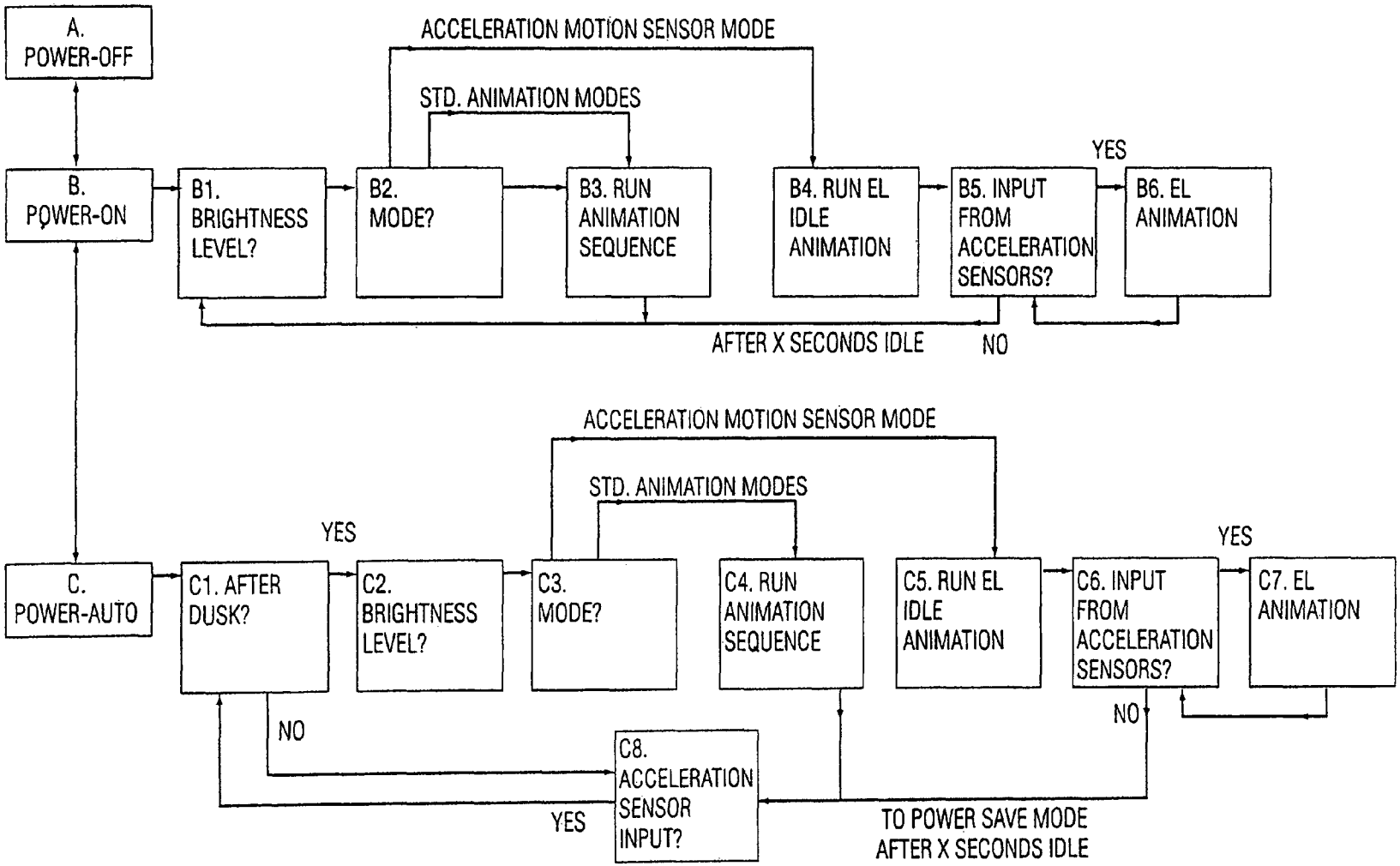
FIG. 29 is a flow chart showing program steps for light and dual acceleration control, according to one embodiment of this invention.

FIG. 29 shows a flow chart for a control scheme, according to another embodiment of this invention, wherein a dual-acceleration sensor is used to deliver the input signal to control module 42. The dual-acceleration sensor can be used to sense breaking, turning and/or accelerating and thus deliver one or more input signals to control module 42, which can then emit one or more output signals to display a complex graphic, such as the left to right and/or up and down motion of a soccer ball, as previously discussed.

The different program steps identified in FIGS. 25-29 can be interchanged with each other. Additional computer steps can be used to convert any one or more sensed parameters into one or more output signals that can result in a graphic display, even a complex graphic display.

FIGS. 30-41 show other embodiments of light film device 20, according to this invention. Light film device 20 of this invention can be used to project, create or display a generally two-dimensional image and make the relatively planar image appear as a generally three-dimensional image, such as by independently controlling the brightness levels at each segment 29, to create a visual display that appears to have depth, in three dimensions. Light film device 20 of this invention can be controlled, particularly as a function of time, to produce or display illuminations that change over a given time period, for example to display a choreographed image that can be luminous and/or non-luminous.

Figure 30:
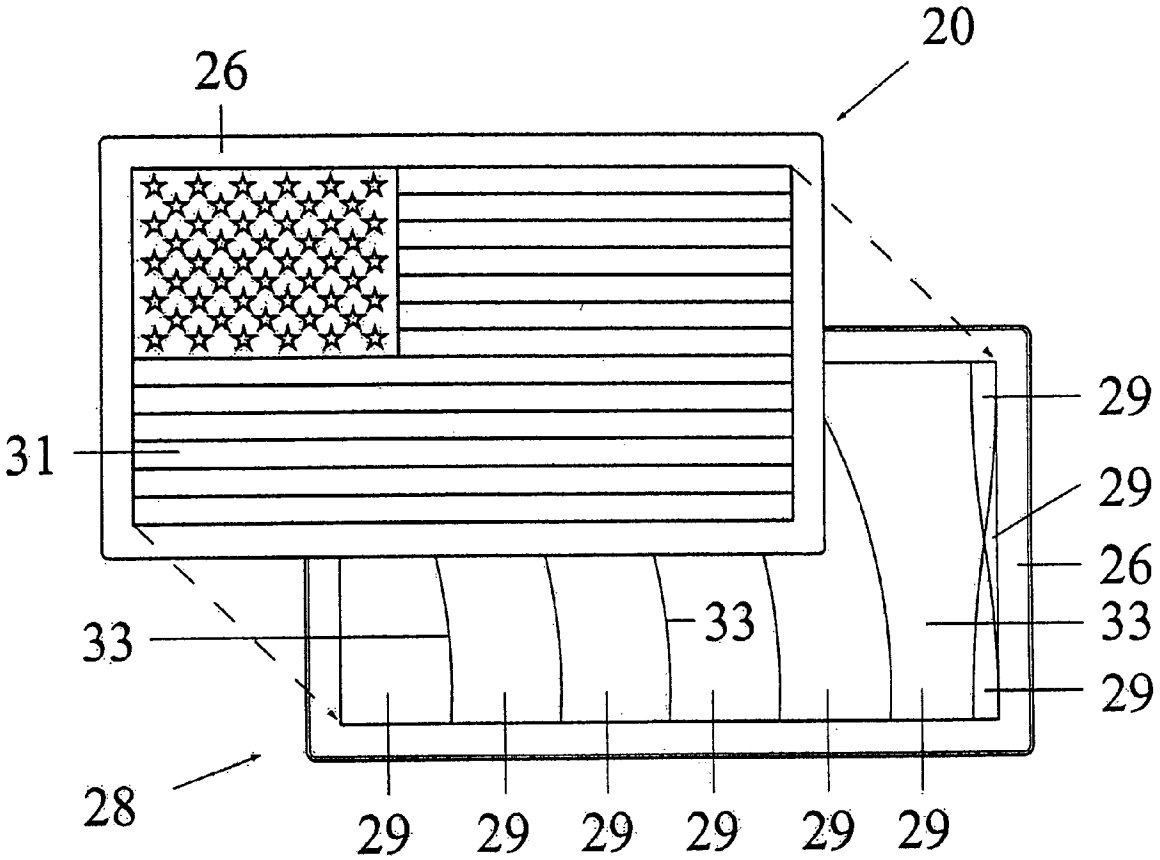
FIG. 30 is an exploded view of an outer layer or graphics panel positioned above an EL panel having a plurality of segments, according to one embodiment of this invention.
Figure 42:
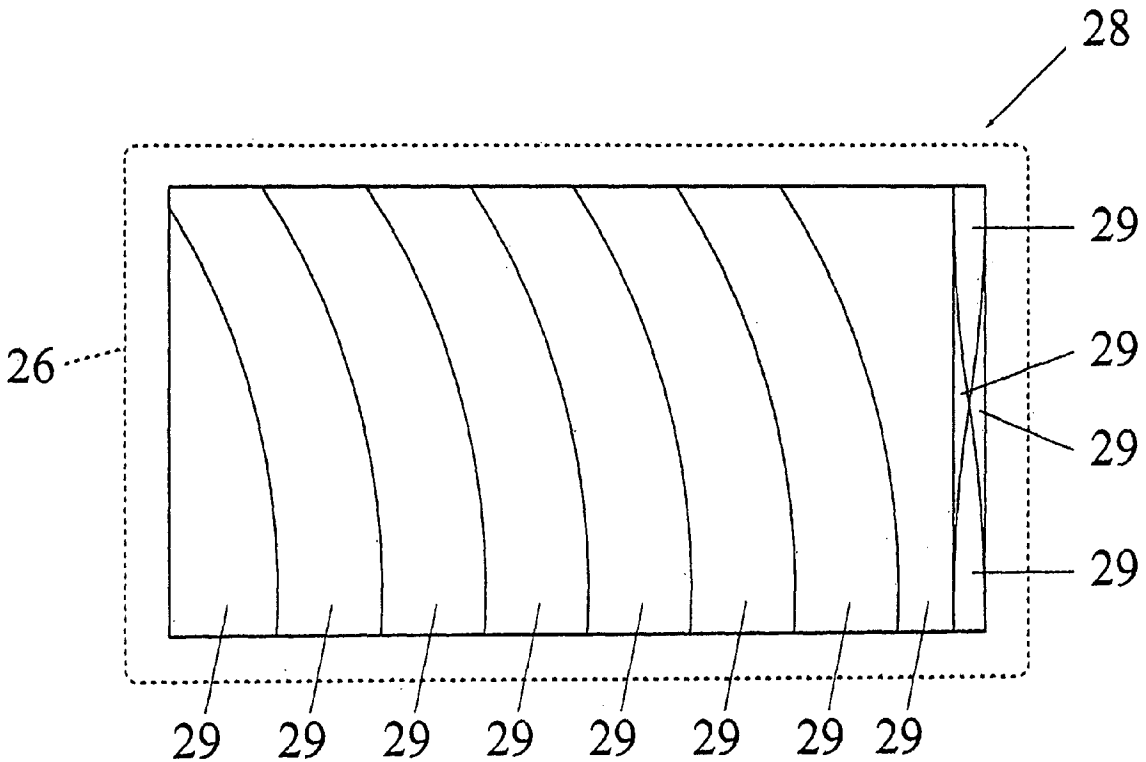
FIG. 42 is a plan schematic view showing a layout of different segments forming an EL element, according to one embodiment of this invention.

As shown in FIG. 30, the illuminated graphics panel comprises at least two segments 29 forming the overall EL element 28. As shown in FIG. 30, EL element 28 includes nine segments 29. As shown in FIG. 42, EL element includes twelve segments 29. Segments 29 can be positioned with respect to each other to form any suitable shape, including but not limited to the shapes shown in FIG. 32. Segments 29 can be positioned or mounted with respect to each other in a fixed manner or in a movable manner. For example, segment 29 can be supported by, mounted to, attached to or otherwise connected to substrate 35, such as shown in FIGS. 43-50. More segments 29, such as in a particular given area, can result in a better dynamic presentation and/or a smoother or fluidic visual presentation, particularly as segments 29 are operated over a given time period.

Figure 32:
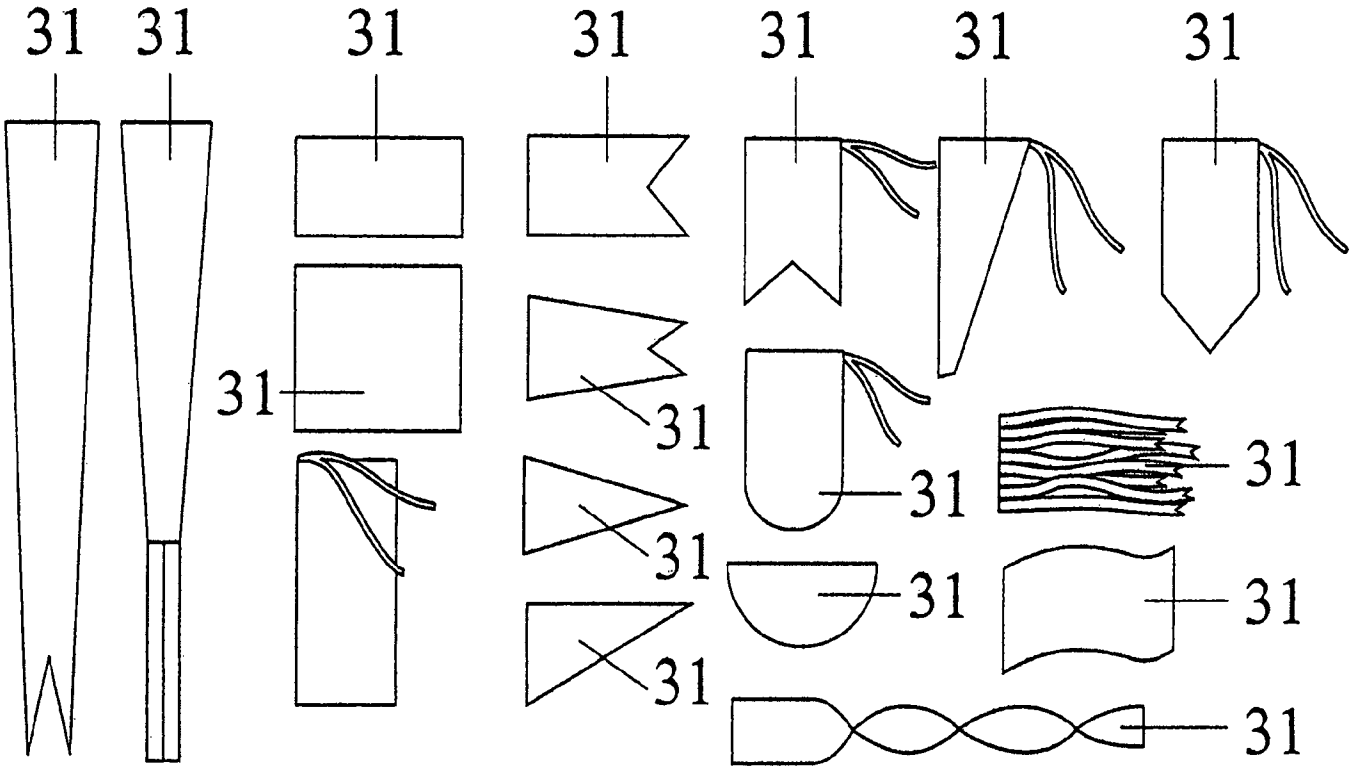
FIG. 32 shows several different silhouette views of different shapes, such as flag or banner shapes, according to different embodiments of this invention.

Because each of the plurality of segments 29 that form EL element 28 can be independently powered, such as at different illuminations or levels of luminosity, the image produced can appear as though it is moving. Each EL element 28 and/or segment 29 can be controlled and/or powered to produce either a luminous or a non-luminous display. Each segment 29 provides a source of light, a glow of which can be measured in lumens or can have a particular magnitude of a luminous flux. Segments 29 and/or EL element 28 may or may not be considered a light. The silhouette shapes of FIG. 32 show examples of different possible shapes of banners or flags. However, segments 29 can be sized, shaped and/or arranged to form any other suitable shape or design of EL element 28.

Controller or control module 42 can be programmed to manage the power that is delivered from a suitable power supply, such as battery 41 shown in FIG. 3, to each of segments 29, in any suitable programmed or selected manner. For example, control module 42 can result in each segment 29 being powered on and thus continuously illuminated, powered off and thus continuously not illuminated, or powered to an intermediate level that is constantly or intermittently varied. The control of the lighting of this invention can, for EL element 28, result in a completely lit mode, a completely unlit mode or a continuously varied or constant dimmed or brightened mode. Control module 42 can be programmed to and/or two or more segments 29 can be arranged or configured so that a same power input is simultaneously delivered to two or more segments 29. Thus, it is possible for two or more segments 29 to be powered by the same power input.

Figure 31:
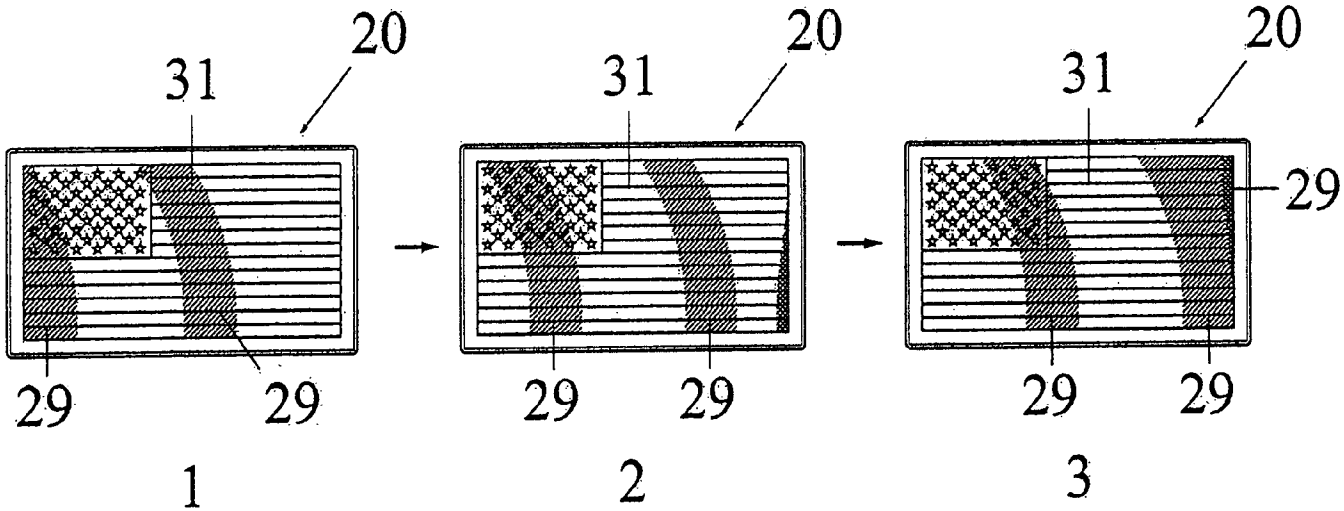
FIG. 31 is a series view showing how the individual segments of FIG. 30 can be illuminated differently to produce the appearance or effect of a waving flag.

FIG. 31 shows a series of only one, the same, EL element 28 operating during a time period. As shown from left to right in FIG. 31, at position 1, each segment 29 is independently powered to a predetermined power level. As time progresses, moving from position 1 to position 2, and then to position 3, it appears that there is a moving or dynamic image, such as a waving flag. Segment 29 located at the right edge portion in each position of FIG. 31, can be powered on, powered off, or powered to an intermediate level, for example to produce a waving effect or another suitable choreographed effect, such as shown between positions 1, 2 and 3, at the right edge of the flag image.

Independently powering each edge section, such as shown in FIG. 42 by the four rightmost segments 29, can create an edge ripple effect. Programming segments 29 at the edge section, or the edge ripple, for example can make the flag image appear as though wind is affecting the flag. The edge ripple can be accomplished at any suitable position, including but not limited to other peripheral edge or edge portion, of EL element 28.

Each segment 29 can have an independent power terminal or another power connector positioned, connected and/or structured so that it delivers or supplies power from a power supply to each independent segment 29.

Control module 42 can be programmed in any suitable manner, such as to independently deliver and/or vary a power level delivered to each segment 29. Control module 42 can receive any of the sensed signals mentioned in this specification, to operate and/or control the power level delivered to each segment 29, instantaneously, intermittently, continuously and/or constantly over any given time period.

Figure 34:
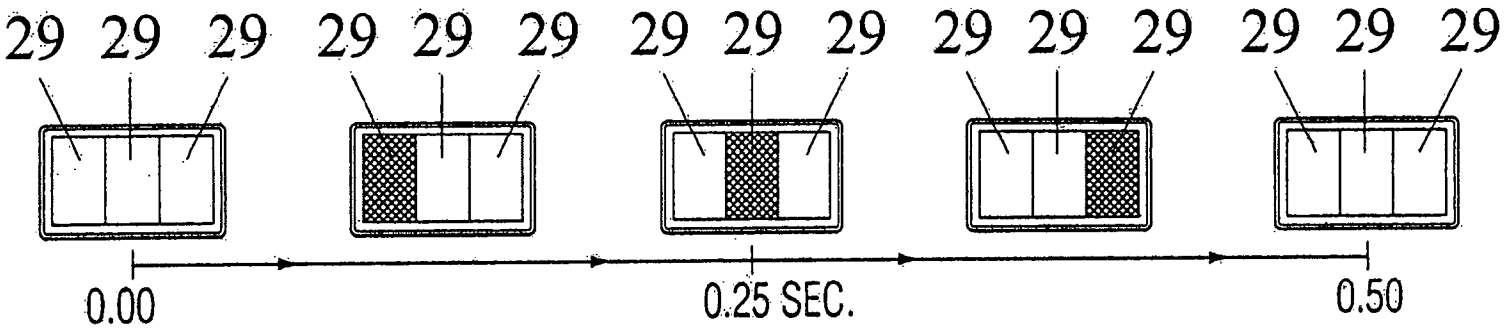
FIG. 34 is a series of diagrams illustrating how an EL panel having three segments can be powered between an on mode and an off mode, over a given time period, according to one embodiment of this invention.

FIG. 34 shows one embodiment of individual segment 29 being powered on or powered off, over a time period of 0.5 seconds. FIG. 34 shows each segment 29 operating in either an on mode or an off mode, at a given time.

Figure 35:
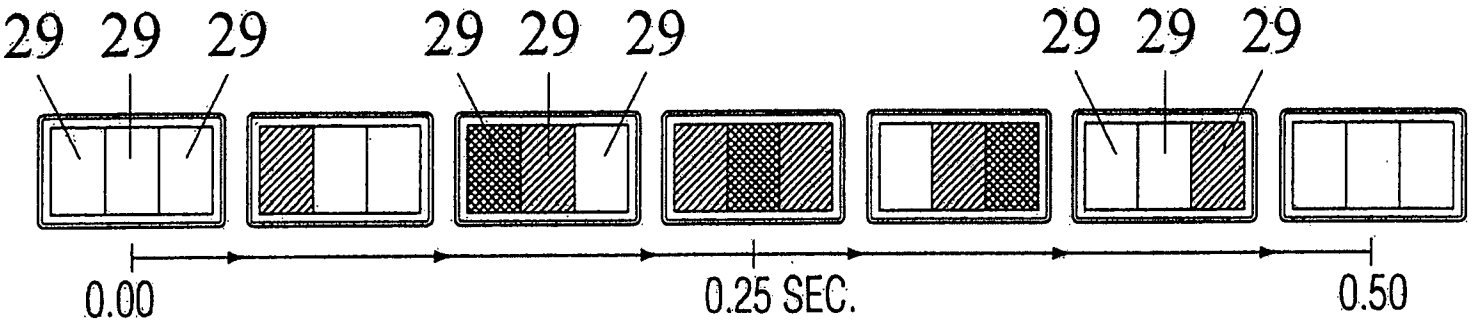
FIG. 35 is a series of diagrams illustrating how an EL panel having three segments can be powered between an off mode, an on mode and an intermediate power level, to have a variable illumination or intensity, according to another embodiment of this invention.
Figure 36:
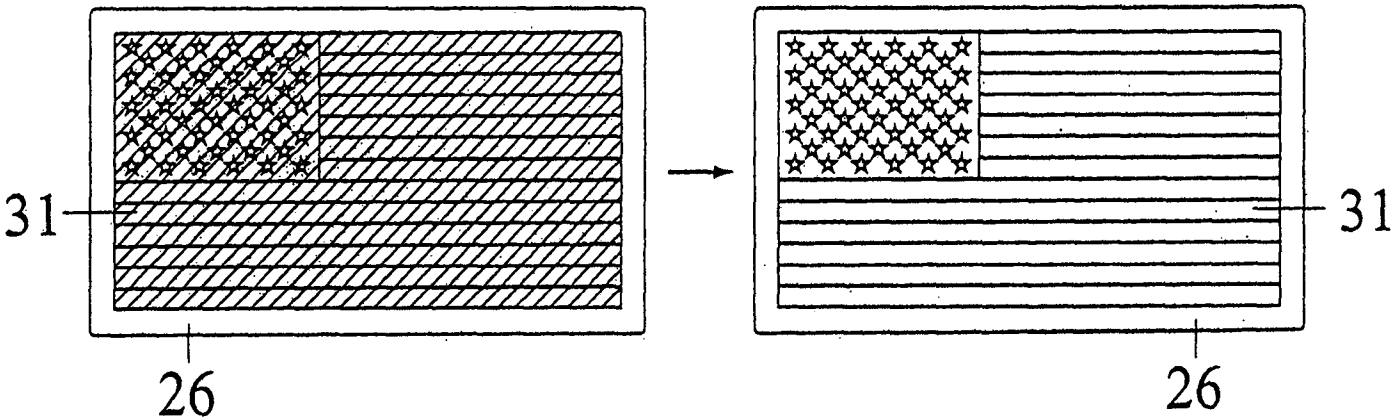
FIG. 36 is a series view showing an EL panel, to the left in an off mode and to the right in an on mode, according to one embodiment of this invention.
Figure 37:
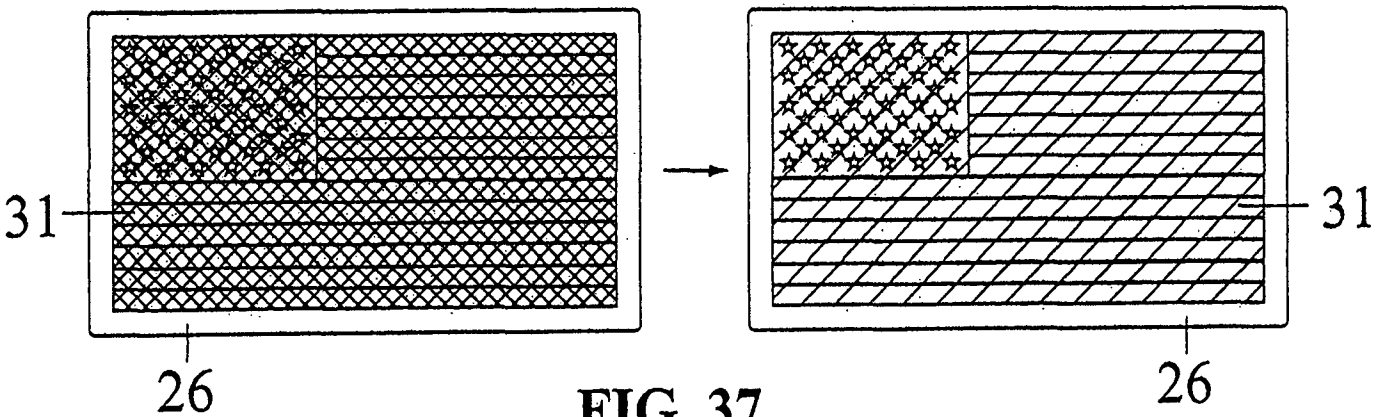
FIG. 37 is a series view showing an EL panel, to the left in an off mode and to the right in an on mode, according to another embodiment of this invention.
Figure 38:
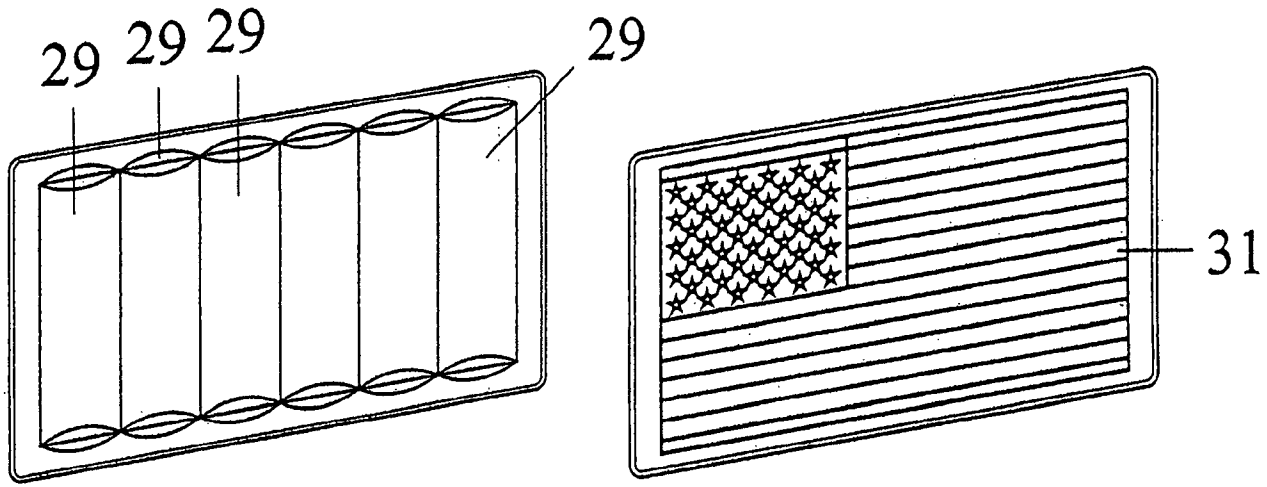
FIG. 38-41 each shows a series of two diagrams illustrating an EL panel with a particular segment layout, on the left side, and the corresponding outer layer positioned over the EL panel, on the right side, according to different embodiments of this invention.

FIG. 35 shows a series of only one or the same EL element 28 operating with segments 29 in different modes, also over a time period of 0.5 seconds. Each individual segment 29 is independently powered to a completely on mode, a completely off mode, or to an intermediate power level mode. The intermediate level of power can range between 0 and 100% of the power. At a zero power level, segment 29 is in an off mode. At a 100% power level, segment 29 is in an on mode. An intermediate power level can vary anywhere between the off mode, at zero, and the on mode, at 100%. In certain embodiments of this invention, an intermediate power level can be used to provide or create a deeper or more defined three-dimensional moving or dynamic image, such as displayed on EL element 28 and/or graphics panel 31.

Any suitable electronic circuit or integrated circuit may comprise at least part of the controller or control module 42 to toggle between or switch each segment 29 to the on mode or to the off mode, and also to deliver a predetermined power level to each segment 29, over a time period to dim or brighten each segment 29 to a predetermined or programmed intensity or luminosity level. In certain embodiments according to this invention, control module 42 can have an electronic circuit, chip or other suitable software loadable device with programmed different power levels and different timing sequences, to deliver a desired display or illuminated choreography.

Control module 42 or any other suitable computer or programmed controller can be used to operate segments 29 to produce an overall dynamic display that is either continuous or intermittent. For example, as shown in FIG. 31, the different segments 29, which are also shown in FIG. 30, are operated by control module 42 to produce a waving effect. At position 1 in FIG. 31, the first and fourth segments 29, in a left to right direction, are powered. At position 2 in FIG. 31, the second and fifth segments 29 are powered. At position 3 in FIG. 31, the third and sixth segments 29 are powered. After position 3 is operated, the sequence returns to position 1 and loops through as many sequences as desired. The sequencing and/or varying the power level at independent segments 29 can be used to produce or provide a shadowing effect when EL element 28 is operated. Although FIG. 31 shows one particular sequencing, any other suitable sequencing, pattern and/or timing can be used to produce a different image.

Control module 42 can be programmed to continuously operate at least one segment 29 and/or to intermittently operate at least one segment 29. For example, an intermittent sequencing can be used to produce an interrupted rhythm, which can be different than a waving effect. For example, an interrupted rhythm can be used to produce a shimmering metals effect, a glimmering precious stones effect, a flame or fire effect and/or a flowing water effect. Flames can appear to flicker, particularly with an interrupted rhythm. Control module 42 can be programmed to loop an animation sequence pattern for a time period long enough that an observer does not consciously remember the pattern, which can be helpful in producing a realistic fire and/or water effect or image display.

Figure 33:
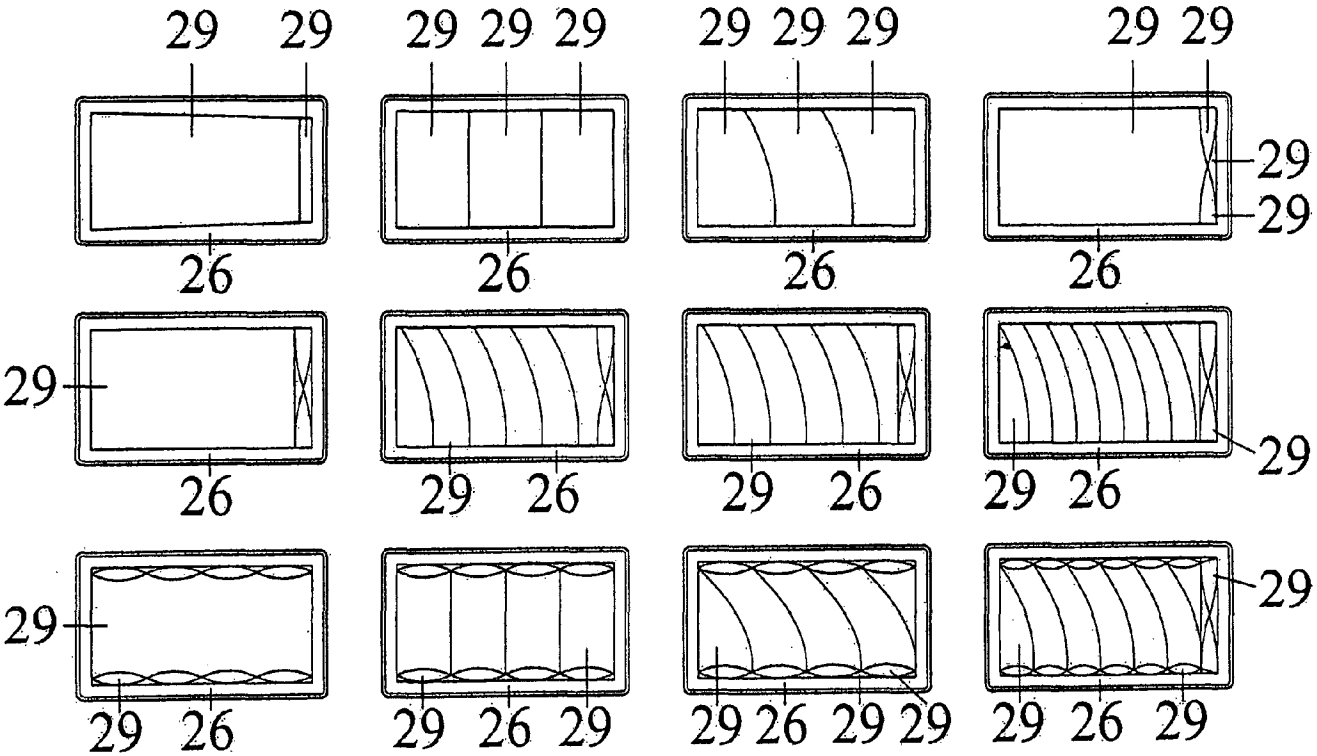
FIG. 33 shows schematic views of panel layouts with differently configured segments, according to different embodiments of this invention.

FIG. 33 shows different configurations, different shapes, different sizes and different numbers of segments 29 that form EL element 28. FIG. 33 is intended to show only some of many different possible shapes, styles, designs, configurations and/or sizes of segments 29 and/or EL elements 28 that can be accomplished according to this invention.

FIGS. 30 and 31 show outer layer or graphics panel 31 positioned coextensively with segments 29. Graphics panel 31 can act as an overlay to cover segments 29. Graphics panel 31 can have any suitable shape that corresponds to or does not correspond to the shape of segments 29, or to the overall shape formed when segments 29 combine to form EL element 28.

Figure 43:
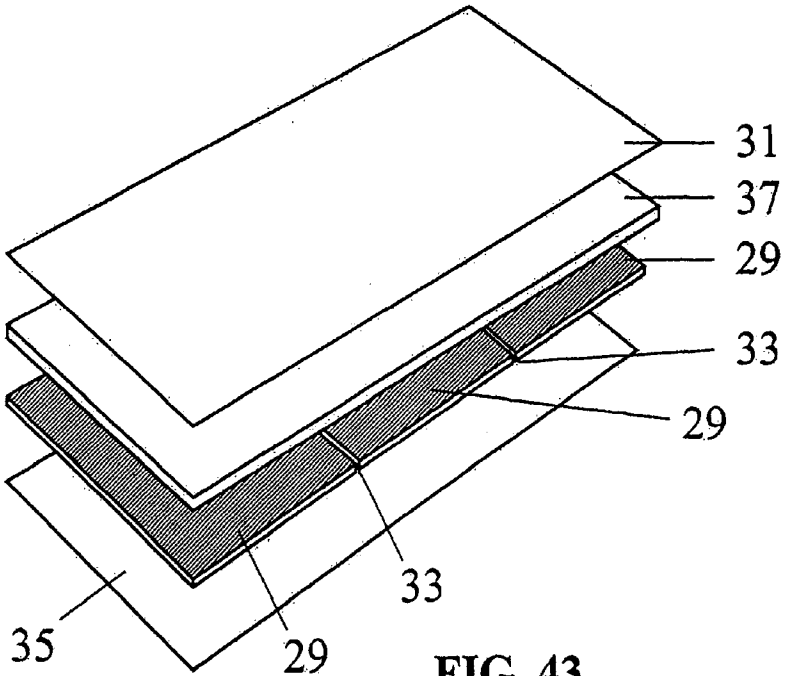
FIG. 43 is an exploded perspective view of an EL panel, according to one embodiment of this invention.
Figure 44:
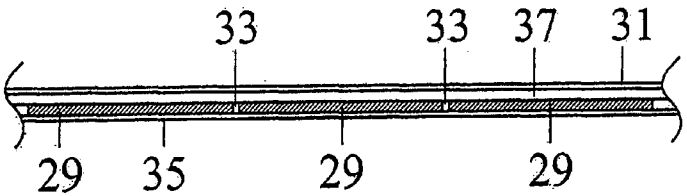
FIG. 44 is a partial cross-sectional view of the EL panel, as shown in FIG. 43.

In certain embodiments according to this invention, adjacent segments 29 are electrically insulated from each other, such as in a non-conducting fashion. In some embodiments, the electrical insulation is accomplished by spacing adjacent segments 29 at a distance from each other, for example as shown in FIGS. 43 and 44, to prevent physical or electrically conducting contact. When positioning segments 29 with respect to each other, it is possible to form gap 33, such as shown in FIGS. 30, 43 and 44, where two adjacent segments 29 almost meet or contact each other.

Figure 45:
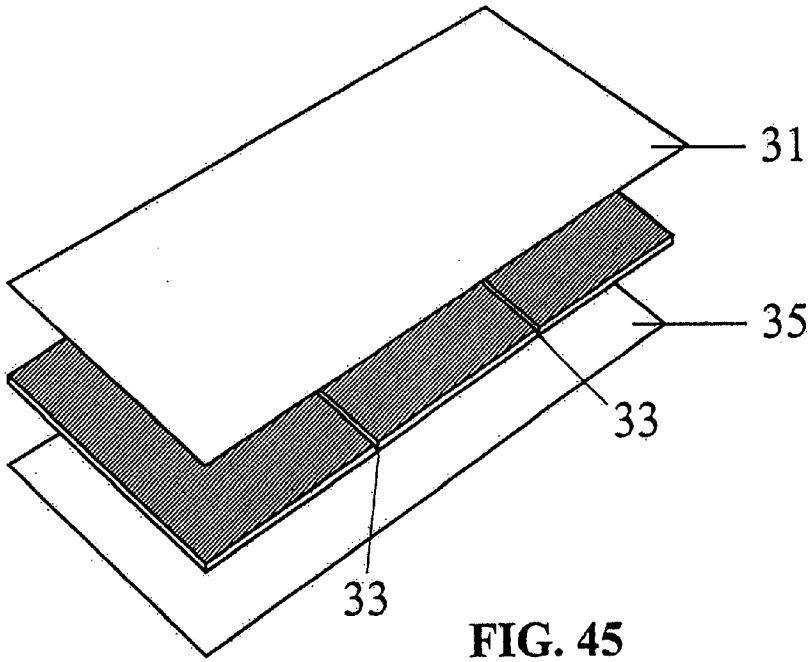
FIG. 45 is an exploded perspective view of an EL panel, according to another embodiment of this invention.
Figure 46:
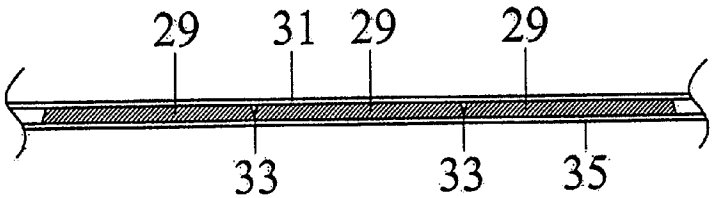
FIG. 46 is a partial cross-sectional view of the EL panel, as shown in FIG. 45.
Figure 47:
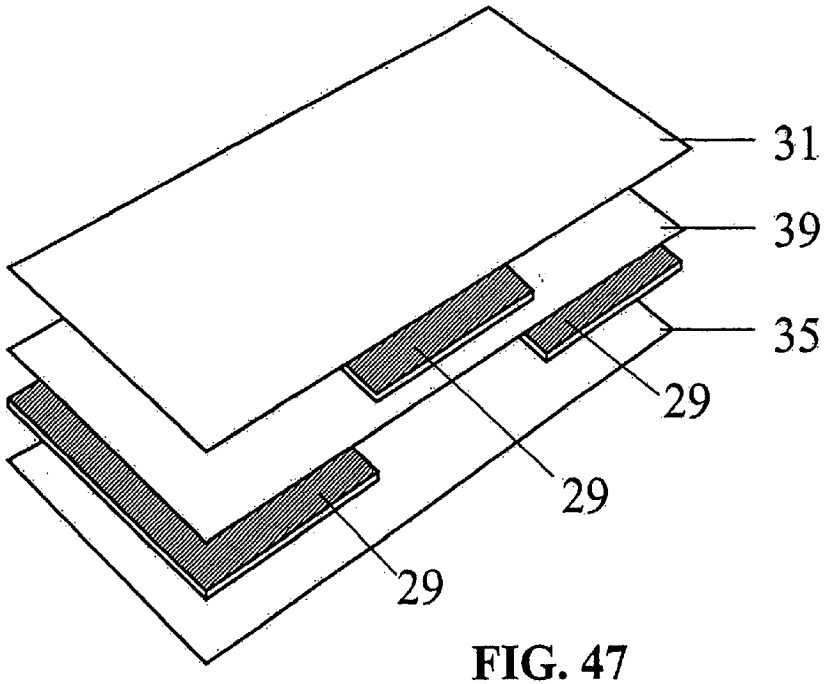
FIG. 47 is an exploded perspective view of an EL panel, according to another embodiment of this invention.

FIGS. 45 and 46 show another embodiment where adjacent segments 29 are spaced at a distance from each other. FIG. 46 shows gap 33 so relatively small that adjacent segments 29 visually appear to contact or touch each other. However, gap 33 remains large enough to prevent physical or electrically conducting contact between two adjacent segments 29. FIG. 46 shows each gap 33 formed as a V-shaped groove. However, any other suitable shape of gap 33 can be used to produce a visual appearance as though gap 33 does not exist.

In other embodiments according to this invention, particularly when gap 33 is at least somewhat visible, the visual appearance of gap 33 can be hidden, reduced or eliminated while still maintaining electrical isolation between adjacent segments 29. For example, substrate 35, such as shown in FIGS. 43-50, can be colored the same as or similar to at least one segment 29, to reduce or eliminate any visible lines created by gap 33.

In some embodiments of this invention, outer layer or graphics panel 31 can be constructed of a translucent material, or another suitable material that allows light to pass through the material. The translucent material can visually hide or reduce the appearance of any gap 33 over which graphics panel 31 is positioned. The translucent material can be an acetate material or any other suitable translucent or transparent material. In addition to or in lieu of graphics panel 31, certain embodiments of this invention may include diffuser 37, such as shown in FIGS. 43 and 44, which can be used to hide gap 33. Eliminating or reducing the visual appearance of gap 33 can result in a more realistic or more believable image or presentation.

In certain embodiments according to this invention, during manufacture or assembly, each segment 29 can be positioned or registered with respect to each other so that during the printing process a distance or thickness of gap 33 is maintained, reduced or minimized.

Figure 48:
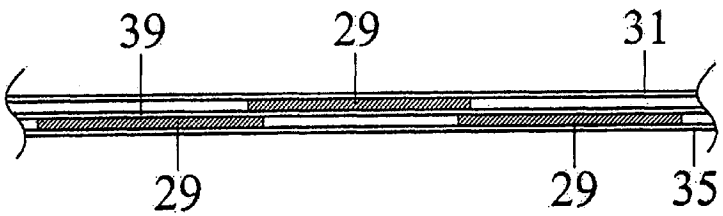
FIG. 48 is a partial cross-sectional view of the EL panel, as shown in FIG. 47.
Figure 49:
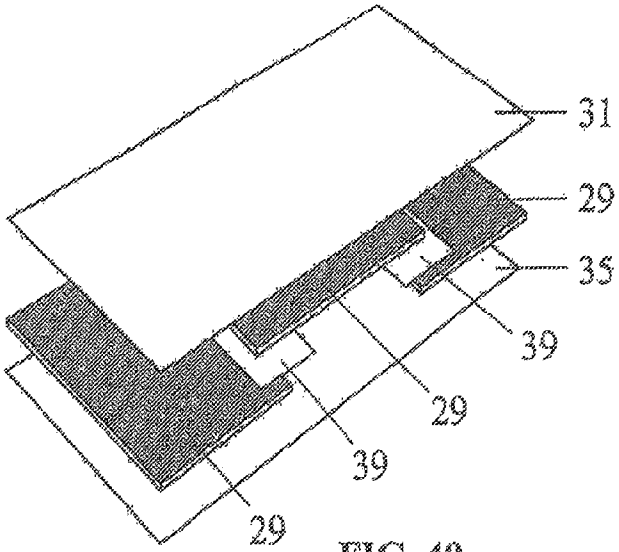
FIG. 49 is an exploded perspective view of an EL panel, according to another embodiment of this invention.

In other embodiments according to this invention, for example as shown in FIGS. 47-50, two adjacent segments 29 can overlap each other, such as at an edge portion or at peripheral portions, to eliminate the need for gap 33 or physical separation to maintain electrical insulation. For example, alternating segments 29, such as in a direction from left to right as shown in FIGS. 30, 42, 47 and 48, can be positioned on or within a first layer or thickness. The remaining segments 29, which may or may not alternate in order from left to right in FIGS. 30 and 42, can be positioned on or within a second layer or thickness. As shown in FIG. 48, for example, the second layer can overlay or be coextensive with the first layer, and edge portions of segments 29 can overlap each other, for example to eliminate otherwise visual gaps. Electrical insulation of adjacent segments 29 can be accomplished by applying or otherwise positioning a coating or layer of an electrical insulating material between any overlapping and/or contacting portions of segments 29. Two or more layers or thicknesses can be stacked or otherwise used to accomplish the electrical insulation aspects of this invention.

Figure 50:
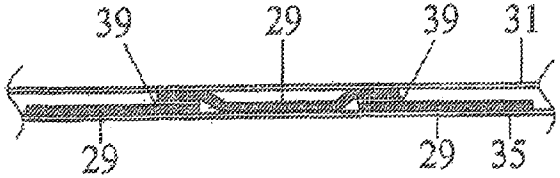
FIG. 50 is a partial cross-sectional view of the EL panel, as shown in FIG. 49.

In another embodiment according to this invention, two or more adjacent segments 29 can be generally positioned within the same layer or thickness, such as shown in FIG. 50, insulator 39, with edge portions of adjacent segments 29 overlapping. In any overlapping area, an electrical insulating material and/or a coating can be positioned or applied to electrically insulate the adjacent segments 29 from each other.

In certain embodiments according to this invention, particularly where edge portions of segments 29 are coated or covered with an electrical insulator, it is possible to use a clear or translucent insulator material and/or color match or coordinate the insulator material with the color of the corresponding segment 29. Clear, translucent and/or color matching can be used to visually hide or decrease the appearance of the electrical insulator, for example when the corresponding segment 29 is in the off mode or at a relatively low or high power or intensity level. Without the color matching between segment 29 and any corresponding electrical insulator, the insulator material may be more visible than desired, even when viewed through graphics panel 31 and/or diffuser 37.

Segment 29 can be constructed from a phosphor material layer or coating. Any suitable phosphor material, such as those that may be commercially available as DUPONT® materials, can be used for segment 29. Any other suitable material known to those skilled in the art can be used to form a lightable segment 29. The material of segment 29 can be printed, sprayed, brushed or otherwise applied to form a desired or suitable layer or sheet of the material of segment 29.

The outer layer or graphics panel 31 and/or diffuser 37 can be positioned partially or completely over segments 29. It is also possible to position graphics panel 31 and/or diffuser 37 over only gap 31 or other overlap areas formed by segments 29.

Graphics panel 31 and/or diffuser 37 can have any suitable shape, size and/or design. In some embodiments according to this invention, segments 29 are positioned completely within an outer peripheral shape formed by all segments 29, which may be referred to as an inboard design or configuration. In other embodiments according to this invention, at least a portion of one or more segments 29 is positioned outside of the overall or outer peripheral shape formed by all segments 29, which is referred to as an outboard design or configuration.

With an inboard configuration, an image applied to graphics panel 31 can appear as the same image or a true image, whether or not EL element 28 is lit or otherwise powered. With an outboard design or configuration, the image can appear different between an operating mode and a completely off mode. For example, with an outboard configuration, a flag can appear to move between two different locations, boundaries or positions when EL element 28 is in the operating mode, but when in a completely off mode EL element 28 has two visually apparent images, each of a flag, which can be visually confusing. The inboard configuration can be used to create a visual appearance that the flag is moving but when EL element 28 is in the completely off mode, the flag will look like a normal single flag design, which would be the same image or the true image.

As used throughout this specification and in the claims, the term inboard is intended to relate to segments 29 positioned with respect to each other to form a boundary or a periphery about all segments 29, such as a boundary or periphery that has a true image. As used throughout this specification and in the claims, the term outboard is intended to relate to segments 29 positioned with respect to each other to form an overall boundary or periphery that does not form a true image. As used throughout this specification and in the claims, the term true image is intended to relate to the boundary or periphery of the true image having a true shape of the image or illumination projected by segments 29, either instantaneously or over time.

For example, FIG. 30 shows an inboard configuration because the flag is a true image and regardless of how segments 29 are powered or operated, the flag will always appear as a true image. With an inboard configuration of segments 29, such as shown in FIG. 30, the flag will look the same even when all segments 29 have no power or are in an off mode. Thus, for example, the true image of the flag will appear as the same flag, such as similar to a decal, when segments 29 are not powered.

Figure 39:
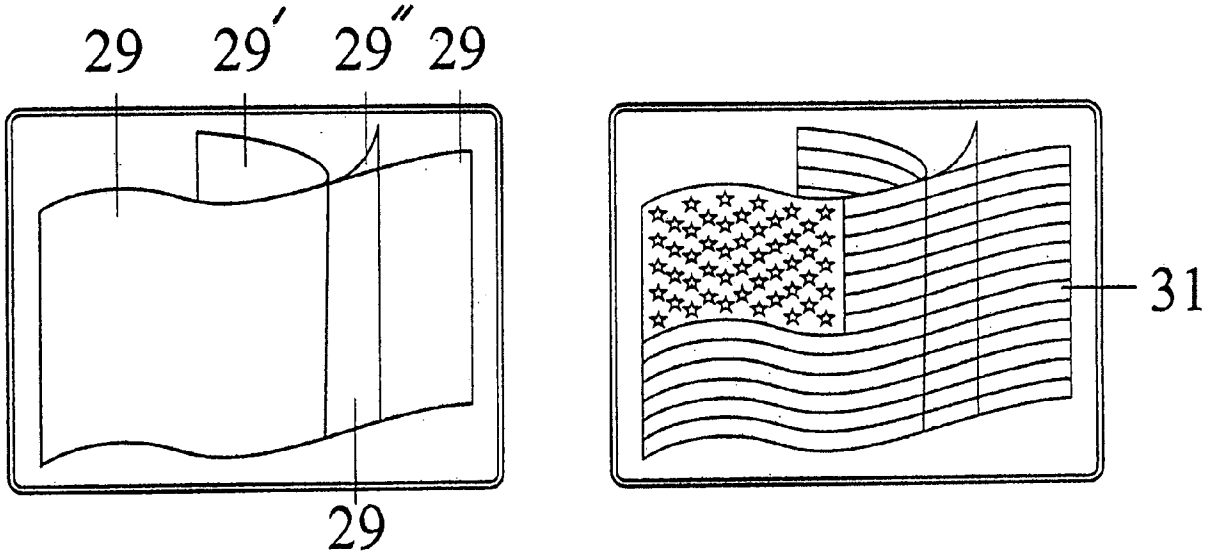

FIG. 39 shows one embodiment of an outboard configuration. As shown in the left diagram of FIG. 39, the three segments 29 form the image of a flag. However, segment 29' can be operated with or without segment 29", such as in a timed sequence, to give the flag an appearance that it is waving, even in three dimensions. However, with the outboard configuration, such as shown in FIG. 39, when all segments 29, 29' and 29" are powered off, the flag image is shown in the right diagram of FIG. 39. With all segments 29, 29' and 29" powered off, the flag appears as though it is not a true image because segments 29' and 29" can be seen or are visually apparent, along with all segments 29.

In certain embodiments with the inboard configuration, light film device 20 of this invention can appear as a decal, for example, in a window, in the completely off mode or appearing as a static, at-rest or steady image, and can also appear as a moving, dynamic, animated or in-motion image when EL element 28 is in the operating mode.

Any suitable frame or housing 26 can be used to structurally hold, attach or connect segments 29, EL element 28, graphics panel 31, control module 42 and/or any other element used in combination with the embodiments of this invention.

Housing 26 can be permanently or detachably secured with respect to any mounting surface, such as a glass window and/or a vehicle surface. In certain embodiments according to this invention, housing 26 is detachably secured with a hook and loop fastener, such as a Velcro™ fastener, and/or any suitable mechanical connector, including a track screwed to or otherwise secured to the mounting surface, with a lock plate that can be mounted within the track. The track can be designed, sized and configured so that the track and the plate is covered up when housing 26 is slid onto or otherwise connected to the track.

In other embodiments according to this invention, double sided tape or another suitable adhesive, such as glue or adhesion strips or other shapes, can be used to attach housing 26 with respect to the mounting surface.

In other embodiments according to this invention, housing 26 can be removably mounted using suction cups structurally attached to or with respect to housing 26. For example, tabs or other inserts can be mounted within any corresponding void to secure housing 26 with respect to a suction cup.

Plates, including wafer plates and die stamp thin metal plates, or injection molded plates or other shapes, can be used to mount or otherwise fasten housing 26 with respect to the mounting surface. Magnetic plates can also be used to mount housing 26 with respect to the mounting surface.

Figure 53:
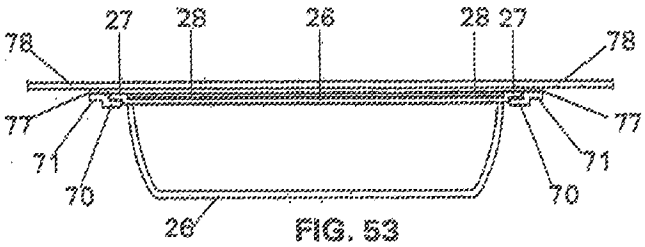
FIG. 53 is a top view of the securement or retainer, as shown in FIG. 51.
Figure 52:
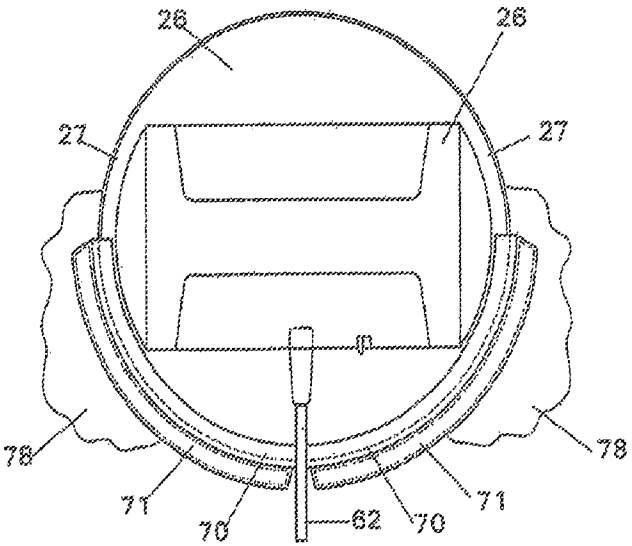
FIG. 52 is a front view of the securement or retainer, as shown in FIG. 51.
Figure 51:
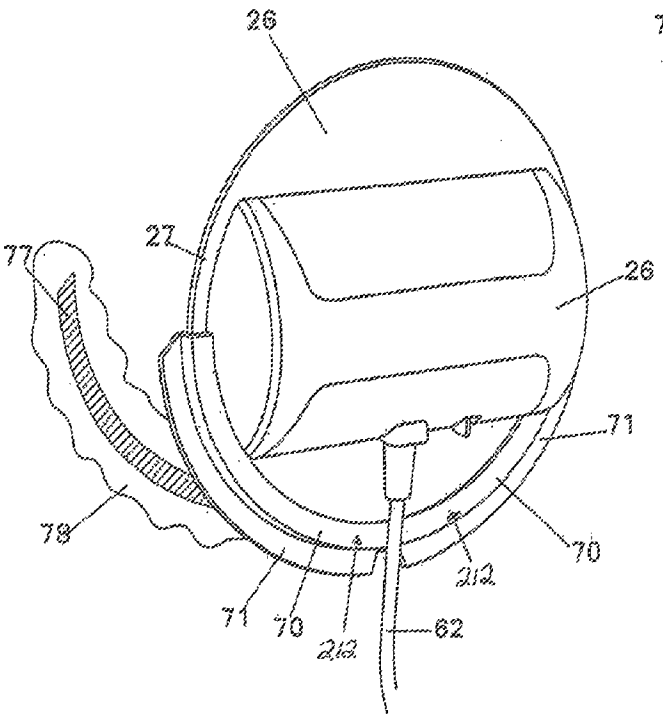
FIG. 51 is a perspective view of a securement or retainer for a housing of a light film device, according to one embodiment of this invention.

FIGS. 51-53 and FIGS. 54-56 show two different embodiments of securement or retainer 70 which is used to permanently or detachably secure housing 26 with respect to any suitable mounting surface 78. For example, FIG. 51 shows retainer 70 spaced apart from mounting surface 78. When connected together, such as shown in FIGS. 52 and 53, retainer 70 and/or attachment 71 is secured directly to or with respect to mounting surface 78. Retainer 70 and/or attachment 71 can be configured or designed to closely mount housing 26 with respect to mounting surface 78, so that EL element 28 abuts or is otherwise closely mounted or positioned to mounting surface 78.

FIGS. 51-53 show mounting surface 78. As shown in FIG. 53, EL element 28 is closely positioned next to, adjacent to or with respect to mounting surface 78. The relatively close relationship between EL element 28 and mounting surface 78 can result in a clear display or other image. As shown in FIGS. 51 and 53, the offset relationship between retainer 70 and attachment 71 can provide the relatively close relationship between mounting surface 78 and EL element 28.

Figure 56:
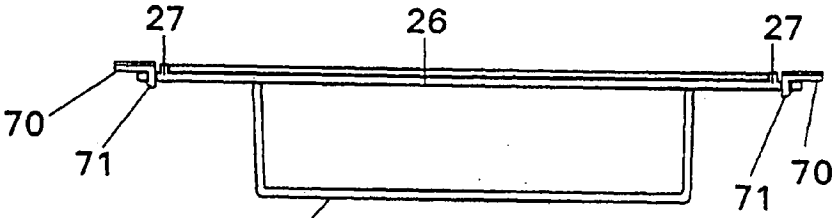
FIG. 56 is a top view of the securement or retainer, as shown in FIG. 54.
Figure 55:
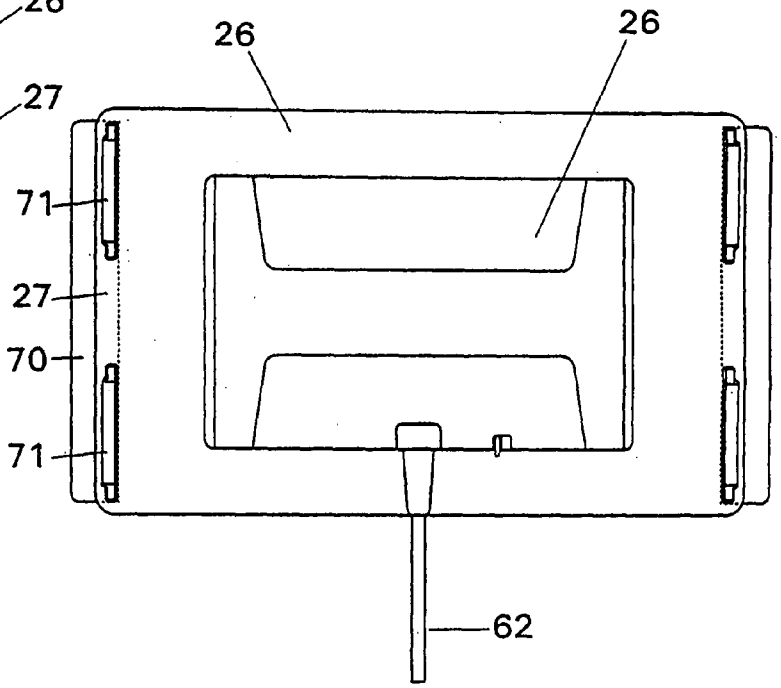
FIG. 55 is a front view of the securement or retainer, as shown in FIG. 54.
Figure 54:
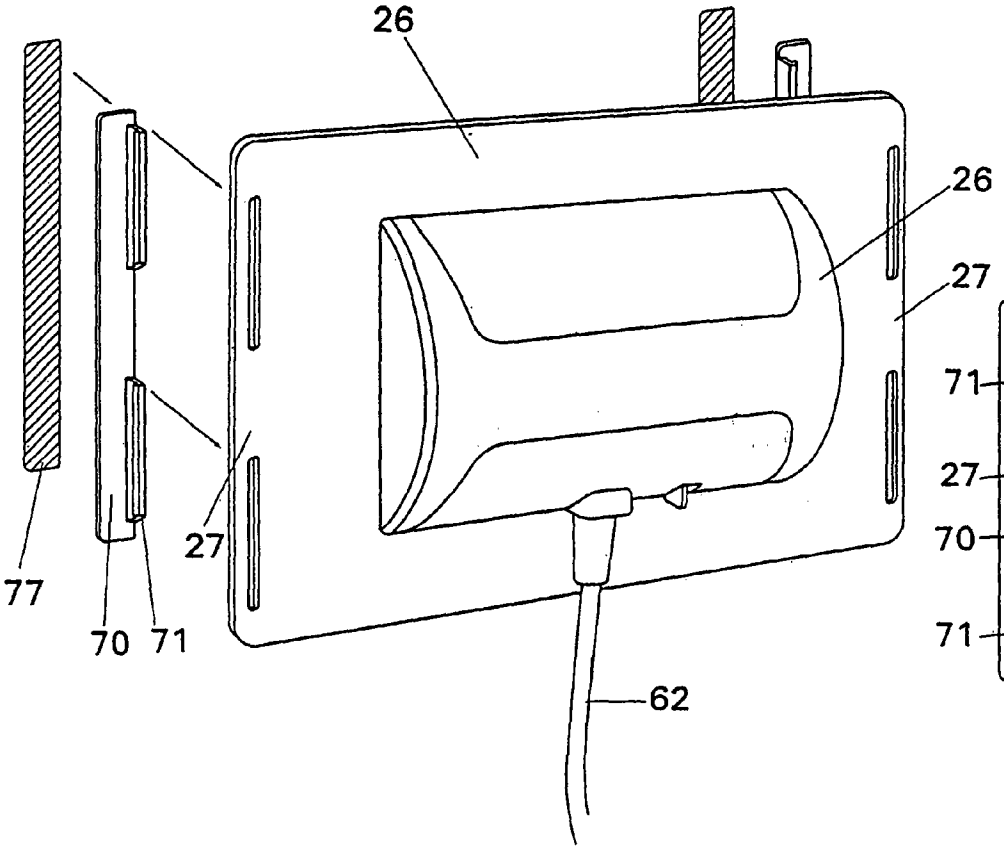
FIG. 54 is a perspective view of a securement or retainer for a housing of a light film device, according to another embodiment of this invention.

As shown between FIGS. 51, 54 and 57-59, 61-64 and 66, housing 26 can have any suitable shape and/or size. FIGS. 51-53 show housing 26 having portion 27 that abuts or otherwise contacts retainer 70 when in a mounted position with respect to mounting surface 78. As shown in FIGS. 54-56, retainer 70 has attachments 71 that project through corresponding openings within housing 26, such as located at portion 27. FIG. 54 shows an exploded view whereas FIGS. 55 and 56 show assembled views.

Figure 57:
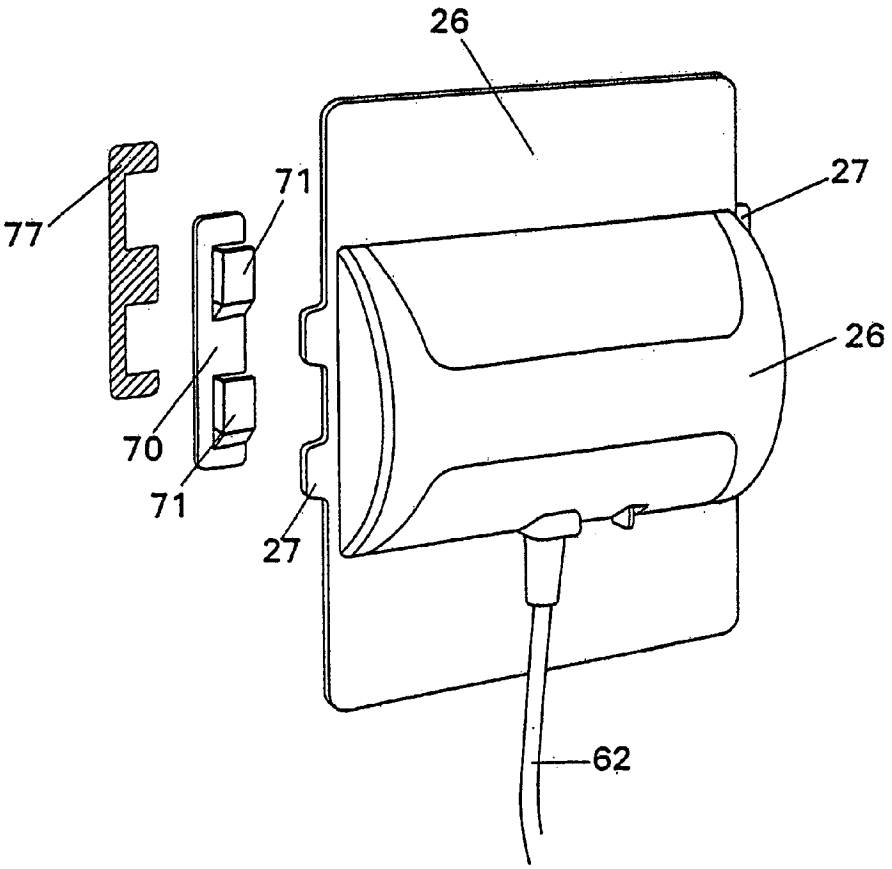
FIG. 57 is a perspective view of a securement or retainer for a housing of a light film device, according to another embodiment of this invention.
Figure 58:
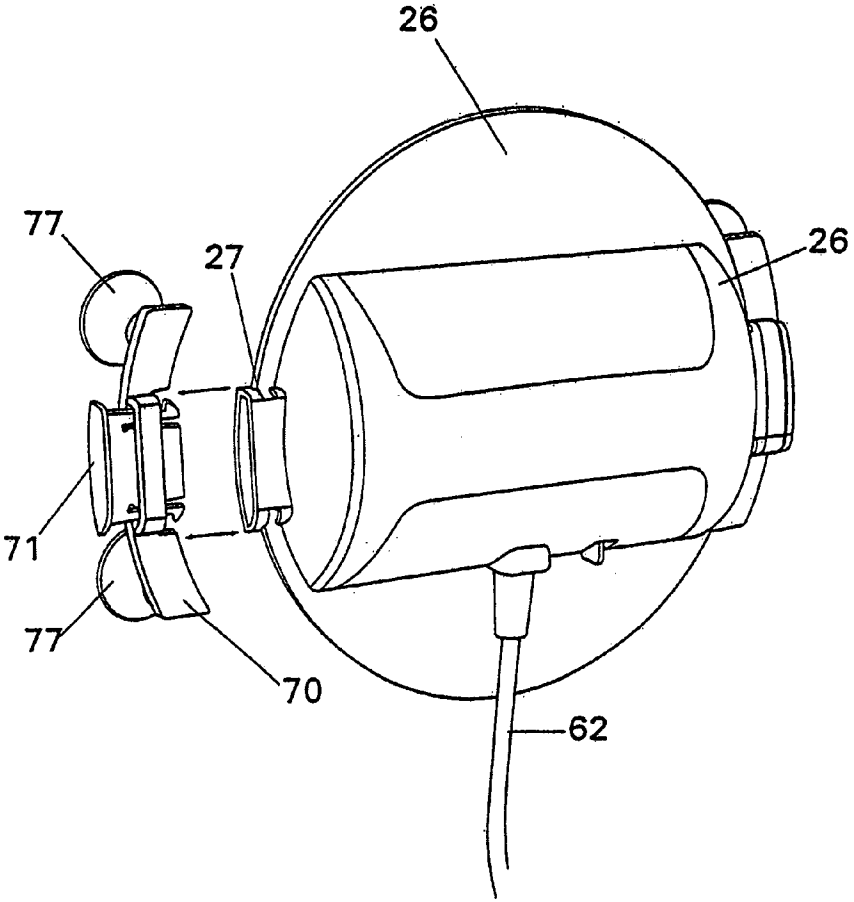
FIG. 58 is a perspective view of a securement or retainer for a housing of a light film device, according to another embodiment of this invention.

FIG. 57 shows another embodiment of retainer 70 having attachments 71 that can be used to secure one or more portions 27 of housing 26.

Figure 64:
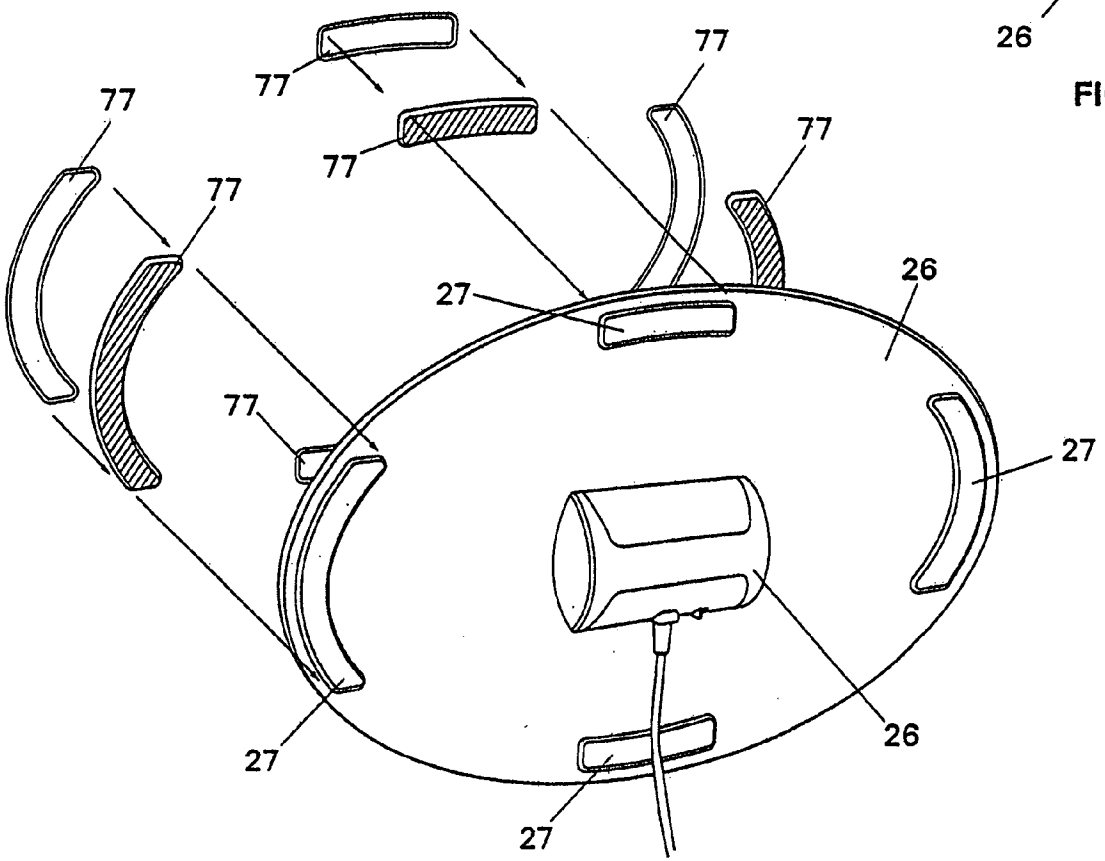
FIG. 64 is a perspective view of a securement or retainer for a housing of a light film device, according to another embodiment of this invention.
Figure 66:
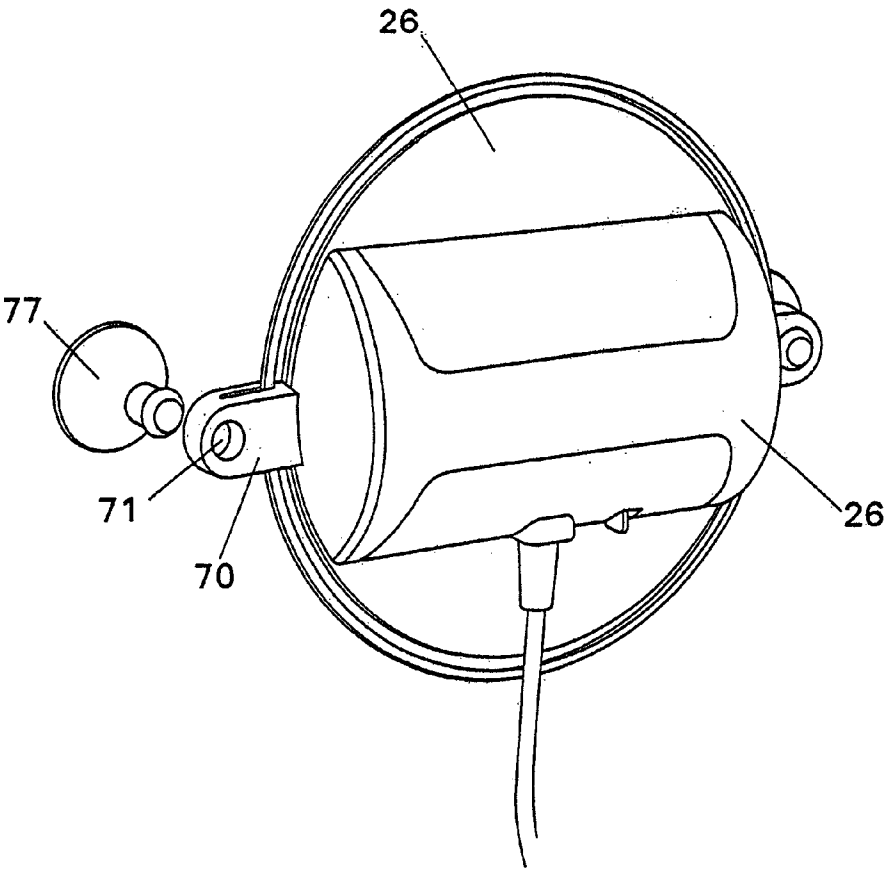
FIG. 66 is a perspective view of a securement or retainer for a housing of a light film device, according to another embodiment of this invention.

FIGS. 58, 61, 62 and 66 each shows connector 77 as a suction cup. Connector 77 can be any other suitable adhesive or mechanical structure or device used to mount or secure elements with respect to each other. For example, as shown in FIGS. 59 and 64, connector 77 can comprise a Velcro™ fastener or another suitable hook and loop fastener or other similar fastener.

Figure 60:
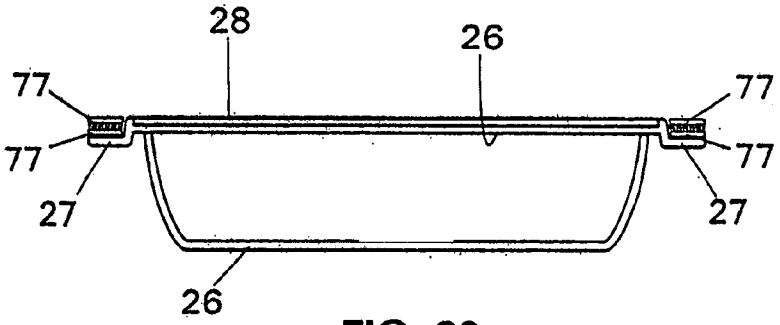
FIG. 60 is a top view of the securement or retainer, as shown in FIG. 59.
Figure 59:
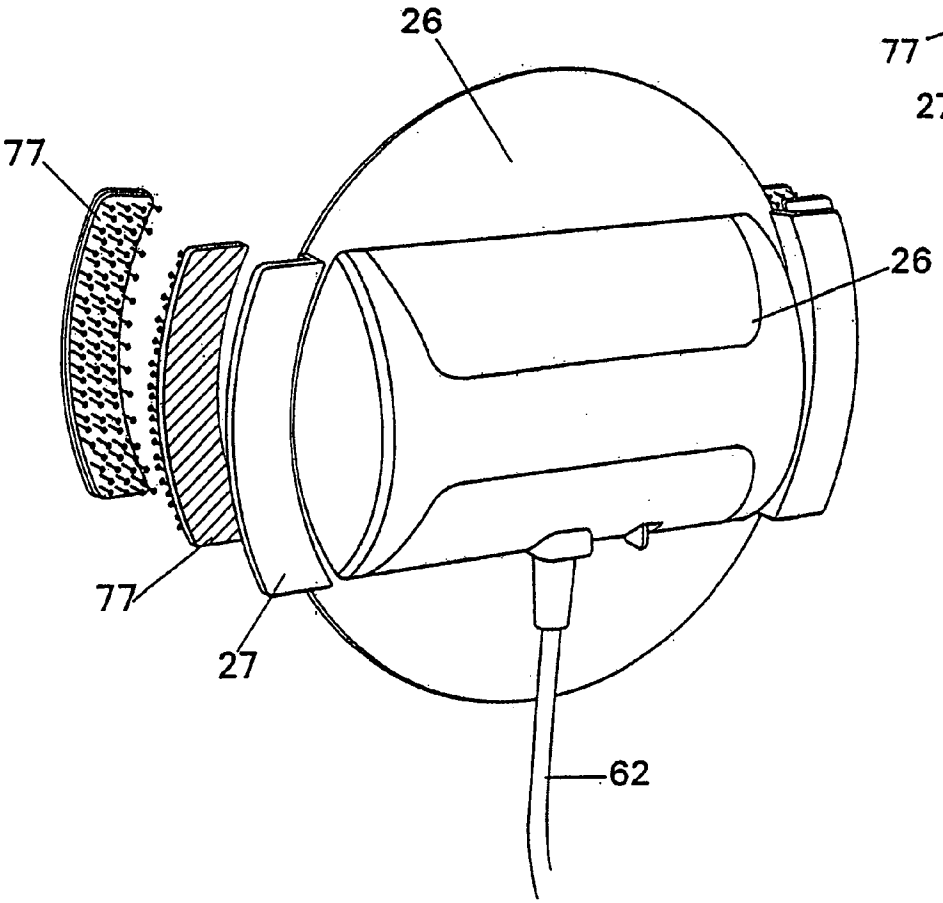
FIG. 59 is a perspective view of a securement or retainer for a housing of a light film device, according to another embodiment of this invention.
Figure 61:
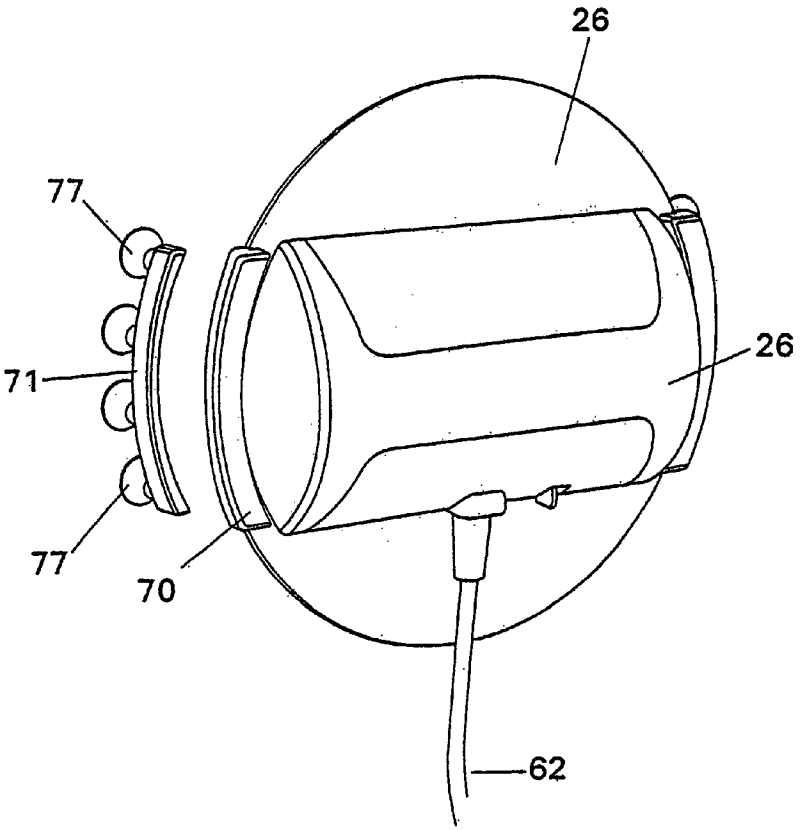
FIG. 61 is a perspective view of a securement or retainer for a housing of a light film device, according to another embodiment of this invention.
Figure 62:
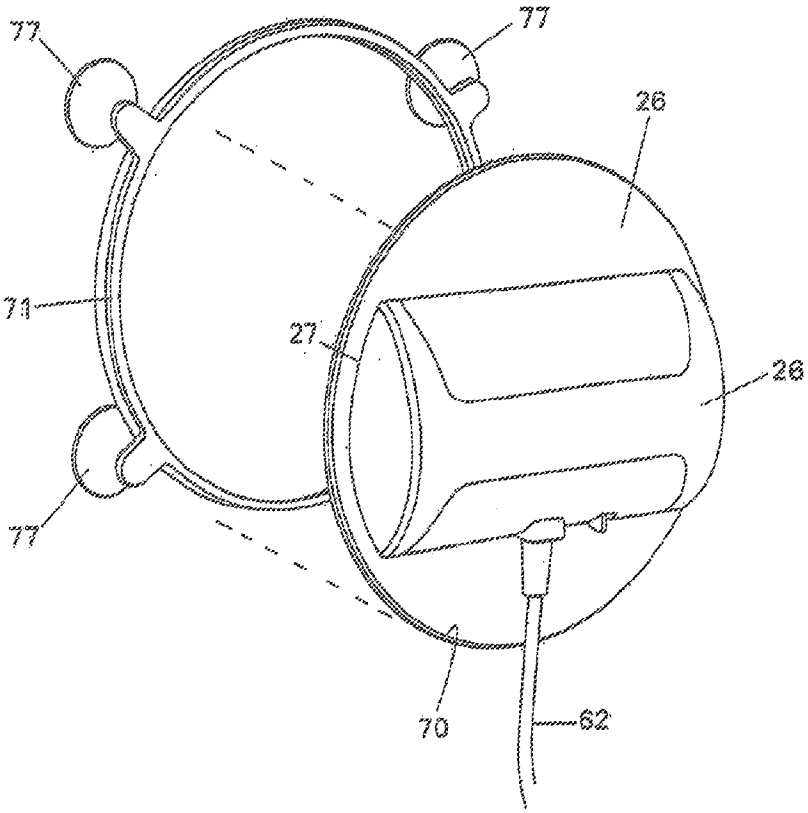
FIG. 62 is a perspective view of a securement or retainer for a housing of a light film device, according to another embodiment of this invention.
Figure 63:
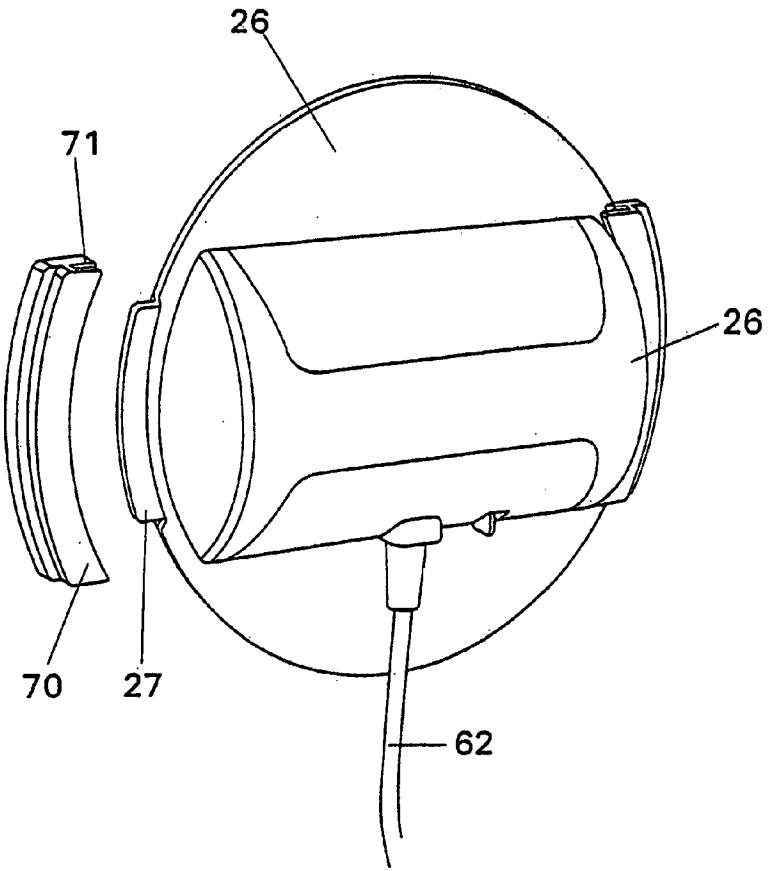
FIG. 63 is a perspective view of a securement or retainer for a housing of a light film device, according to another embodiment of this invention.
Figure 65:
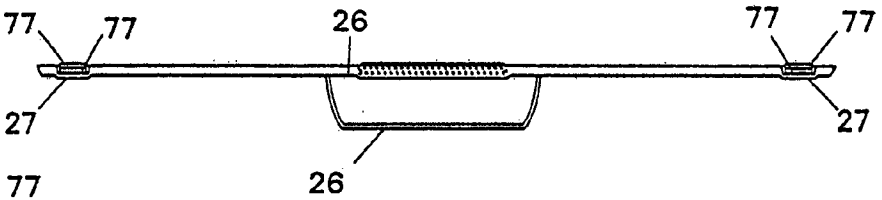
FIG. 65 is a top view of the securement or retainer, as shown in FIG. 64.

FIGS. 59 and 60 show another embodiment of a configuration, such as an offset relationship between portion 27 and connector 77, that allows EL element 28 to be positioned closely adjacent to or abutting mounting surface 78. The embodiments shown in FIGS. 63 and 64 can also be used to closely mount EL element 28 with respect to mounting surface 78. FIG. 64 shows portion 27 having indented or debossed sections for accommodating connector 77, which can be a hook and loop fastener, for example. FIG. 65 shows connector 77 inserted within portion 27. Depending upon the dimension selected for the embodiment shown in FIG. 62, housing 26 can be positioned with respect to attachment 71 so that EL element 28 is closely positioned with respect to mounting surface 78.

The controller management and power distribution to the independent segments 29, according to this invention, can be effectively used to project, display or otherwise create an appearance that segments 29, which are arranged in a generally planar or two-dimensional configuration, are a three-dimensional image or display enhanced with depth and definition.

In certain embodiments of this invention, light film device 20 can be operated by delivering power from a suitable power supply to the illuminated graphics panel 31 which overlays at least two segments 29. Control module 42 manages the power delivered to each of segments 29. During a given time period the illumination level or intensity of each segment can be either powered on, powered off, or powered to an intermediate level. With the independent control of each segment 29, it is possible to project or display a two-dimensional image as a three-dimensional image that appears to have significant depth.

EL element 28, segments 29, control module 42 and/or any other suitable element of this invention can communicate information to each other and/or between each other by using any suitable wire connection and/or wireless communication. For example, Bluetooth™ technology or any other suitable control technology, language, and/or protocol can be used to communicate information, such as commands or control signals.

In some embodiments according to this invention, segments 29 can be structurally connected to housing 26, and housing 26 can be mounted with respect to any structure, such as a window surface, a vehicle surface of a vehicle body or any other structural element.

Figure 40:
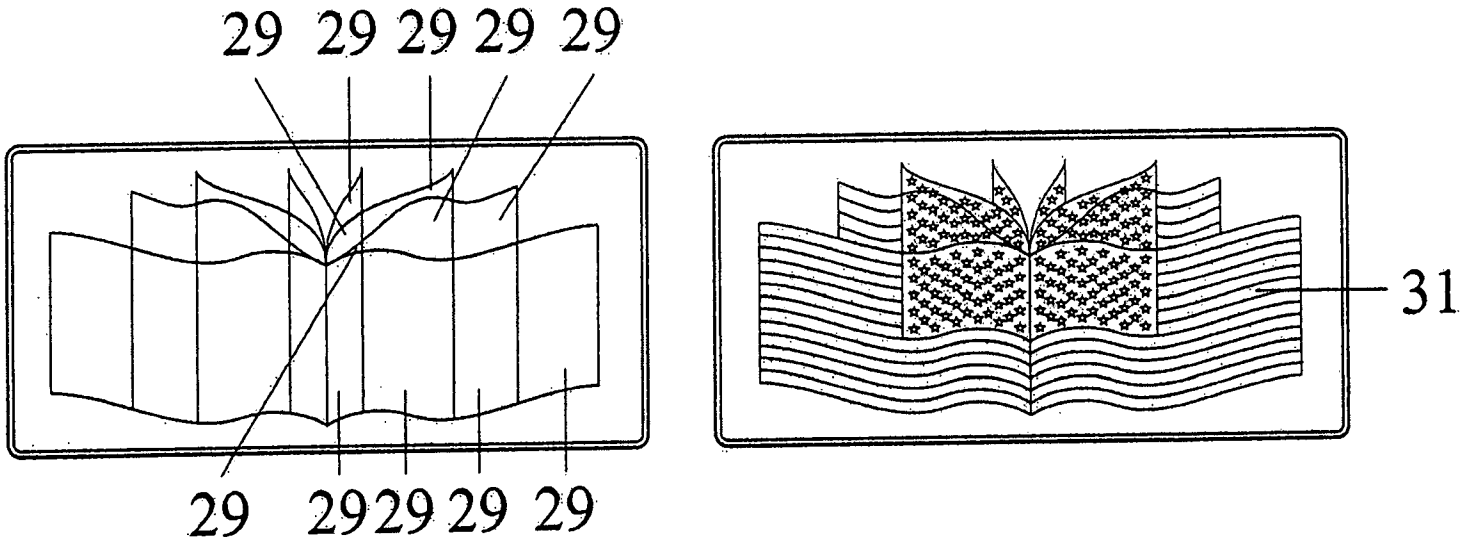
Figure 41:
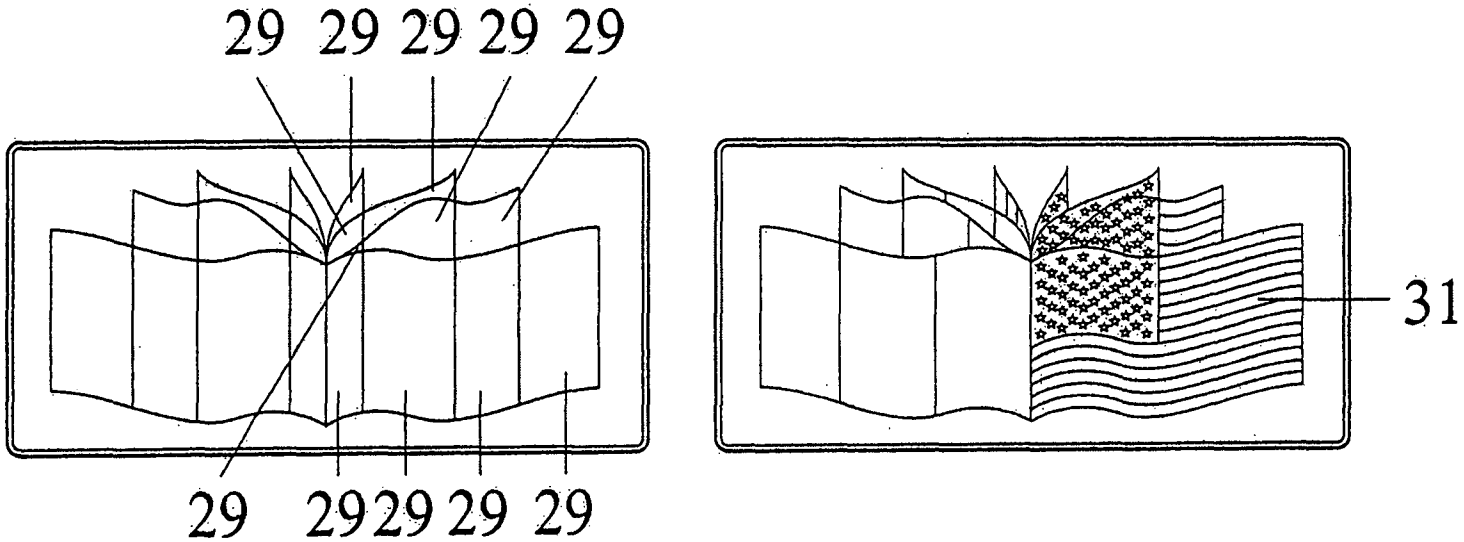

FIGS. 40 and 41 each shows EL element 28 having an outboard configuration, according to this invention. As shown in FIGS. 40 and 41, the flag image can move from a starting position to a finish position, with or without intermediate positions. In the operating mode of segments 29, as shown in FIGS. 40 and 41, the flag image appears to move between left and right. Any other shape or configuration can be used to display a different image. EL element 28 according to FIGS. 40 and/or 41 can produce an image with a more dramatic effect.

In some jurisdictions, it may be necessary or desirable to comply with environmental or other regulations. Thus, in certain embodiments of this invention, at least a portion of housing 26 can be sealed, for example hermetically sealed with respect to the surrounding environment. At least a portion of or all of housing 26 can be hermetically sealed, for example to protect or isolate any circuit or other electrical device mounted within housing 26. Also, conductor or wire 62 can be sealed, such as hermetically sealed, as a part of or separate from the seal associated with housing 26.

Figure 68:
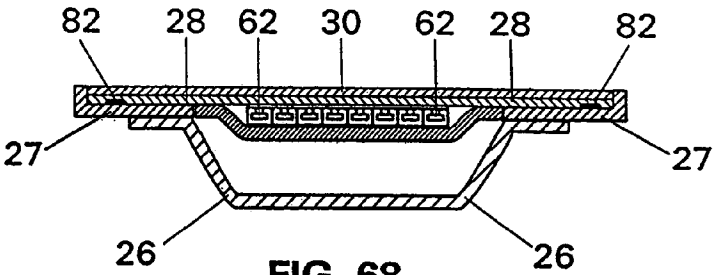
FIG. 68 is a partial sectional view of the securement or retainer, as shown in FIG. 67.
Figure 69:
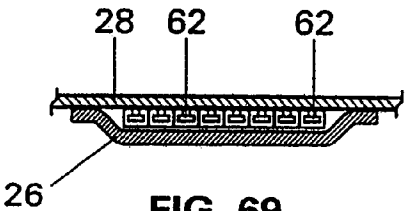
FIG. 69 is a partial sectional view of a portion of the securement or retainer that houses a cable arrangement, as shown in FIG. 67.
Figure 70:
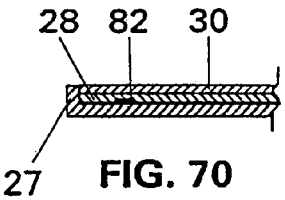
FIG. 70 is a partial sectional view of an end portion of the securement or retainer, as shown in FIG. 67.

FIGS. 67-71 show different embodiments for hermetically sealing one or more elements of this invention. For example, conductor or wire 62, for example shown as a ribbon cable in FIGS. 67-69, can be sealed from the surrounding environment. As shown in FIG. 69, any suitable attachment, securement or joint, including but not limited to an adhesive, a heat seal, an ultrasonic seal or the like, can be used to seal or hermetically seal housing 26 with respect to EL element 28. Likewise, as shown in FIGS. 68 and 70 for example, any suitable attachment, securement or joint can be used to seal or hermetically seal housing 26, portion 27, and/or any other suitable element with respect to EL element 28, element 30 and/or any other suitable element.

Figure 71:
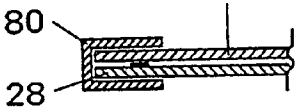
FIG. 71 is a partial sectional view of an end portion of the securement or retainer, according to another embodiment of this invention.
Figure 67:
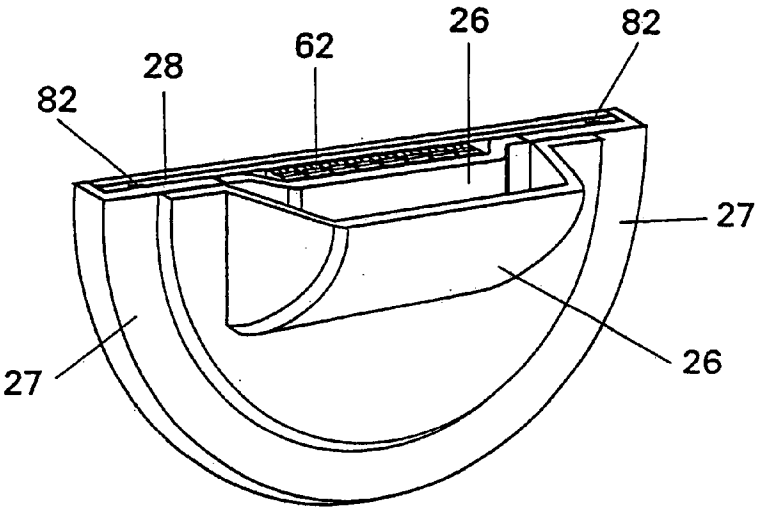
FIG. 67 is a partial perspective view of a securement or retainer for a housing of a light film device, according to another embodiment of this invention.

FIG. 71 shows another embodiment for forming a seal. Insulator 80 can be any suitable material that provides a seal between two or more elements of this invention. By wrapping or at least partially surrounding portion 27, it is possible to provide reduced but still sufficient material to seal or otherwise shelter or protect, for example, edge circuit 82 which is used as a conductor in certain embodiments of this invention. By reducing the distance of portion 27 that is covered, it is possible to maximize the surface area of EL element 28 and/or element 30 that is available for graphics or another suitable display while still providing any needed seal or other protection.

In some embodiments of this invention, sonic welding, heat fastening, sealing and/or any other suitable mechanical attachment can be used to form a seal or attach the film between housing 26 and a back portion of housing 26.

Figure 73:
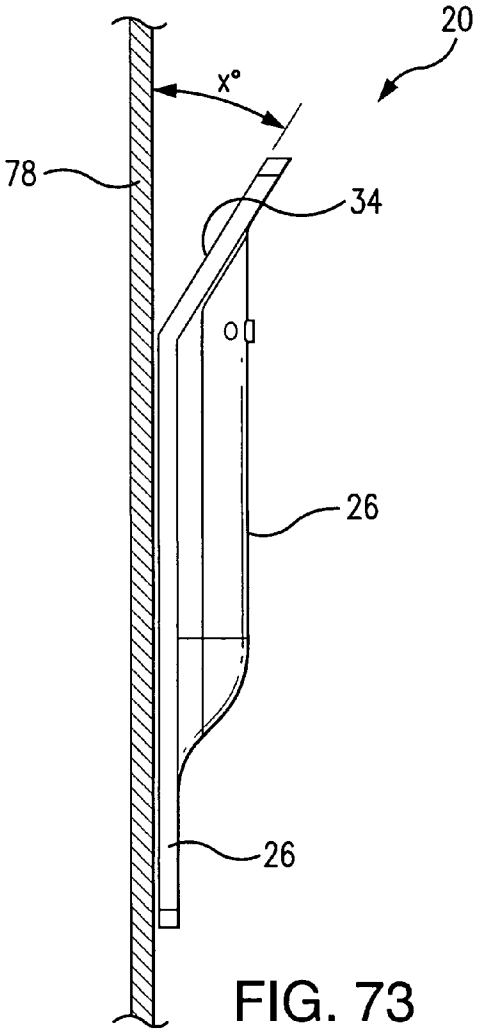
FIG. 73 is a side view of the solar powered lighting device, as shown in FIG. 72, mounted with respect to a plate material.
Figure 72:
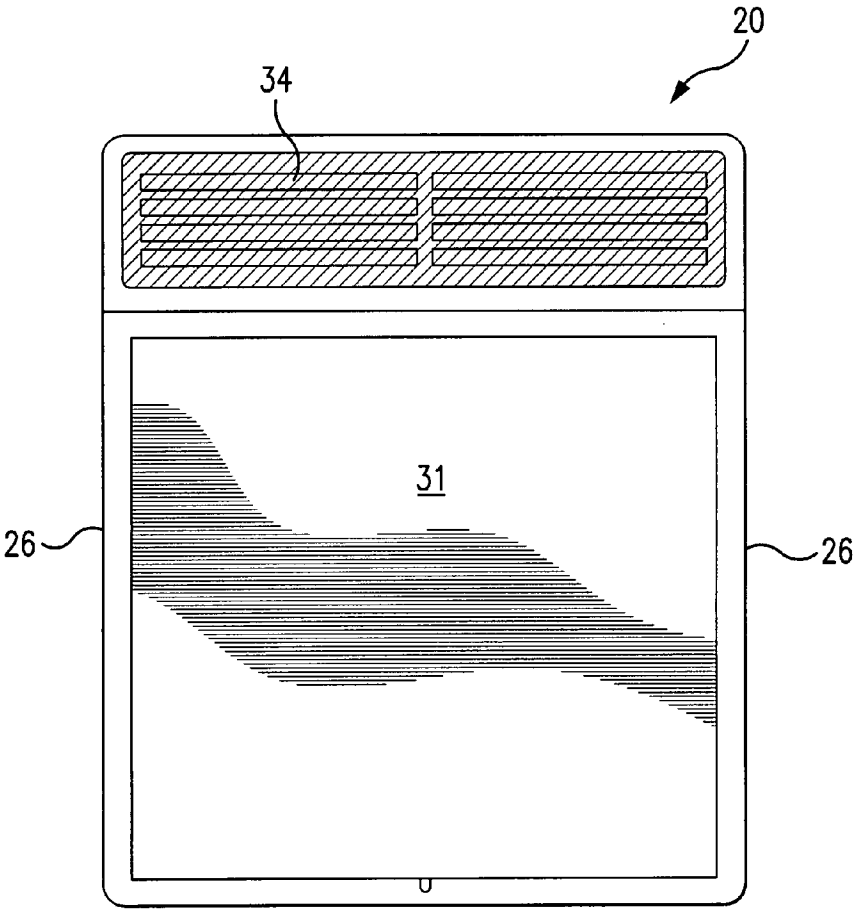
FIG. 72 is a front view of a solar powered lighting device, according to one embodiment of this invention.

FIGS. 72 and 73 show solar powered lighting device 20, according to one embodiment of this invention. FIG. 73 shows a front surface of solar panel 34 fixed at a particular angle X, with respect to mounting surface 78. Angle X as shown in FIG. 73 is approximately 30°. However, angle X can have any suitable value, depending upon a relative position of the solar power source, such as the sun, with respect to housing 26 of lighting device 20.

Figure 75:
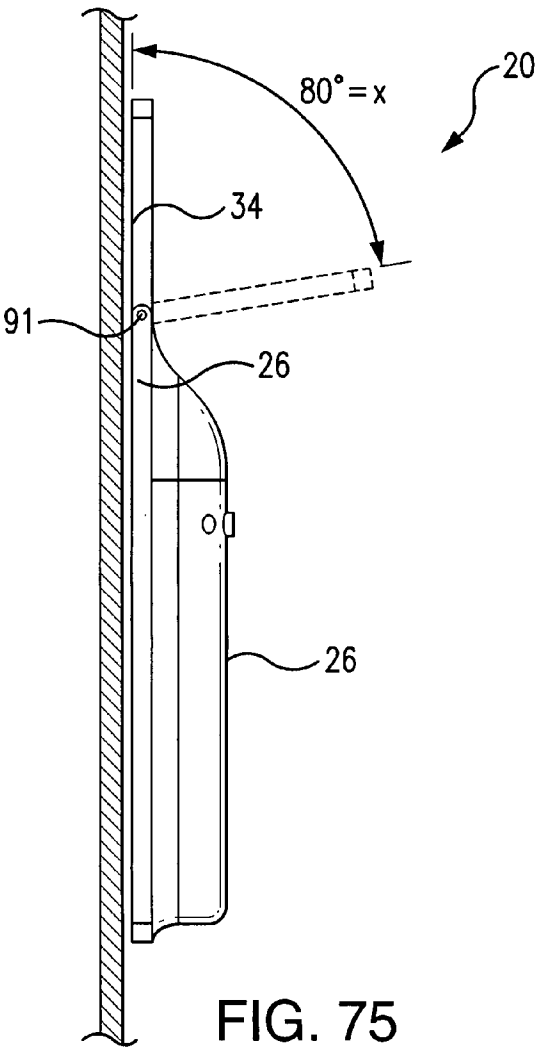
FIG. 75 is a side view of the solar powered lighting device, as shown in FIG. 74, mounted with respect to a panel.
Figure 74:
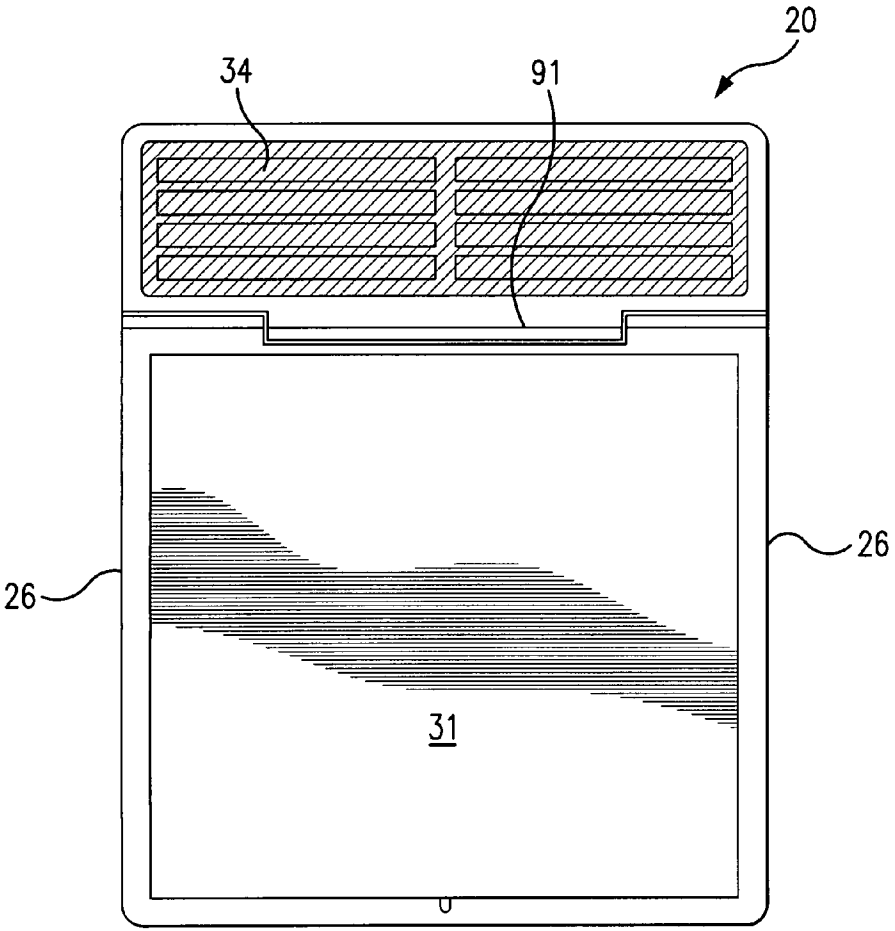
FIG. 74 is a front view of a solar powered lighting device, according to another embodiment of this invention.

Because some uses of a solar powered lighting device 20 require angle X to be adjustable, in some embodiments according to this invention, solar panel 34 is adjustably mounted and then fixed in position with respect to mounting surface 78 or any other suitable structure or surface. FIGS. 74 and 75 show hinge 91 positioned with respect to and/or mounted to different parts of housing 26. Hinge 91 can be a frictional hinge and/or a hinge with graduated or stepped lockable positions. Any other suitable mechanical structure and/or component can be used to accomplish the variably adjustable position of solar panel 34 with respect to mounting surface 78.

With either fixed positions of angle X, such as shown in FIGS. 72 and 73, or with variable positions of angle X, such as shown in FIGS. 74 and 75, angle X can be approximately 30°, such as shown in FIG. 73, or can be in a range of about 10° to about 80°, or it can be any other suitable angle, depending upon the particular use and/or location of use.

In some embodiments according to this invention, the position of solar panel 34 with respect to mounting surface 78 and/or any other structure can be adjusted and then fixed into position using a flexible or bendable solar panel 34 and/or housing 26, either alone or in combination with another mechanical structure, electromechanical structure, magnetic structure and/or any other suitable structure.

Figure 76:
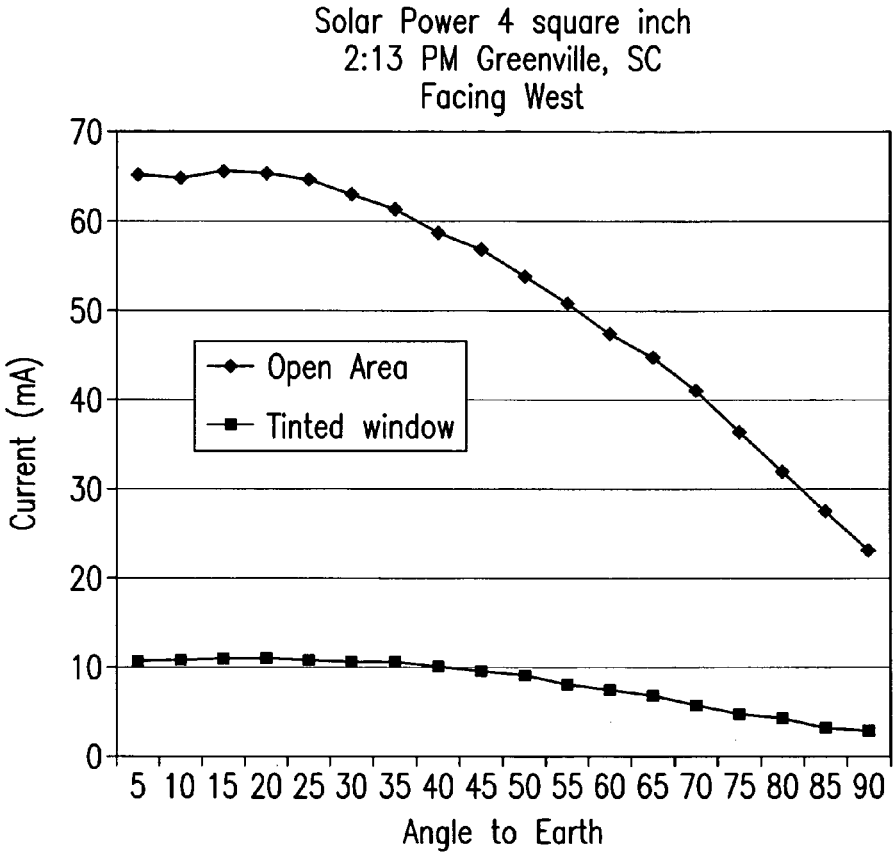
FIG. 76 is a graph showing electrical current generated versus an angle with respect to the earth, for a particular solar power cell.

FIG. 76 is a graph that shows one particular type of solar cell and one particular location. The graph represents how current can be maximized or varied as a function of the angle or other position with respect to earth. FIG. 76 also shows the difference between current values obtained in an open area versus those obtained through a tinted window, such as a tinted window within a vehicle and/or a building structure. The functional relationships between current, angle and tinted or non-tinted glass can vary depending upon the particular location, for example, in which a solar power source is used.

FIGS. 77-80 show different examples for mounting and/or interchangeably mounting housing 26 and/or solar panel 34 with respect to mounting surface 78 and/or any other suitable structure.

Figure 77:
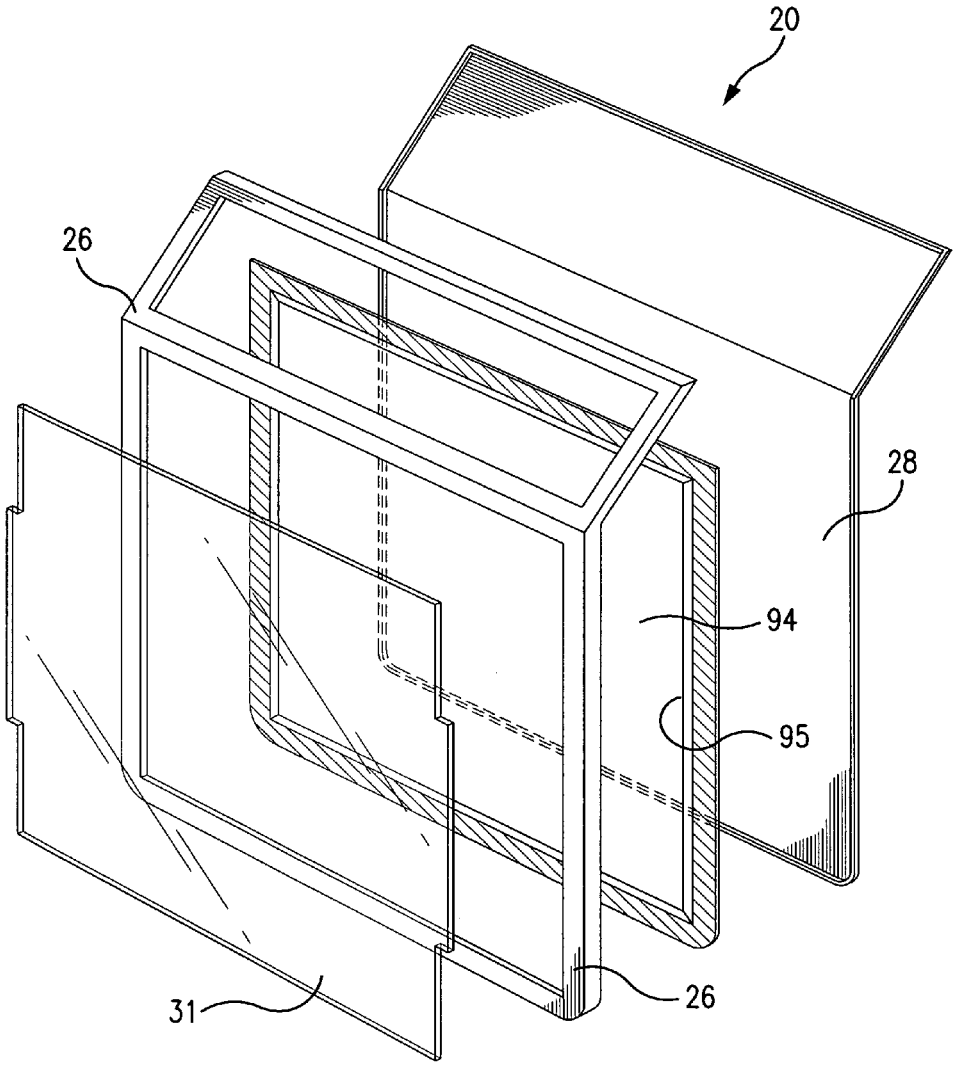
FIG. 77 is a perspective view of a solar powered lighting device, according to another embodiment of this invention, in an exploded view.
Figure 78:
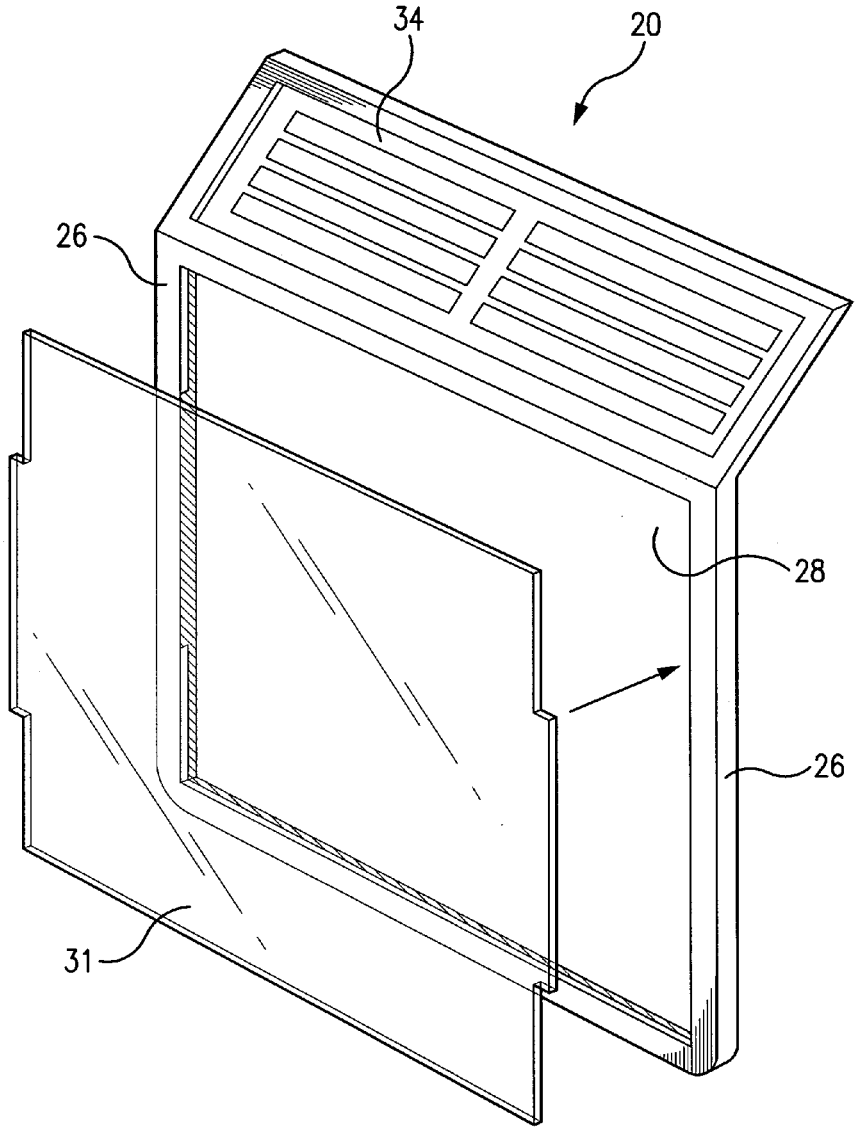
FIG. 78 shows the solar powered lighting device of FIG. 77, but with a replaceable lens.
Figure 79:
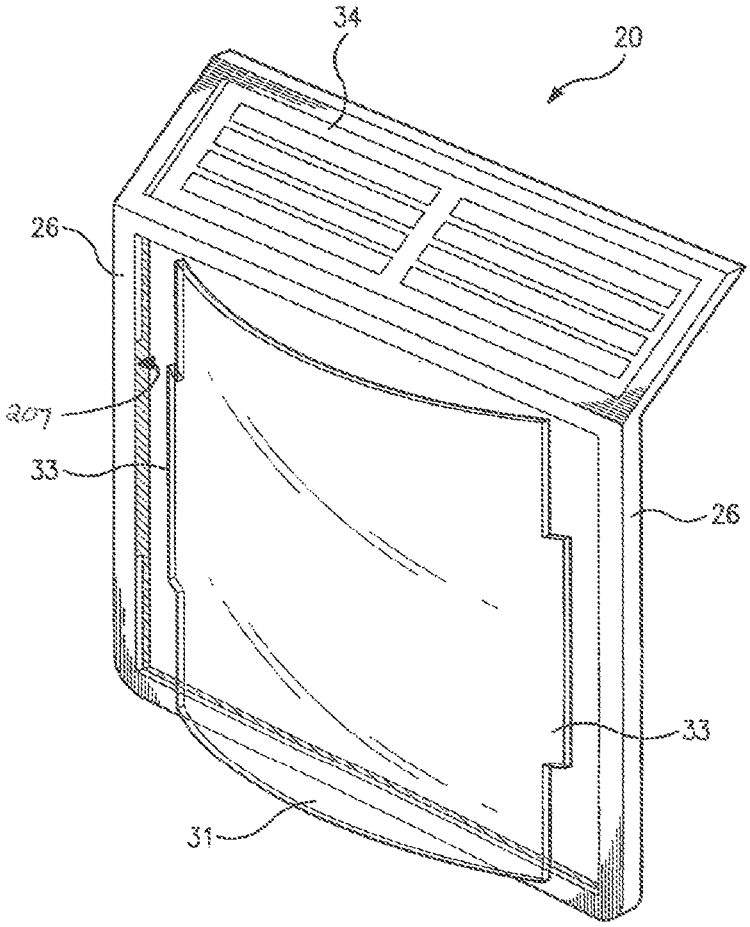
FIG. 79 is a perspective view of the solar powered lighting device as shown in FIG. 78, with the lens distorted or bent to fit within a replaceable mounting bracket.
Figure 80:
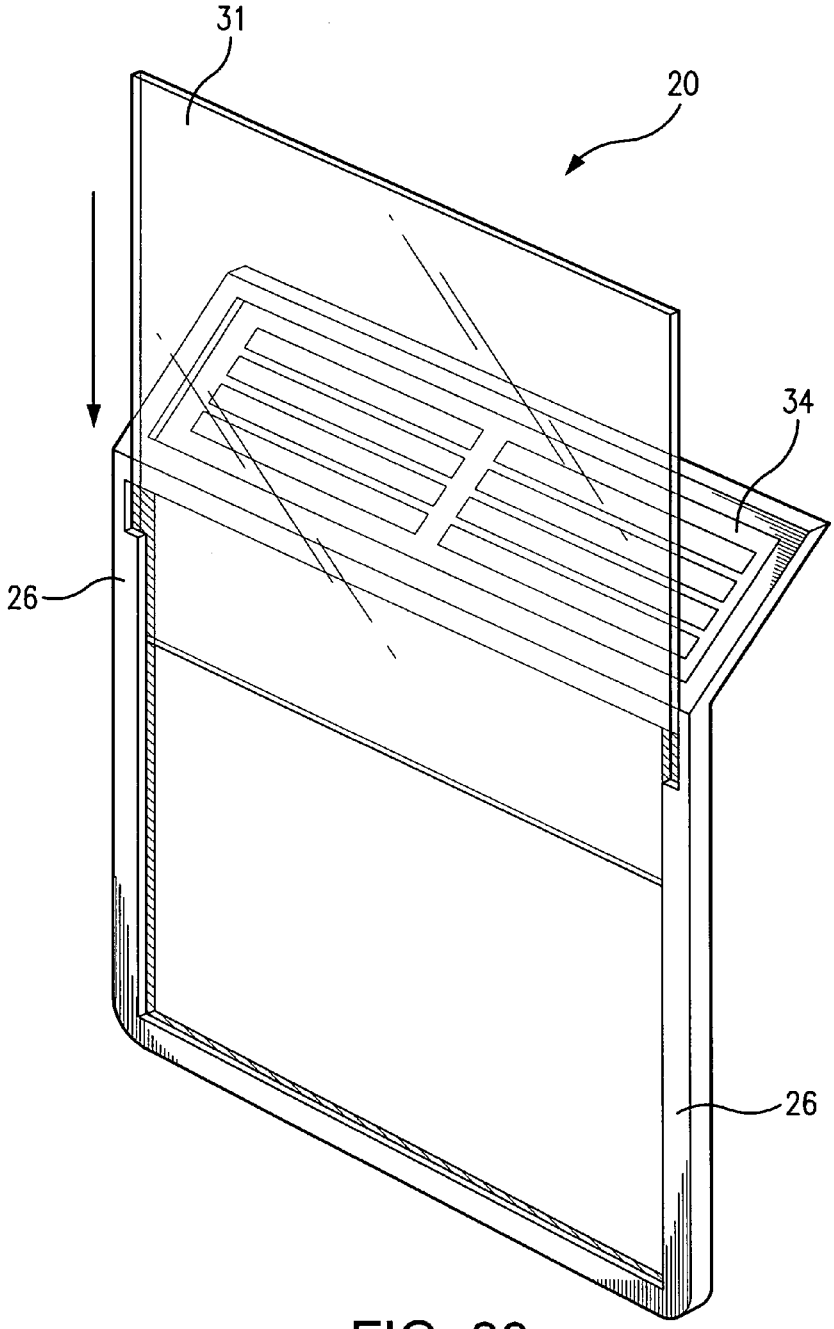
FIG. 80 is a perspective view of a solar powered lighting device, according to another embodiment of this invention, with a slidable replaceable lens.
Figure 82:
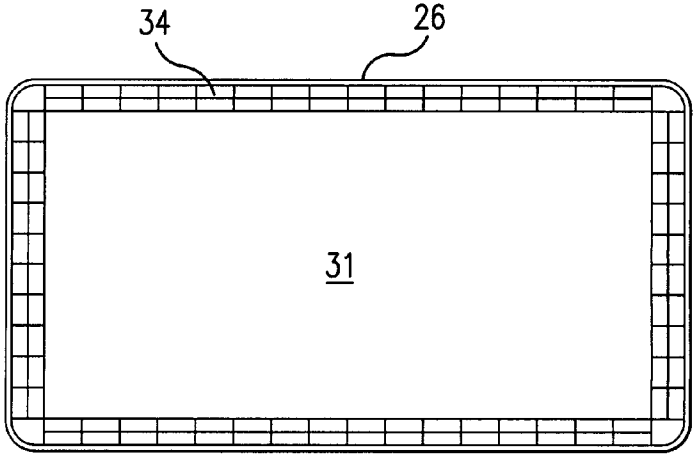
FIGS. 81-84 each is a front view of a solar power unit, showing solar cells positioned about a periphery of the unit.
Figure 84:
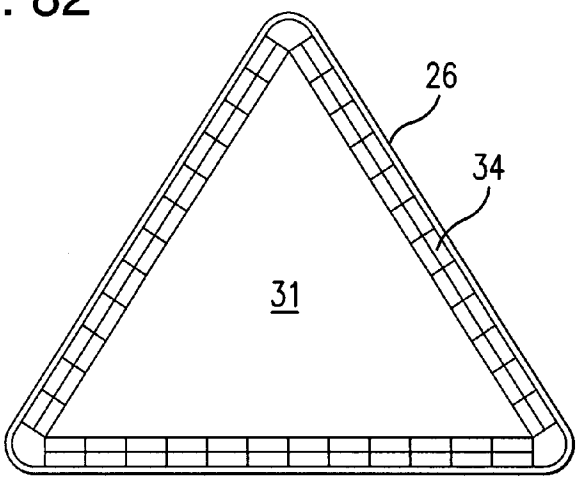
Figure 83:
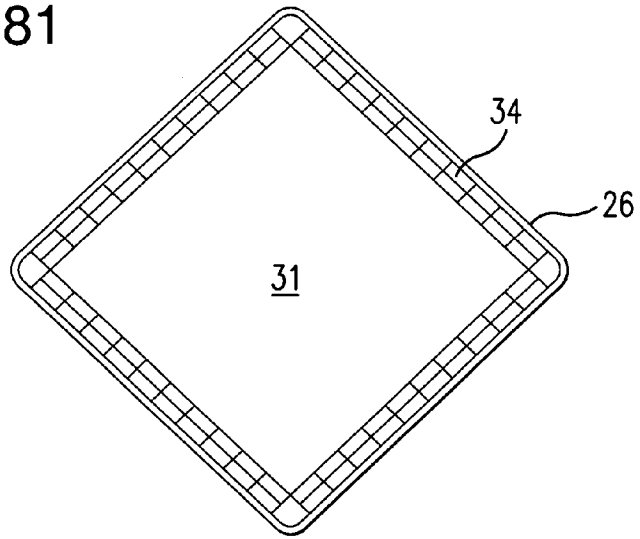
Figure 81:
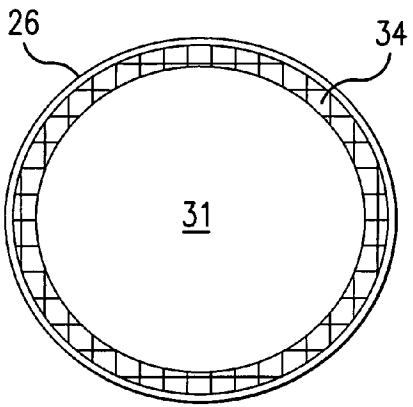
Figure 85:
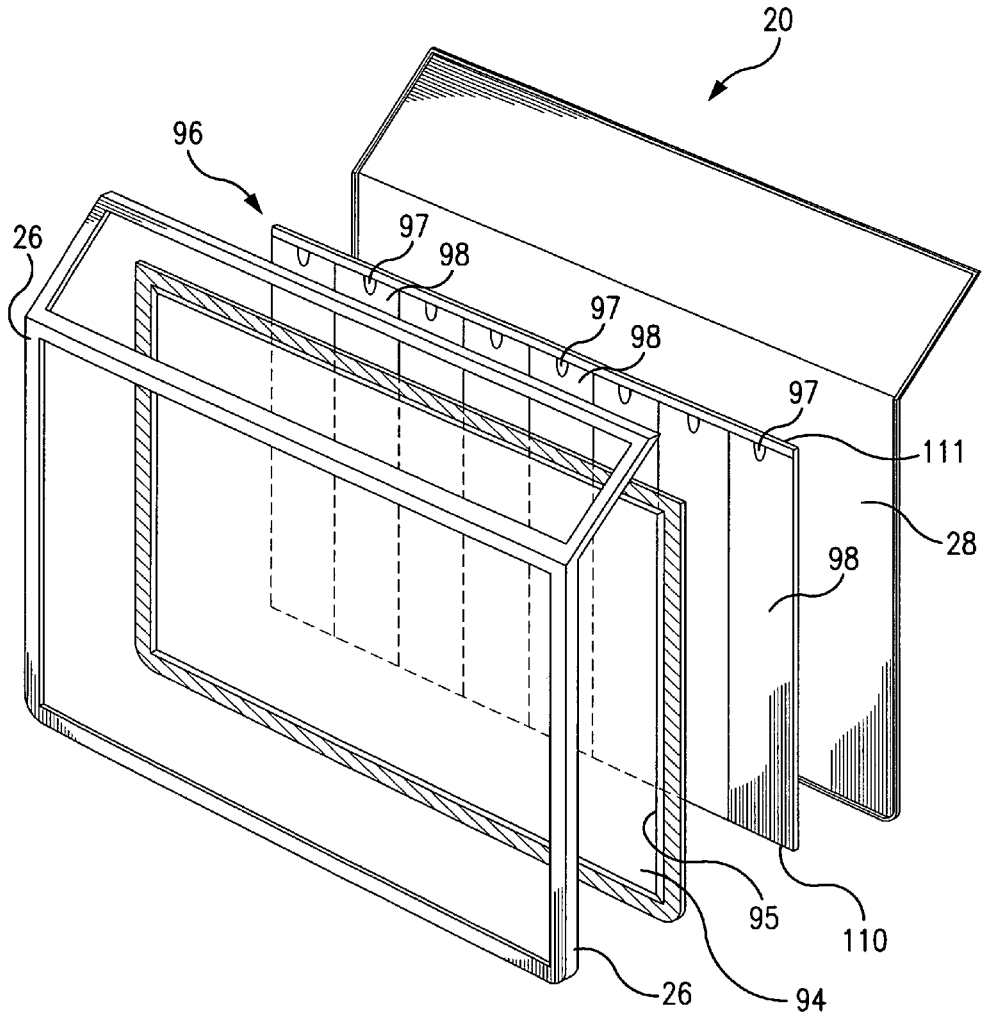
FIG. 85 is an exploded perspective view of a solar powered lighting device, according to another embodiment of this invention.

FIG. 77 shows an exploded perspective view of lighted element 28, housing 26 and graphics panel 31, according to one embodiment of this invention. FIG. 78 shows lighted element 28, panel 94 and housing 26 secured or connected with respect to each other, with graphics panel 31 in an unattached position. FIG. 79 shows how graphics panel 31 can be bent, flexed and/or otherwise deformed to be installed, removed, replaceably mounted and/or otherwise fixedly positioned within or with respect to housing 26. FIG. 79 shows panel 31 having tabs 33 or ears or another retainer or structural elements that fit within a corresponding or mating void or groove formed by housing 26, panel 94 and/or lighted element 28. FIG. 80 shows another embodiment for interchangeably installing, removing and/or otherwise positioning graphics panel 31 with respect to housing 26 and/or light guide 96, as shown in FIG. 85. In other embodiments according to this invention, other suitable mechanical systems and/or other structures can be used to accomplish the same result of interchangeably installing, removing and/or otherwise positioning graphics panel 31 with respect to housing 26 and/or any other element of this invention.

FIGS. 81-84 each shows a front view of a layout for collector cells of solar panel 34. From the different shapes shown in FIGS. 81-84, different surface areas for solar panel 34 can be achieved, depending upon selected dimensions and/or types of collector cells. Any other suitable shape and/or dimension can be used as a layout for the collector cells of solar panel 34.

In another embodiment according to this invention, it is possible to removably mount graphics panel 31 with respect to housing 26, wherein housing 26 has a pivotal connection or a hinge connection that allows housing 26 to open or otherwise move and receive graphics panel 31. For example, housing 26 can have a hinge positioned near a bottom portion of housing 26, so that graphic panel 31 can be slid, pivoted or otherwise moved or positioned into place and then housing 26 can be slid, pivoted or otherwise moved into a closed position, such as like closing a book, to fix or secure graphics panel 31 with respect to housing 26.

Although FIG. 80 shows graphics panel 31 sliding from top to bottom, in other embodiments according to this invention, graphics panel 31 can slide or otherwise move in any other direction and/or fashion with respect to housing 26, to accomplish the same result of interchangeably mounting graphics panel 31 with respect to housing 26.

As shown in FIGS. 81-84, solar panel 34 can be integrated into a frame or other section of housing 26. In some embodiments according to this invention, it is possible to eliminate solar panel 34, such as those shown in FIGS. 72-75, and by using the integrated solar panels 34 with respect to housing 26 and/or any other suitable structure, such as shown in FIGS. 81-84. Also using an arrangement of collector cells of solar panel 34, such as shown in FIGS. 81-84, provides or allows for a visually concealed appearance of solar panel 34. In such embodiments, the shape of housing 26 is not as visually distorted by solar panel 34 as compared to some other embodiments of this invention.

Depending upon the particular power needs, solar panel 34 can be sized and/or selected, depending upon the particular shape, to fully and/or partially power the requirements of lighting device 20 according to this invention.

In some embodiments according to this invention, such as shown in FIG. 85, panel 94 comprises border 95 that completely or at least partially surrounds a periphery of panel 94. As shown in FIG. 77, border 95 forms a complete rectangle shape. As shown in FIG. 78, when panel 94 is assembled with respect to frame or housing 26, border 95 completely or at least partially surrounds an outer edge, an outer periphery and/or a footprint of graphics panel 31. If there is any gap or spacing formed between the outer periphery of graphics panel 31 and a corresponding window of housing 26, border 95 can be positioned to block light from lighted element 28 to graphics panel 31. Border 95 can be a black color or any other suitable color or structure or element that blocks light to a degree required or preferred. With border 95, there is less of a need for a precise fit between the outer periphery of graphics panel 31 and a corresponding inner periphery of a window formed by housing 26.

FIG. 85 shows an exploded perspective view of lighting device 20, according to another embodiment of this invention. As shown in FIG. 85, eight light elements 97 are used to illuminate light guide 96 comprising eight corresponding segments 98 or panels. In some embodiments according to this invention, light element 97 is an LED type light. For example, light element 97 can be a pointing LED that initially directs light along a generally linear path, a wide beam LED, a side firing LED, an organic LED (OLED) and/or any other suitable LED type light. However, light element 97 can be any other suitable light source known to those skilled in the art of the technology associated with this invention.

Figure 87:
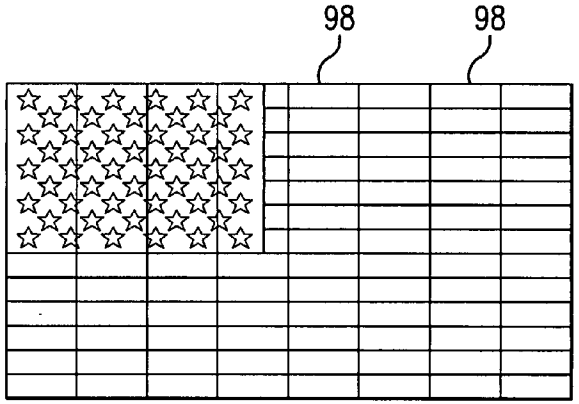
FIGS. 87-89 each shows a schematic representation of lighting elements arranged to achieve the general shape of the image shown in FIG. 86.
Figure 89:
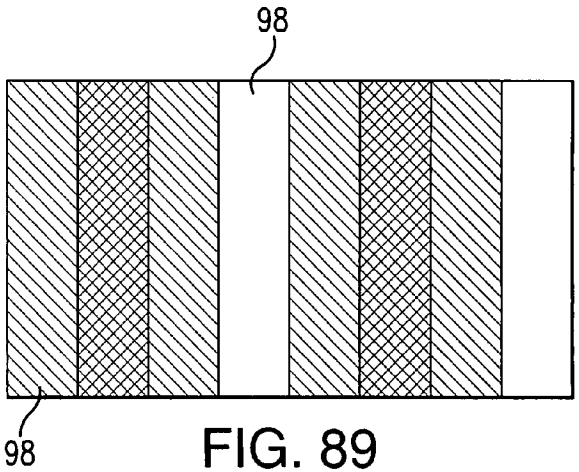
Figure 86:
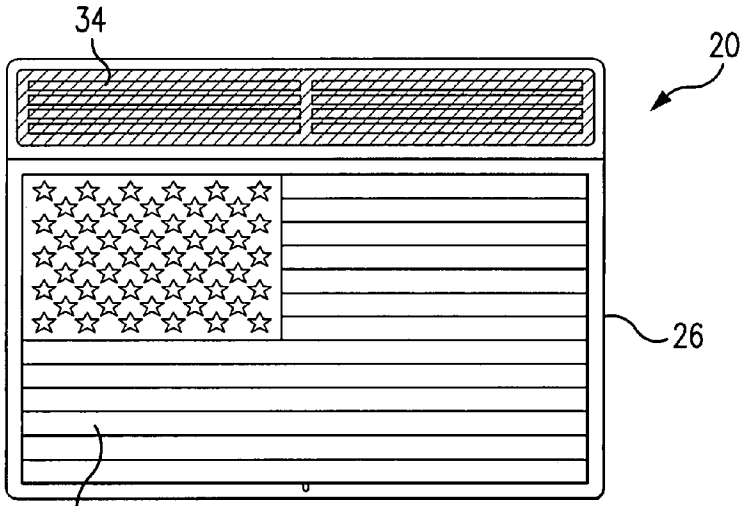
FIG. 86 is a front view of a solar powered lighting device, according to another embodiment of this invention.
Figure 88:
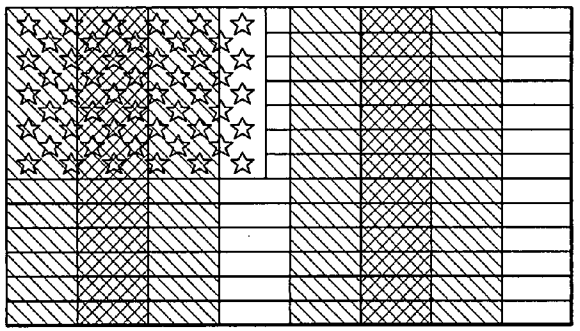

FIG. 86 shows a front view of the solar powered lighting device 20 as shown in FIG. 85. FIGS. 87-89 show how the panels 98 are arranged and segmented to achieve the overall design, such as a flag, as shown in FIG. 86. Any other suitable arrangement of segments or panels 98 and/or light elements 97 can be used to achieve different images and effects.

In some embodiments of this invention, light guide 96 can have only one segment 98. In other embodiments of this invention, light guide 96 comprises two or more segments 98. In some embodiments of this invention, segments 98 are separated from or isolated with respect to each other. For example, as shown in FIG. 85, the vertical lines between adjacent segments 98 can either be an imaginary line of separation or an actual line of separation, depending upon the particular use for lighting device 20.

Figure 125:
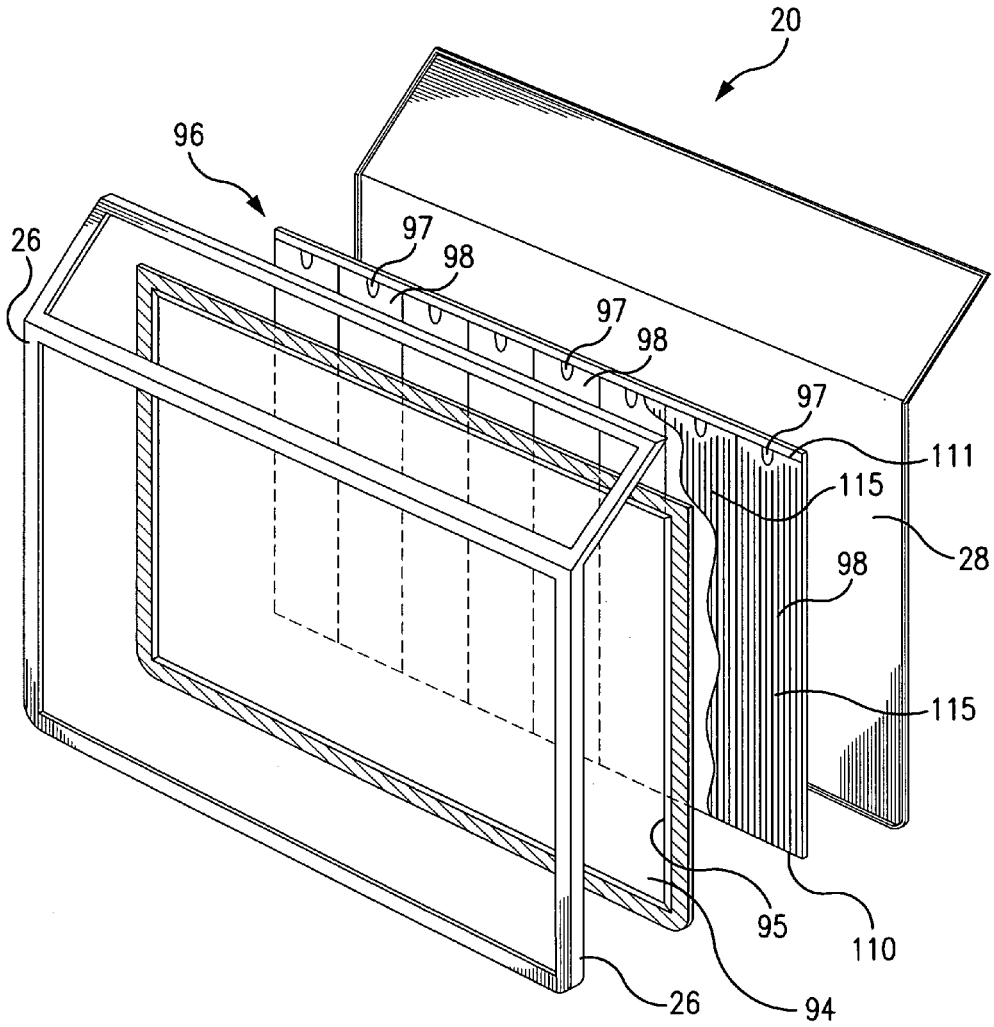
FIG. 125 is an exploded perspective view of a solar powered lighting device, similar to the embodiment shown in FIG. 85, but according to another embodiment of this invention.
Figure 126:
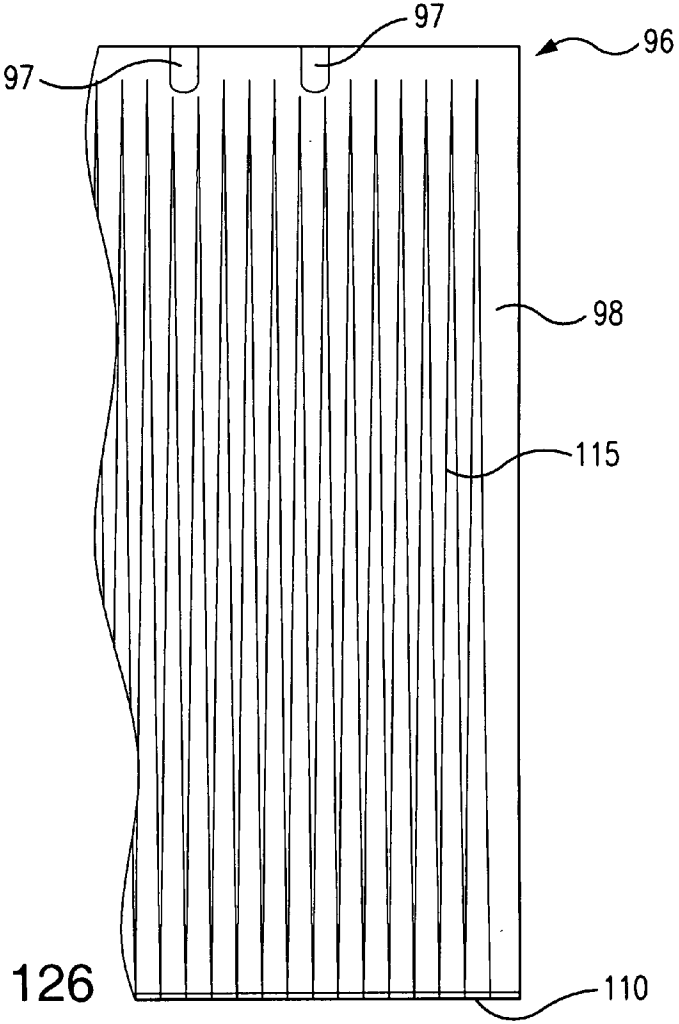
FIG. 126 is a partial front view of a section of a light guide having longitudinal grooves, according to one embodiment of this invention.

FIG. 125 shows another embodiment of this invention, where light guide 96 has a non-planar surface and/or an irregular surface. FIG. 125 shows only a partial view of the irregular surface, schematically represented by vertical lines generally parallel to each other. Any textured, grooved, perforated and/or otherwise structured irregular surface can be used to gradate light through light guide 96. For example, FIG. 126 shows an irregular and/or non-planar surface formed by a plurality of longitudinal grooves 115 that form a V-shape, in a longitudinal and/or a cross-sectional direction. As shown in FIGS. 125 and 126, the grooves extend entirely to bottom edge 110 but stop short and thus do not extend entirely to top edge 111. However, in other embodiments according to this invention, the longitudinal lines can extend entirely to or stop short of bottom edge 110 and/or top edge 111.

The layout and design of the irregular surface, such as grooves 115, can be varied to accommodate any suitable, particular and/or desired impact or result upon gradation of the light through light guide 96. For example, the V-shaped grooves 115 shown in FIG. 127 can have a different shape or cross-sectional shape, again depending upon the desired effect and impact on the gradation of light through light guide 96. In some embodiments according to this invention, the irregular surface and/or grooves can be symmetrical and/or a symmetrical about a center line axis, horizontal, vertical and/or diagonal, of light guide 96.

Figure 127:
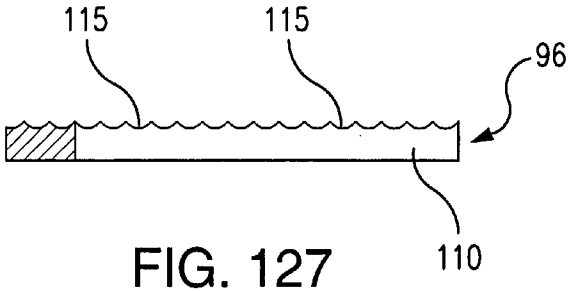
FIG. 127 is a bottom view of the partial light guide, as shown in FIG. 126.
Figure 128:
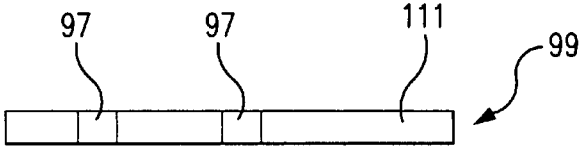
FIG. 128 is a top view of the partial light guide, as shown in FIG. 126.

In some embodiments of this invention, portions of the irregular surface, such as edges of grooves 115, such as shown in FIG. 127, culminate or gather the light rays or a light spectrum. The design of the shape and/or dimensions of the irregular surface can be varied to achieve different levels of light at different areas of light guide 96. Even though when lit, light guide 96 brightens or lights up facets of the irregular surface, when panel 94 and/or panel 31 is positioned adjacent, next to or near light guide 96, the graphics displayed appear uniform and/or continuous. The controller of this invention manages power delivered to the light sources, such as light elements 97, during a time period in which the controller manages power delivered to produce a dynamic image or an animated image on or at light guide 96. In some embodiments of this invention, the controller changes an illumination intensity of each of the light sources so that during the time period, each light element 97 receives a zero power level when powered off, receives a complete power level when powered on or receives an intermediate power level when powered to the intermediate level.

As used throughout this specification and in the claims, the terms gradate and gradation relate to how light is distributed from light element 97 into light guide 96 and through the material of light guide 96. The location, spacing and dimensions of light elements 97 can be varied to achieve different manners in which light enters and is transferred through light guide 96 and/or the irregular surface of light guide 96.

Figure 90:
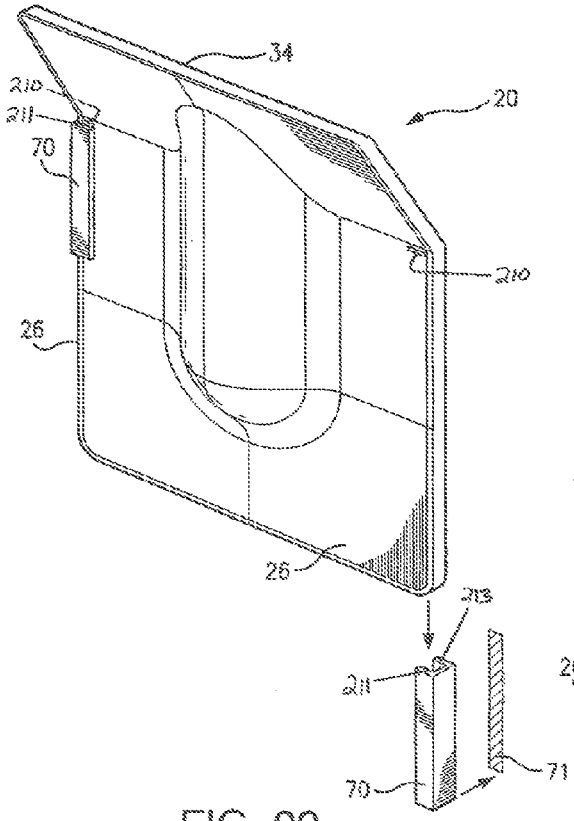
FIG. 90 is an exploded perspective view of a solar powered lighting device, with a mounting bracket, according to one embodiment of this invention.
Figure 91:
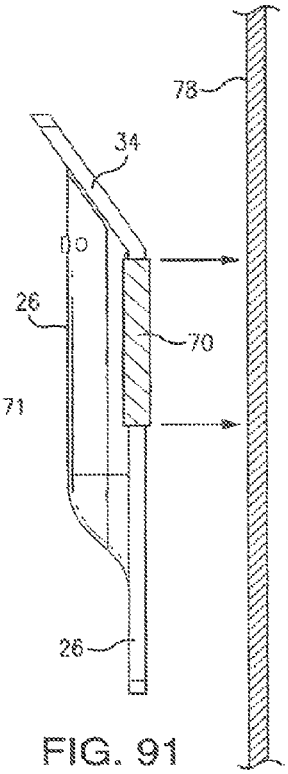
FIG. 91 is a side view of the solar powered lighting device as shown in FIG. 90, but positioned at a distance away from a plate material or a panel.

FIGS. 90 and 91 show another embodiment for mounting housing 26 with respect to mounting surface 78 and/or another suitable structure and/or element. FIG. 90 shows retainer 70 sized and shaped to forth a void that accommodates or corresponds to an outer surface of housing 26. Retainer 70 can be designed and/or dimensioned differently than as shown in FIG. 90, to accommodate housing 26 as shown in FIG. 90 and/or to accommodate any other suitably shaped or designed housing.

As shown in FIG. 90, connector 71 or another attachment and/or other suitable structure or element is used to fix the position of retainer 70 and thus housing 26 with respect to mounting surface 78 or another suitable structure. As shown in FIG. 90, connector 71 comprises double sided tape. However, connector 71 may also comprise a suitable hook and loop fastener, suction cups, and/or any other suitable fastener. As shown in FIGS. 90 and 91, retainer 70 is relatively small in size when compared to the size of housing 26. The difference in sizes can minimize the visual appearance of retainer 70, so that retainer 70 appears to integrate with or flow with the overall shape and/or dimensions of housing 26. Retainer 70 can have any other suitable design, size and/or shape. FIG. 91 shows a direction of attachment for fixing retainer 70 and thus housing 26 with respect to mounting surface 78. It is possible to increase the strength of materials used for retainer 70, in an effort to reduce the thickness and/or another visible dimension of retainer 70.

Figure 92:
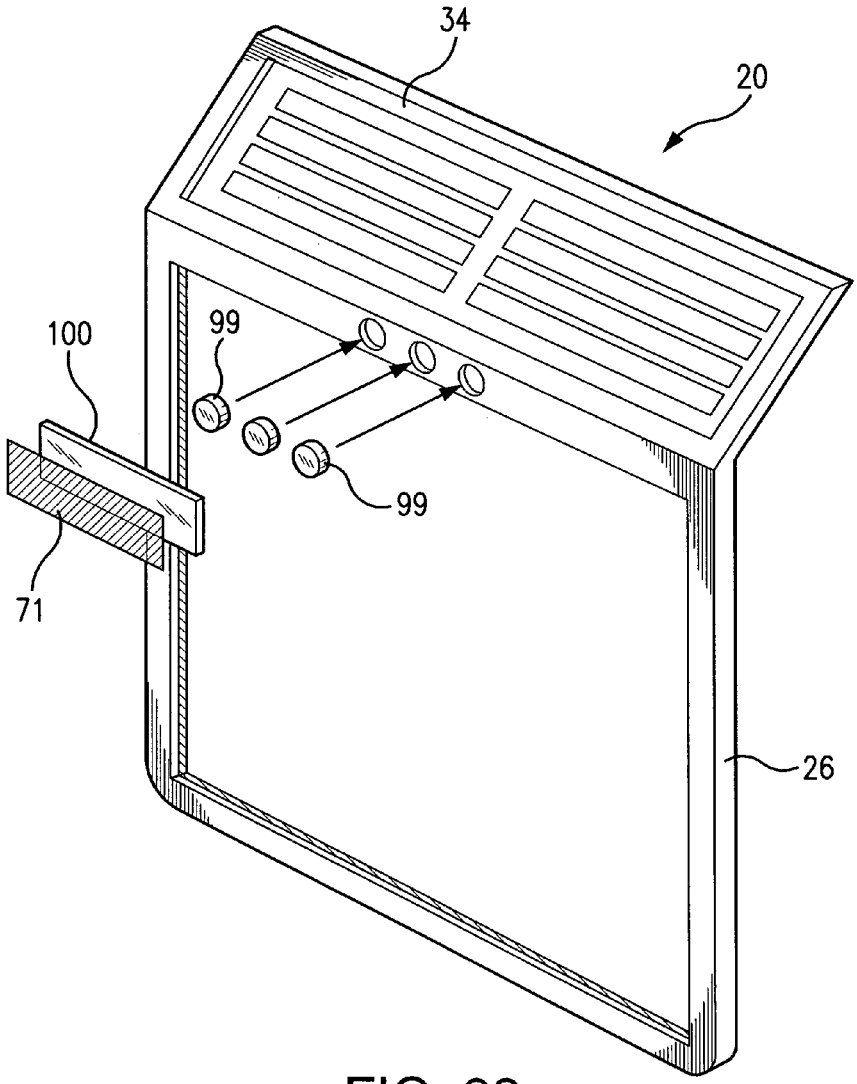
FIG. 92 is a perspective view of a solar powered lighting device with a magnetic retention system, according to one embodiment of this invention.

FIG. 92 shows a perspective view of another attachment for fixing the position of housing 26 with respect to mounting surface 78. As shown in FIG. 92, one or more magnets 99 are used to interchangeably fix the position of housing 26 with respect to mounting surface 78. Attracting element 100, which can be a metal or another magnetically attracting substance, and/or connector 71 can be used to position, mount and/or interchangeably fix a position of housing 26 with respect to mounting surface 78.

Figure 93:
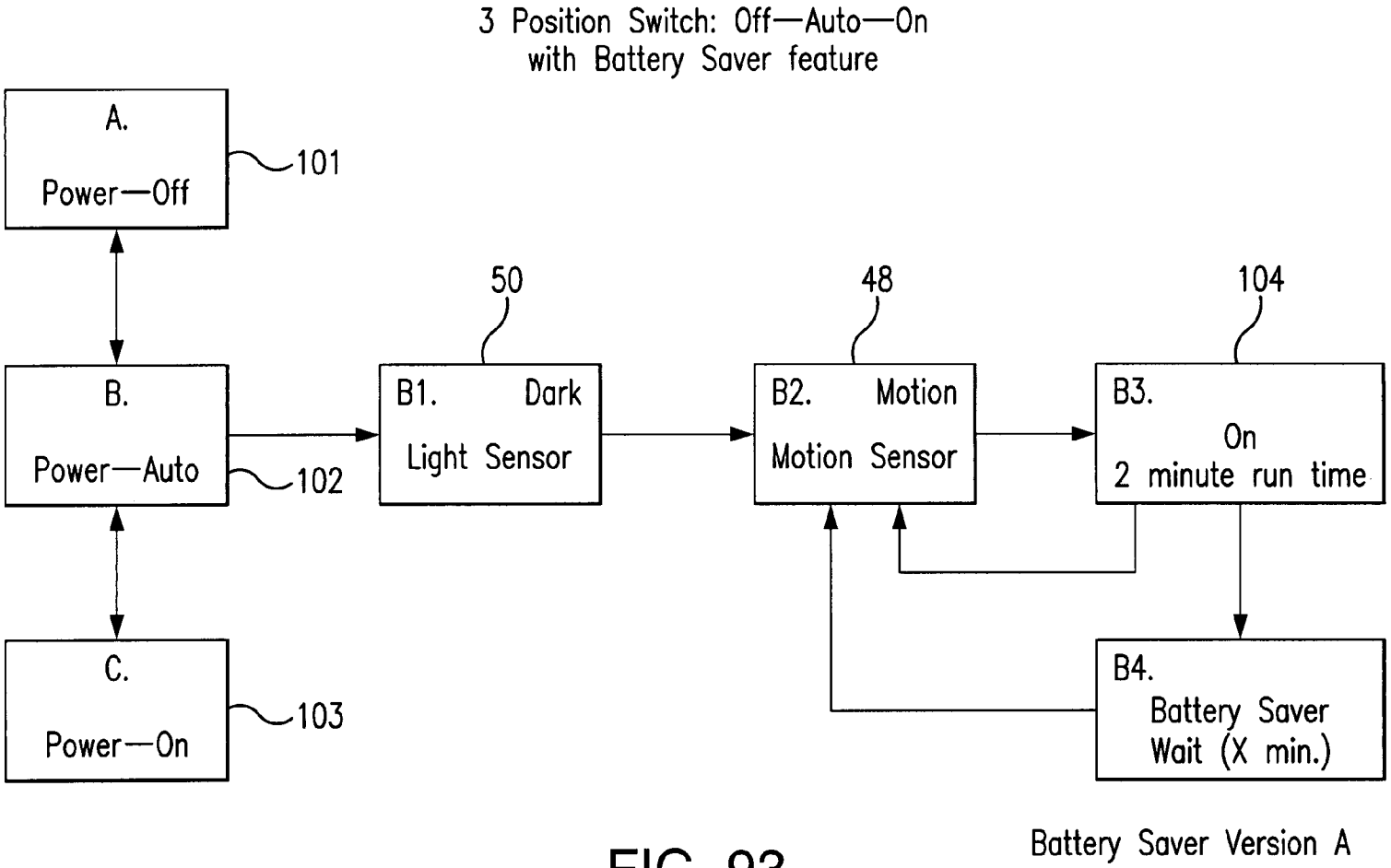
FIG. 93 is a flow chart showing program steps for switching a power supply between an off position, an auto position and an on position.

FIG. 93 shows a flow diagram for programmable logic used in combination with control module 42 to operate a battery powered lighting device 20, according to one embodiment of this invention. Any battery unit, electrical and/or solar, of this invention can be used alone or in combination with solar panel 34. FIG. 93 shows a timer receiving signals from light sensor 50 and/or motion sensor 48. However, any other suitable sensor can be used in place of or in combination with the sensor shown in FIG. 93, for example, to operate the timer and to switch the battery into a power saver mode.

Figure 94:
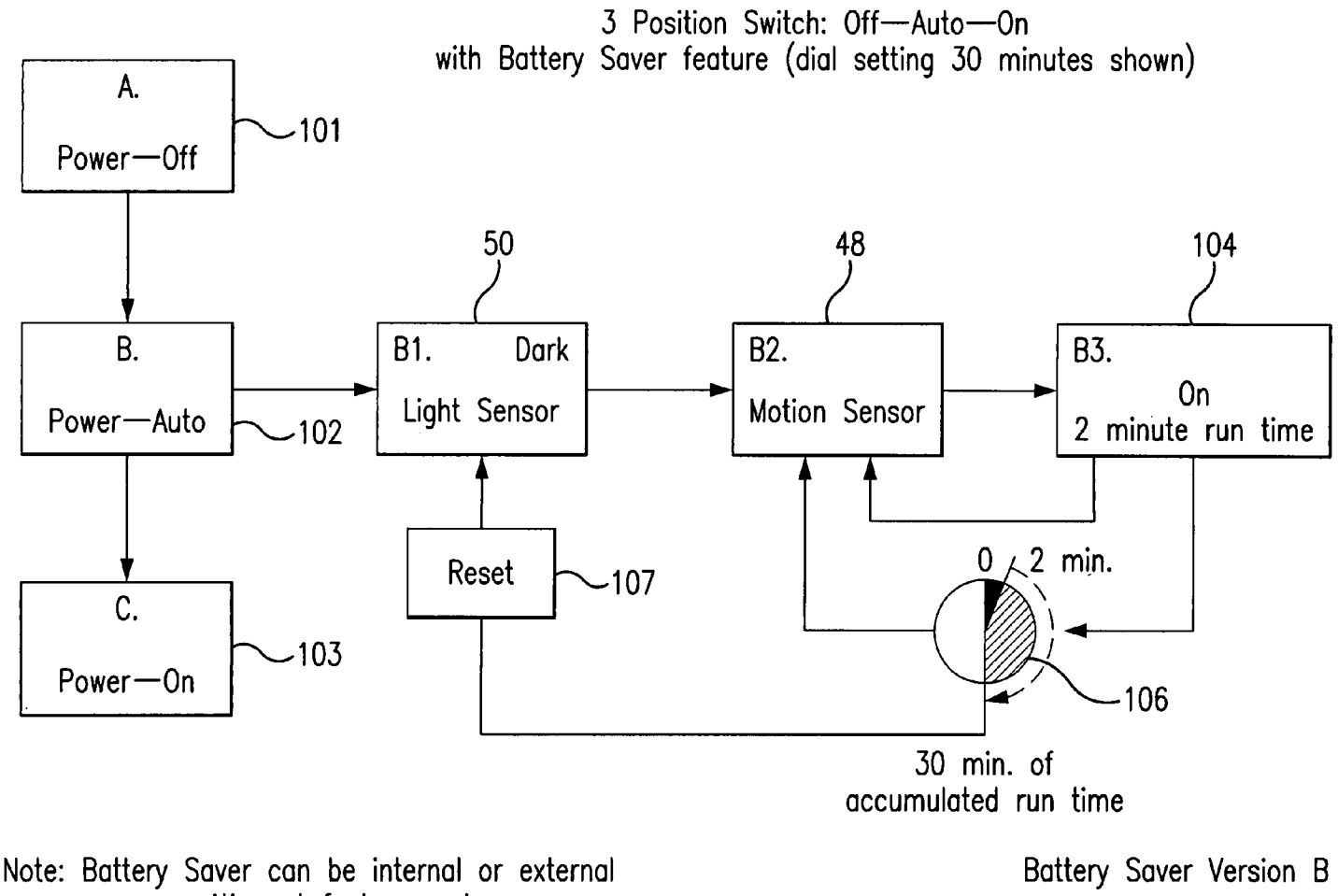
FIG. 94 is a flow chart showing program steps for switching a power supply, using a timer function.

FIG. 94 shows another embodiment of programmable logic that can be used in combination with control module 42 to switch a battery powered lighting device 20 into a battery saver mode, using an accumulated run time counter or timer. Although light sensor 50 and motion sensor 48 are shown in FIG. 94, any other suitable sensor can be used in place of or in combination with those shown in FIGS. 93-95.

Figure 95:
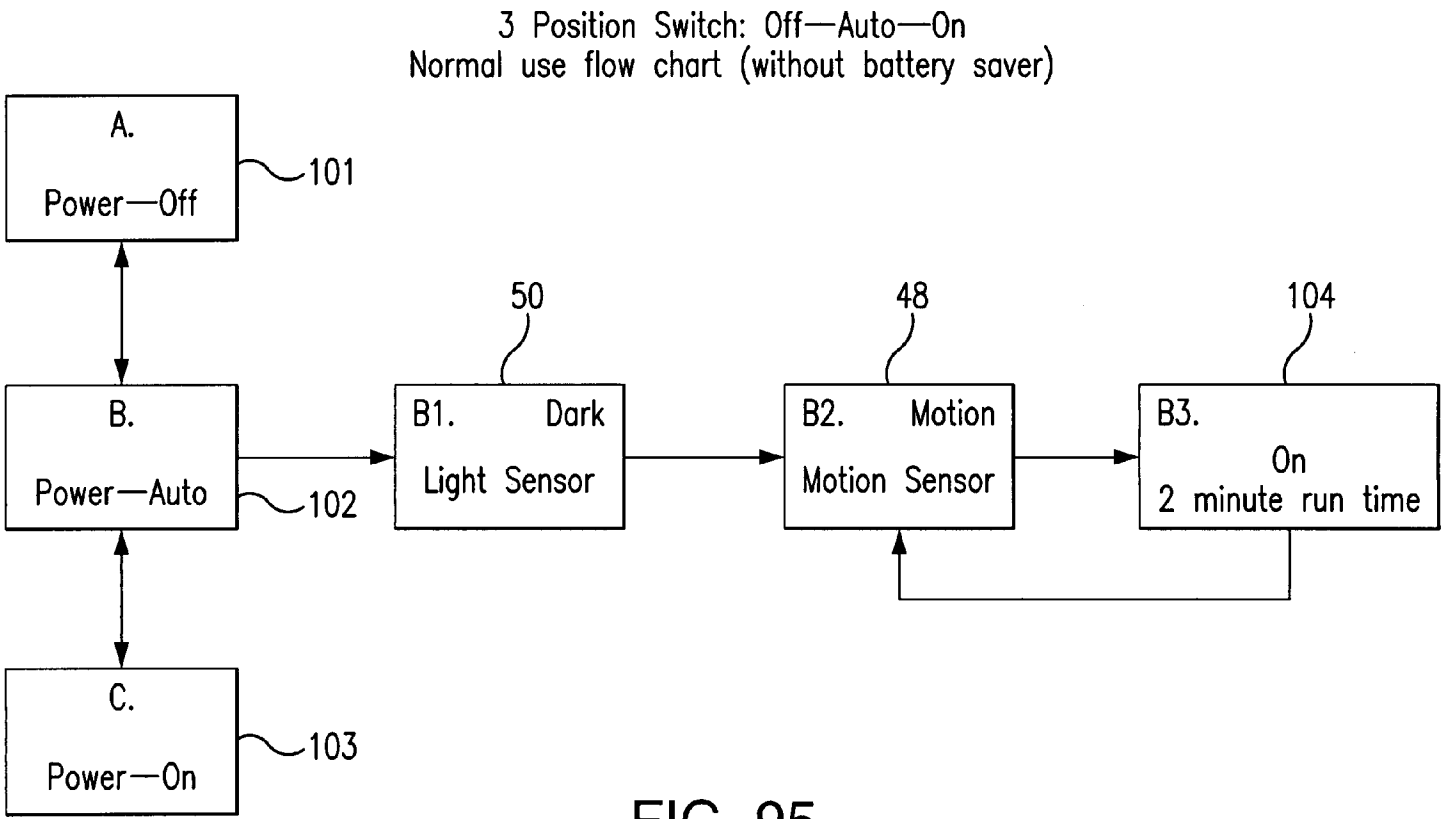
FIG. 95 is a flow chart showing program steps for switching a power supply that does not use a battery saver feature.

FIG. 95 shows another embodiment of programmable logic that can be used in combination with control module 42, without a battery saver mode. FIG. 95 shows light sensor 50 and motion sensor 48 generating signals to emit to timer 106. However, any other suitable sensor can be used in place of and/or in combination with the sensors shown in FIG. 95.

The programmable logic or control scheme shown in FIGS. 93-95 can be used with control module 42, for example, which may include PC board 43. Control module 42 can be programmed to automatically switch internally according to a particular factory setting and/or can be manually switched externally, for example, by a user or a consumer. The battery saver modes can be used to maintain battery life, which is particularly important when using non-rechargeable batteries.

As shown in FIG. 93, depending upon the signal that run time block 104 receives, it emits either a non-battery saving signal to motion sensor 48 or it emits a signal to the battery saver block to wait a certain period of time and then emits the signal to motion sensor 48, for example.

As shown in FIG. 94, a consumer or user sets power-off 101, power-auto 102 and/or power-on 103. A signal is then sent to light sensor 50 and motion sensor 48. Light sensor 50 and/or motion sensor 48 can be set to different levels of sensitivity. Motion sensor 48 emits a signal to run time 104 which then either emits a non-battery saver signal back to motion sensor 48 or emits a signal to accumulate a run time at timer 106 which is a timer or accumulator that can be set or programmed for a different number of sets at a different period of time. The run time can be set at a particular or set interval, such as a particular number of minutes. Once the timer 106 accumulates a specified amount of time, then the circuit or flow logic proceeds to reset 107 and enters a reset mode. The reset mode can be controlled by light, such as daylight, or by any other start parameter, such as a sound, a voice command and/or any other suitable input parameter. Reset 107 then emits a signal back to light sensor 50. The system can enter or then enters a loop. If timer 106 accumulates run time per set period, like a day or an hour, to limit power consumption to a selected time interval for the period, which can be factory set and/or consumer set, then the signal proceeds from timer 106 to motion sensor 48 and again enters a programmable loop.

FIGS. 93-95 and the associated flow diagrams and programmable logic can be altered to achieve different battery saving modes of operation for lighting device 20 and/or any suitable element according to this invention.

Figure 97:
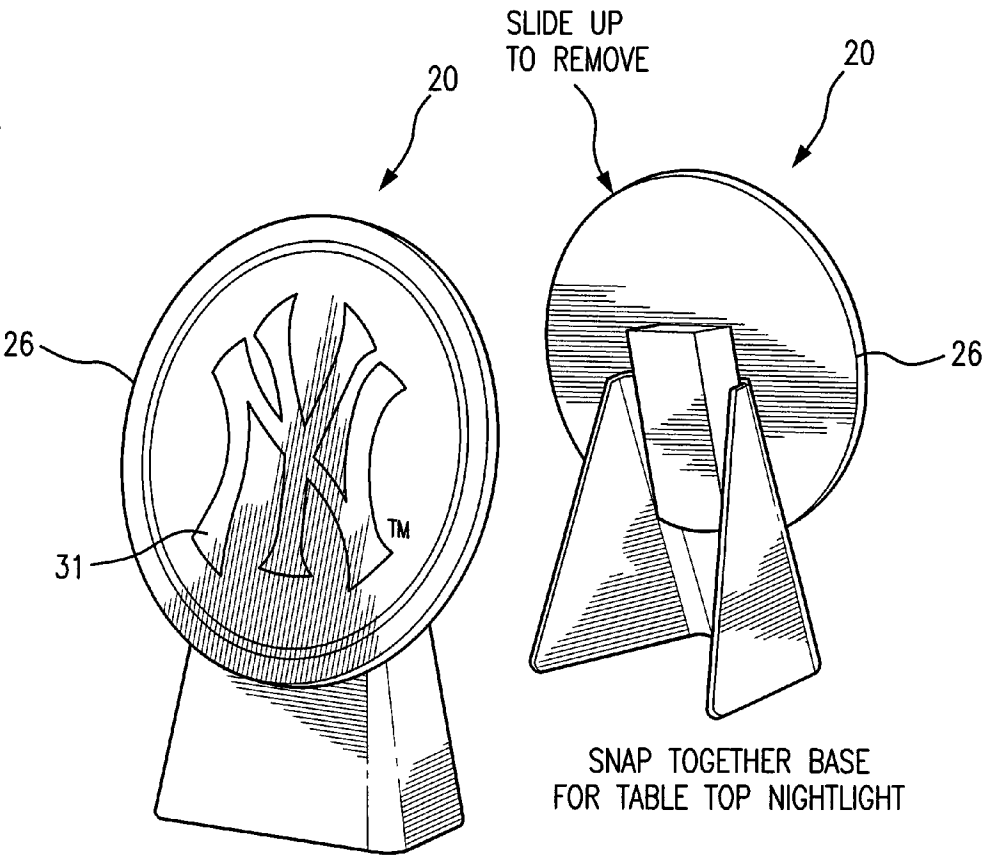
FIG. 97 shows front and back perspective views of the lighting device shown in FIG. 96, but in an assembled position.
Figure 96:
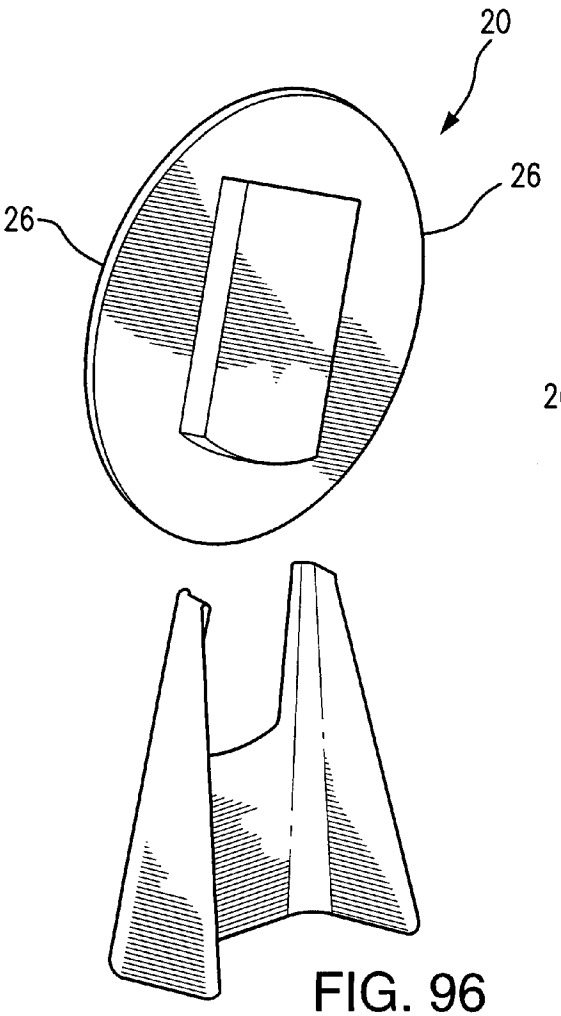
FIG. 96 is a perspective view of a battery powered lighting device, according to one embodiment of this invention.

FIGS. 96 and 97 show different embodiments of battery powered lighting devices 20, according to this invention. As shown in FIGS. 96 and 97, housing 26 can be replaceably mounted within a cradle or a stand, which can be used for display purposes. In some embodiments according to this invention, the cradle or base can also include a powered charging unit.

Figure 99:
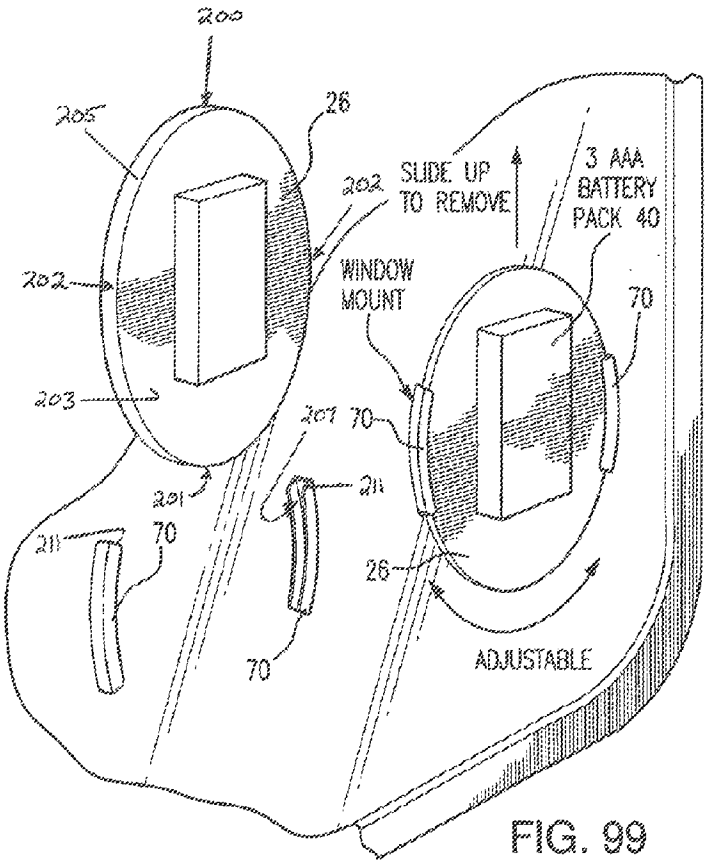
FIG. 99 is an exploded respective view showing different options for adjustably positioning the lighting device of this invention, with respect to a car window.
Figure 98:
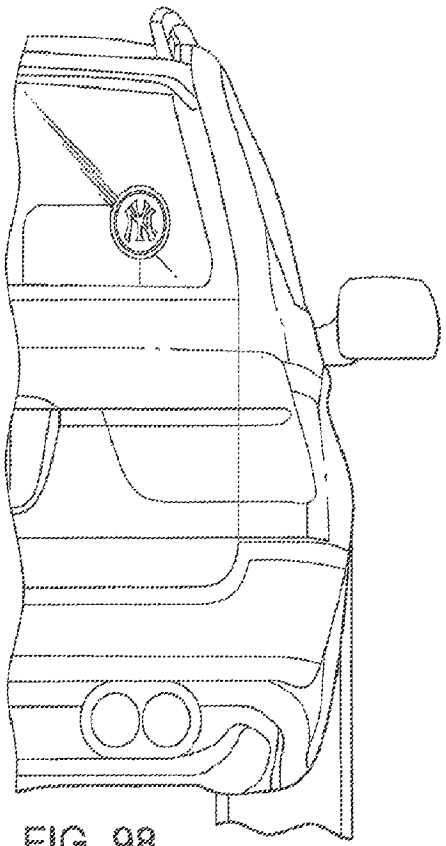
FIG. 98 shows a lighting device according to this invention, as mounted in the rear window of a vehicle.

FIGS. 98 and 99 show one embodiment of housing 26 attached with respect to a vehicle window with retainer 70. In some embodiments according to this invention, such as shown in FIG. 99, retainer 70 has an open upper portion to accommodate a sliding in movement of housing 26 with respect to retainer 70, such as shown in FIG. 99. With such retainer 70, housing 26 can be adjusted or repositioned to change the mounting position of housing 26 and thus lighting device 20, such as with respect to mounting surface 78, which can be a glass window of a vehicle.

Figure 102:
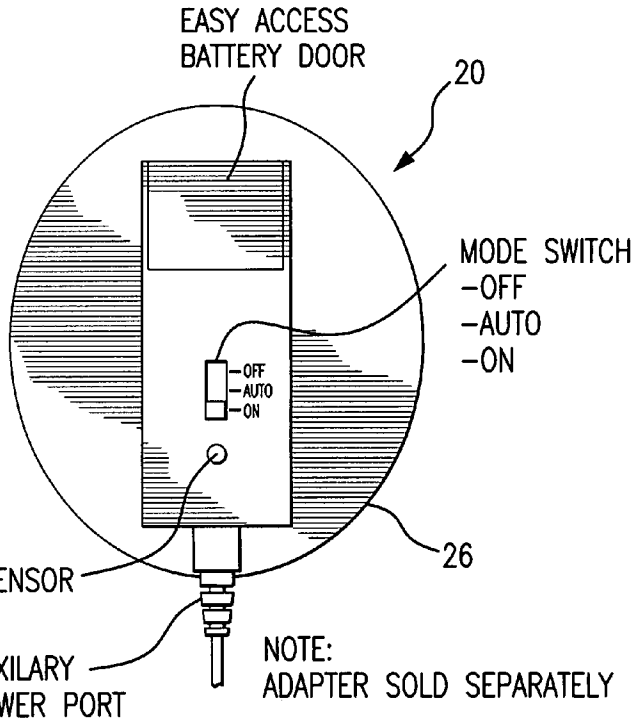
FIG. 102 is a rear view of a battery powered lighting device, according to one embodiment of this invention.
Figure 101:
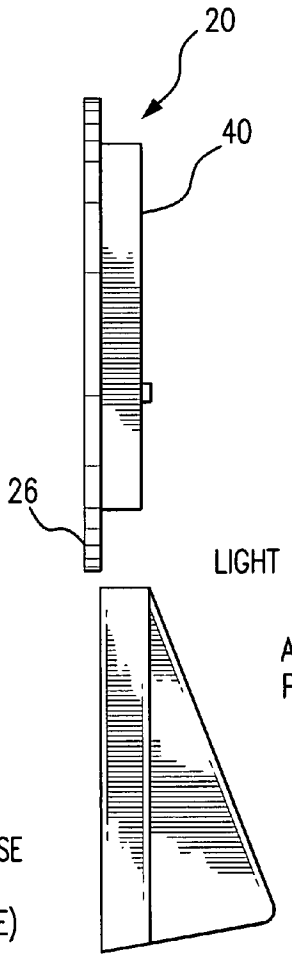
FIG. 101 is a side view showing the lighting device as shown in FIG. 100.
Figure 100:
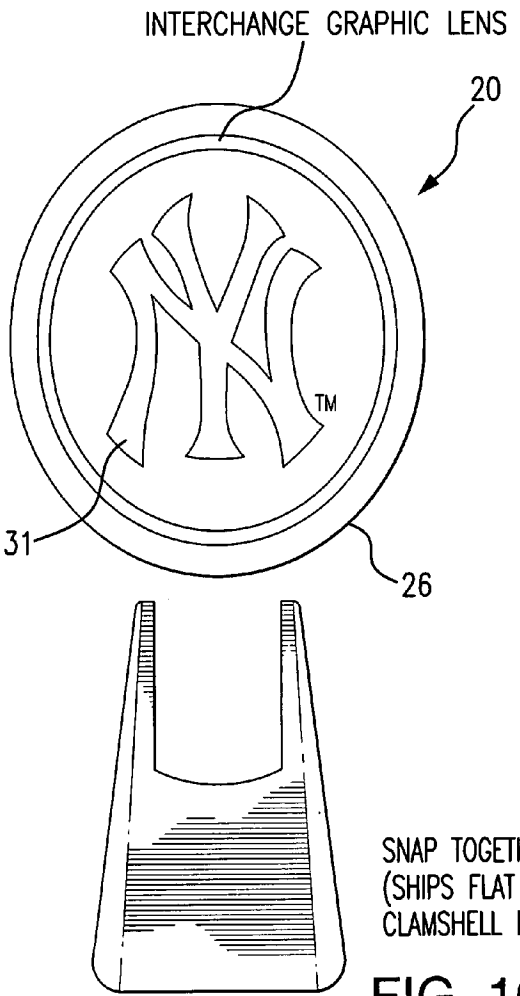
FIG. 100 is a front exploded front view showing a battery powered lighting device, according to one embodiment of this invention.
Figure 103:
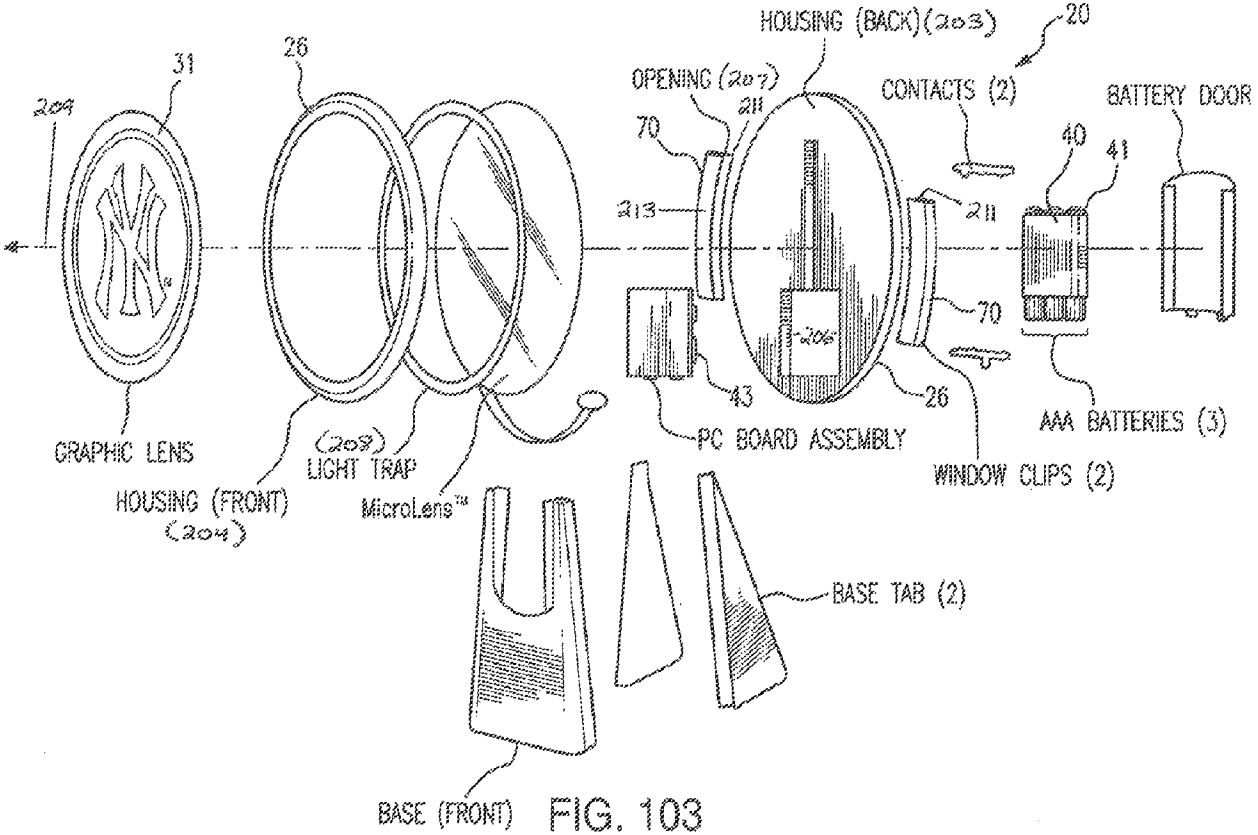
FIG. 103 is an exploded perspective view of a battery powered lighting device, according to one embodiment of this invention.
Figure 104:
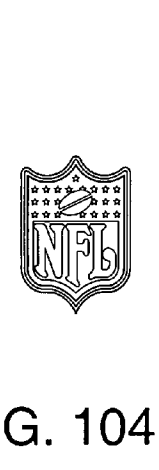
FIGS. 104-107 each is a perspective view of a lighting device, according to different embodiments of this invention.
Figure 104:
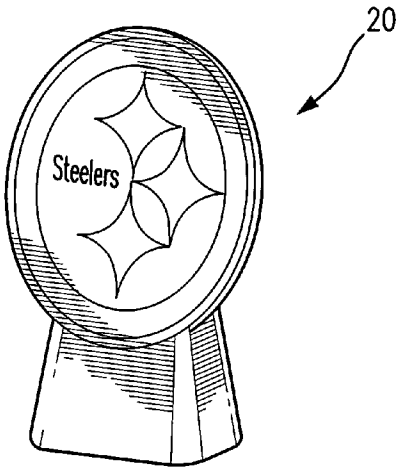
Figure 105:
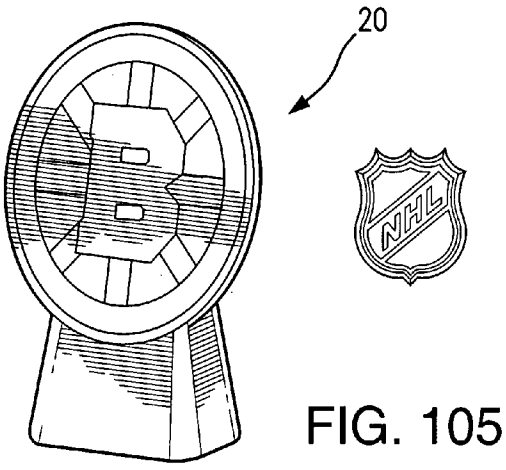
Figure 106:
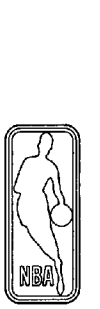
Figure 106:
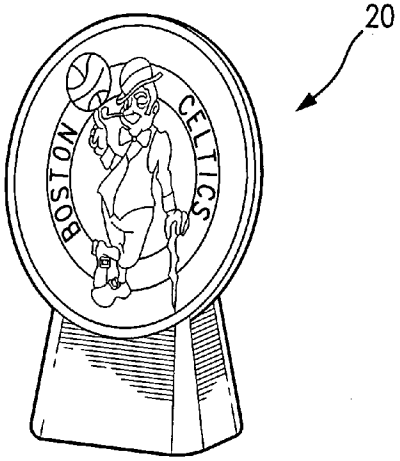
Figure 107:
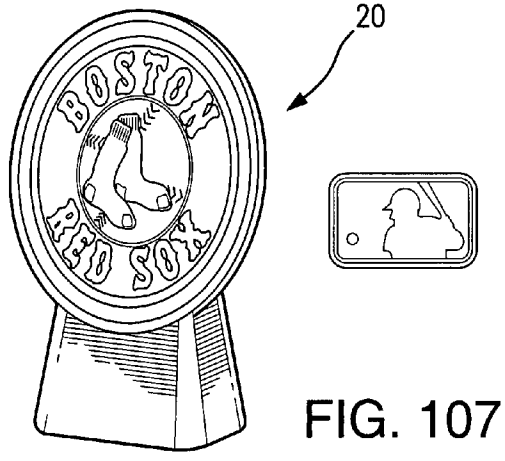
Figure 110:
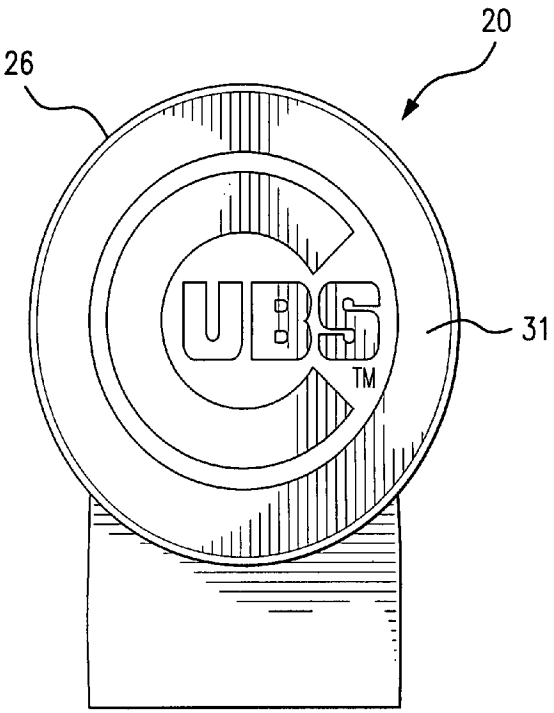
FIG. 110 is a front view of the lighting device, as shown in FIG. 108.
Figure 109:
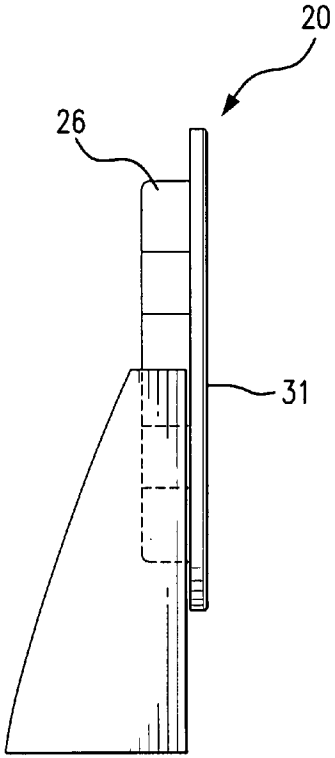
FIG. 109 is a side view of the lighting device, as shown in FIG. 108.
Figure 108:
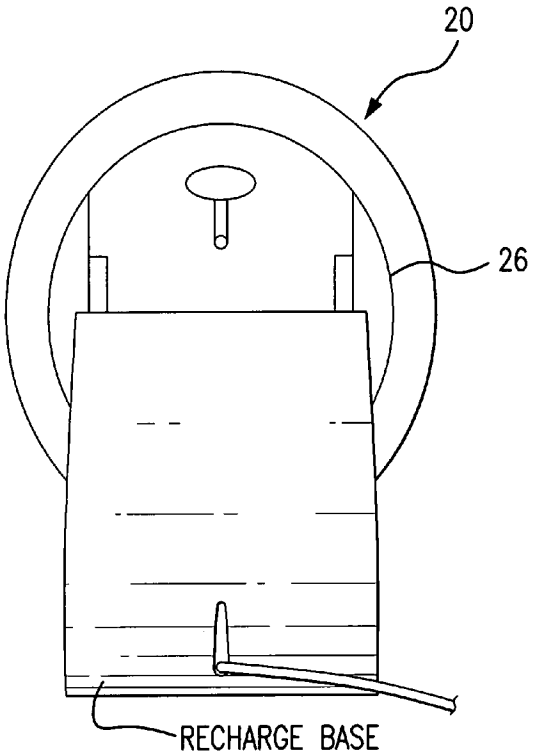
FIG. 108 is a rear view of a rechargeable lighting device, according to one embodiment of this invention.
Figure 111:
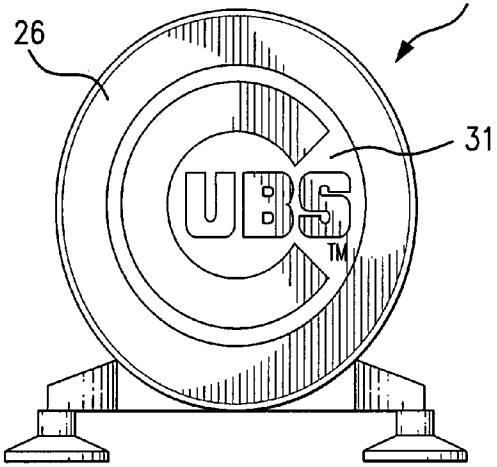
FIG. 111 is a front view of a lighting device, according to another embodiment of this invention.
Figure 112:
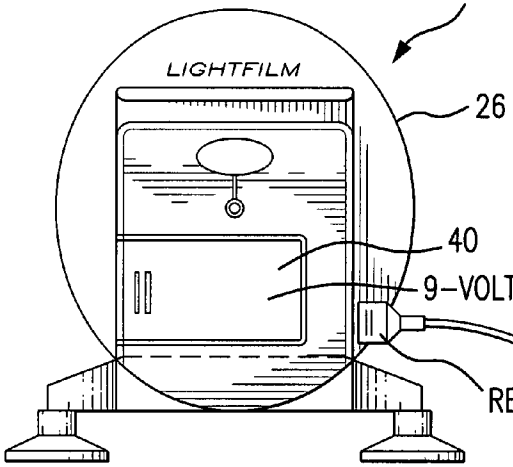
FIG. 112 is a rear view of the lighting device, as shown in FIG. 111.
Figure 113:
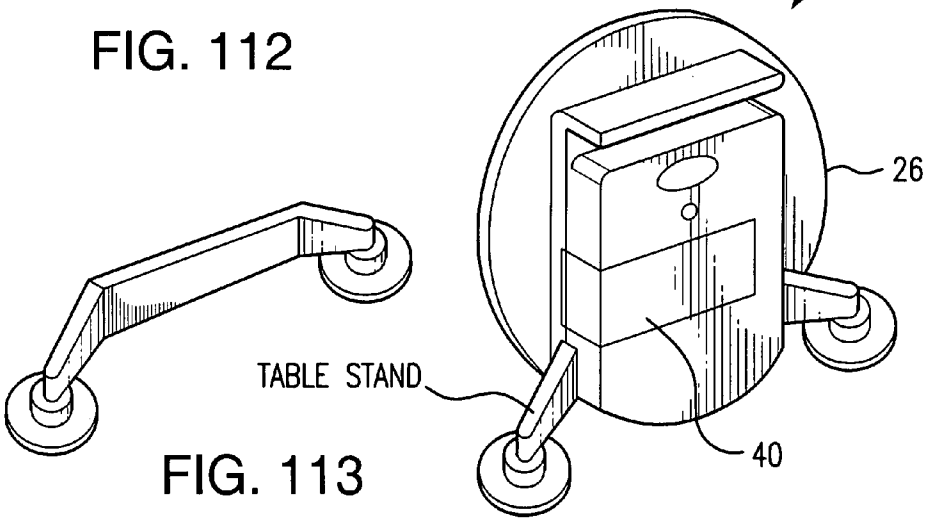
FIG. 113 is a rear perspective view of a lighting device, according to another embodiment of this invention.
Figure 116:
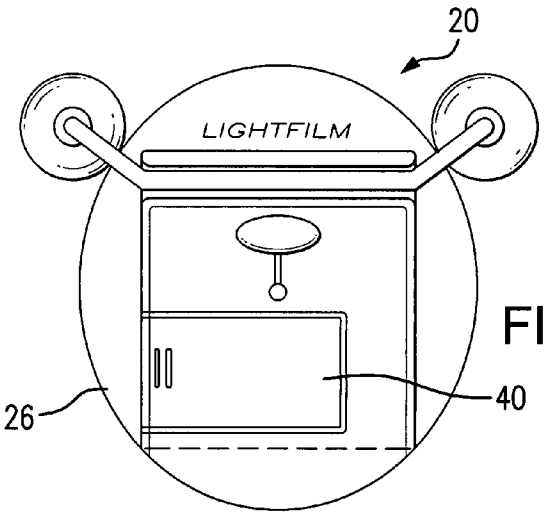
FIG. 116 is a rear view of the lighting device, as shown in FIGS. 114 and 115.
Figure 115:
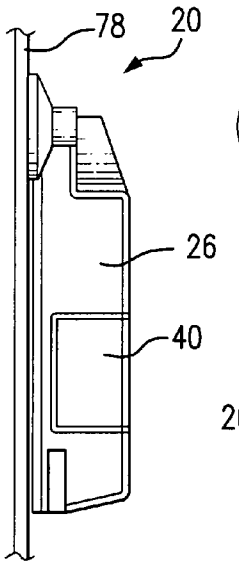
FIG. 115 is a side view of the lighting device, as shown in FIG. 114, mounted to a plate material or a panel.
Figure 114:
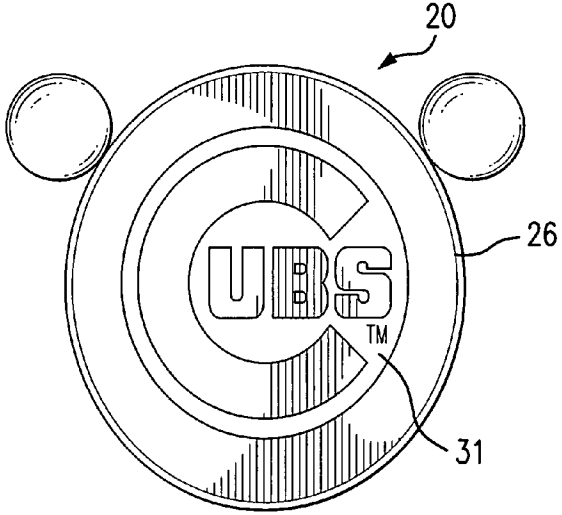
FIG. 114 is a front view of a lighting device, according to another embodiment of this invention.
Figure 117:
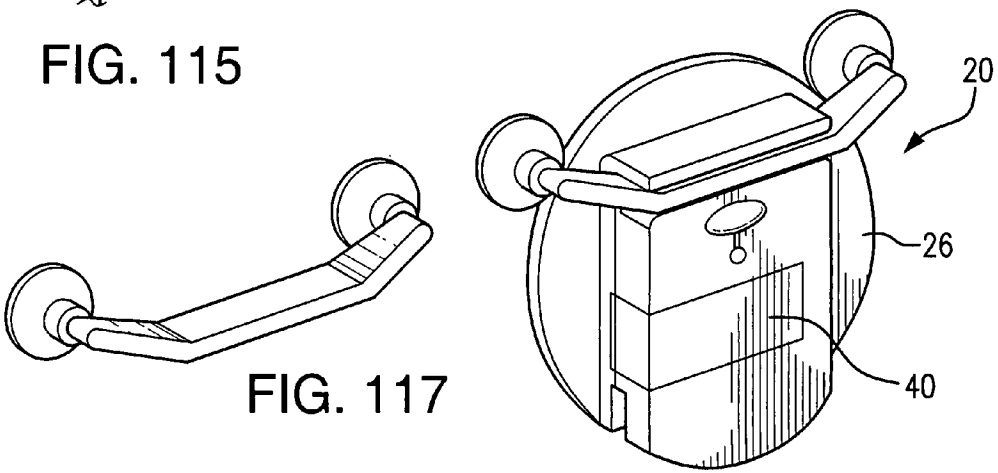
FIG. 117 is a rear perspective view of the lighting device, as shown in FIGS. 114-116.
Figure 119:
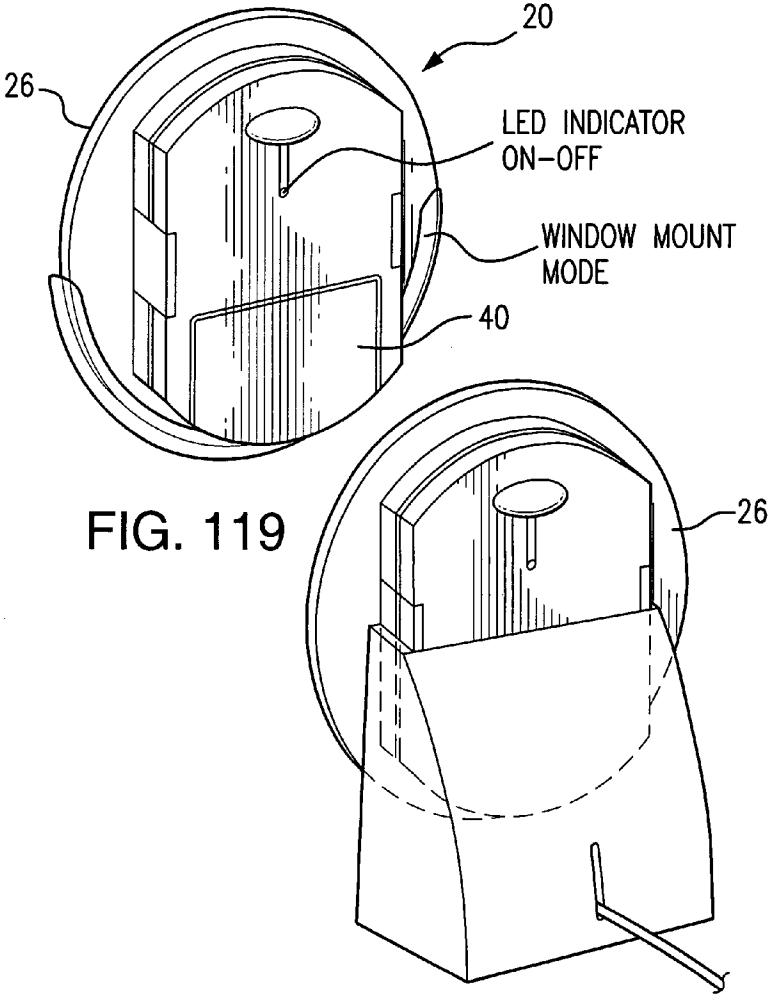
FIG. 119 is a rear perspective exploded view showing a lighting device within a base structure, according to another embodiment of this invention.
Figure 118:
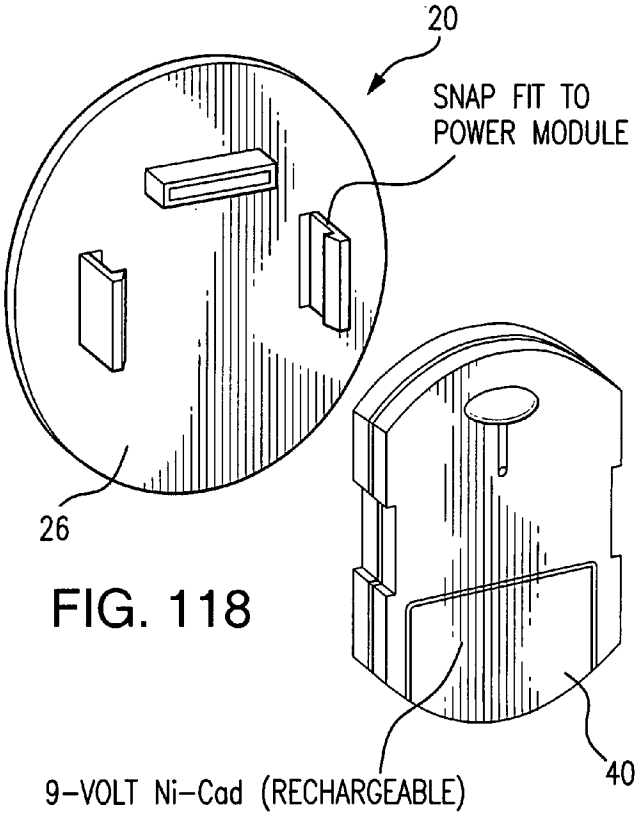
FIG. 118 is a rear perspective exploded view of a lighting device, according to another embodiment of this invention.

FIGS. 100-102 show different perspective views of other embodiments for attaching housing 26 with respect to a cradle. FIG. 103 is an exploded view showing different assembly features of lighting device 20, according to this invention. As shown in FIG. 103, retainer 70 has an overall arcuate shape and also has an opening or a void within the upper portion, so that a back or other structural part of housing 26 can be slid or positioned within the openings, particularly without removing retainer 70 from its attached position with respect to connector 71 and/or mounting surface 78.

FIGS. 104-107 show perspective views of other embodiments of lighting device 20, according to this invention.

FIGS. 108-119 show different embodiments of lighting device 20, according to this invention, with several different options for mounting, attaching or fixing a position of housing 26 with respect to mounting surface 78 or with respect to a cradle, a bracket, a stand and/or any other suitable support structure.

Figure 120:
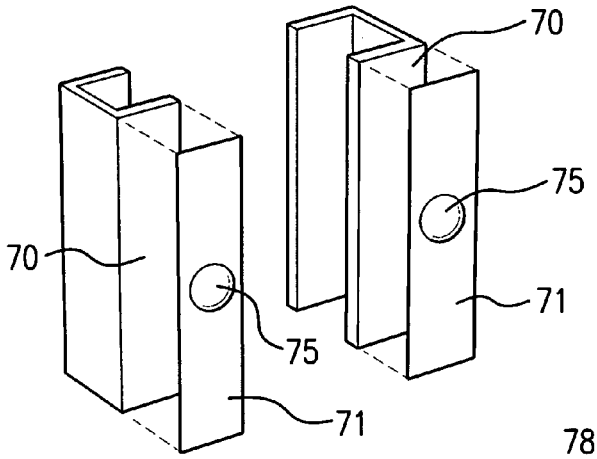
FIG. 120 is a perspective view of a mounting system, according to one embodiment of this invention.

FIG. 120 shows a perspective view of retainer 70 and connector or attachment 71, according to other embodiments of this invention. The dashed lines of FIG. 120 show a direction for securing attachment 71 in an adhered manner or an otherwise secured manner to retainer 70, such as with an adhesive strip or a double sided tape. Attachment 71 as shown in FIG. 120 can be constructed of a tape material, a plastic material, a composite material, and/or any other suitable material for attaching or securing attachment 71 with respect to retainer 70.

Figure 121:
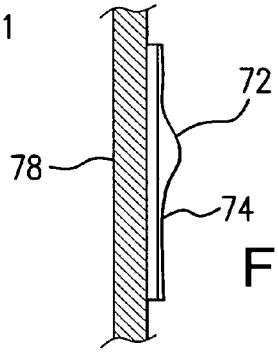
FIGS. 121-123 each is a side view of an attachment element used in the mounting system shown in FIG. 120, according to different embodiments of this invention.
Figure 122:
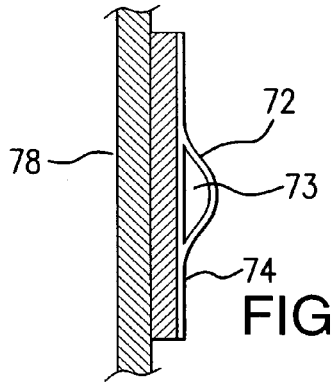
Figure 123:
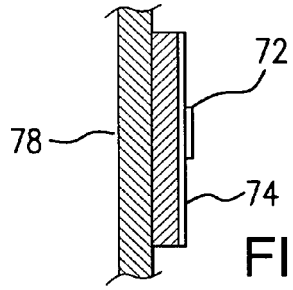

FIGS. 121-123 show different embodiments of a bubble structure or blister structure that can be used to position retainer 70 and thus housing 26 in a preset position, or that can be used to reposition housing 26 to align housing 26 as required by any surrounding environment. For example, if housing 26 is mounted with respect to mounting surface 78 and then it is determined that housing 26 requires movement because the image on graphics panel 31 is misaligned, attachment 71 can be moved or reset into a final position and then set to fix the position of retainer 70 with respect to mounting surface 78.

FIG. 121 shows a side view of an adhesive strip with an area of protrusion 72 that can be mated with hole 75, as shown in FIG. 120, to temporarily position protrusion 72 with respect to hole 75. FIG. 122 shows a sectional view of protrusion 72, as shown in FIG. 121. FIG. 122 shows that protrusion 72 forms a void or air pocket 73. In some embodiments according to this invention, retainer 70 and/or housing 26 can be preset or aligned into a particular position by contacting protrusion 72 against mounting attachment 71. Once the relative position of housing 26 and/or retainer 70 is found or determined with respect to mounting surface 78, a force or pressure can be applied to retainer 70 and/or housing 26 to force and then burst or break the bubble formed by protrusion 72, as shown in FIGS. 121 and 122, and make adhesive contact and set retainer 70.

FIG. 123 shows a sectional view of another embodiment of protrusion 72 as shown in FIG. 123, protrusion 72 comprises a relatively soft material, such as an adhesive layer which can be compressed or smashed, so that when force is applied to retainer 70 and/or housing 26, adhesive strip 74 makes adhesive contact with attachment 71.

In addition to the embodiment shown in FIGS. 120-123, any other suitable structure can be used to temporarily hold or to lightly hold retainer 70 and/or housing 26 with respect to mounting surface 78, and thus provide a preset alignment before more permanently contacting or securing retainer 70 and/or housing 26 with respect to mounting surface 78.

Figure 124:
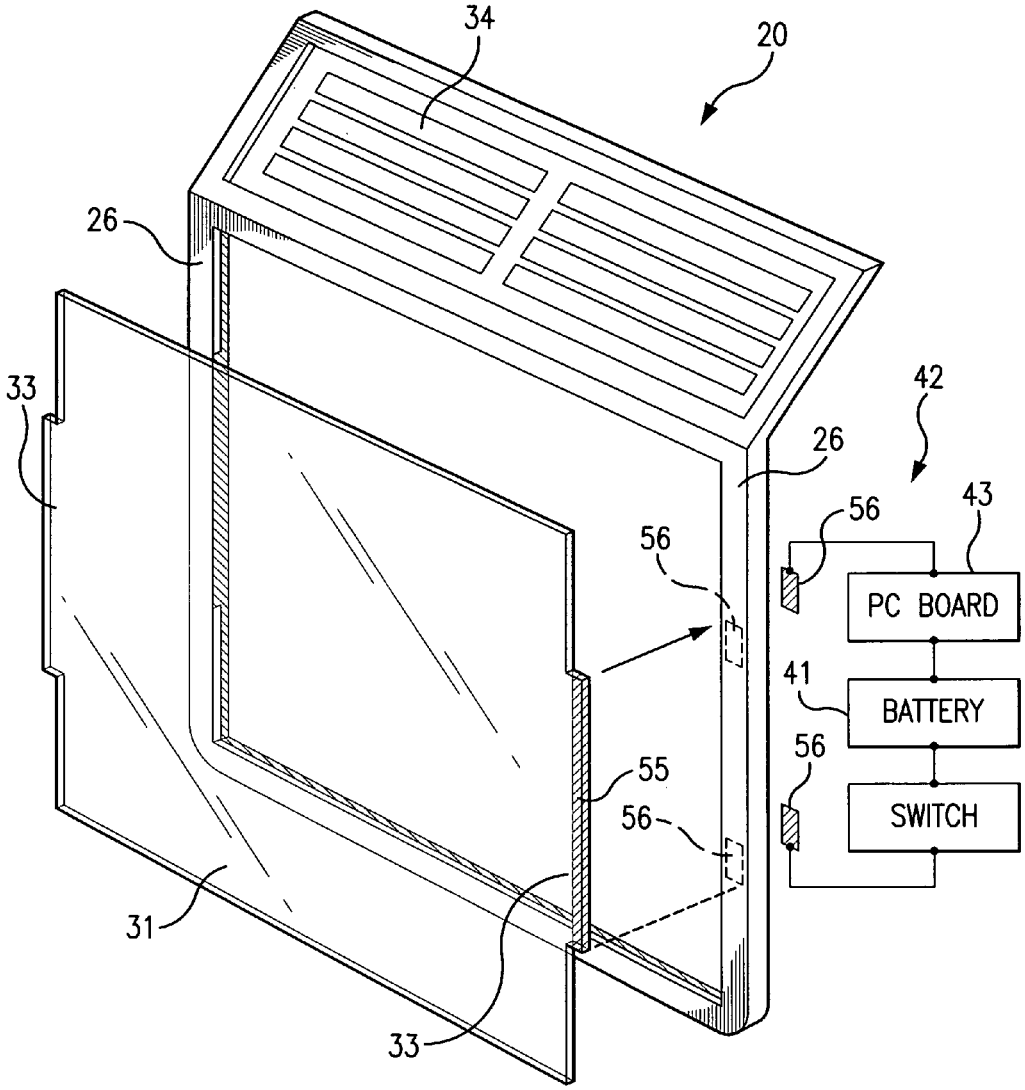
FIG. 124 is a perspective view of a solar powered lighting device, according to another embodiment of this invention, with a replaceable lens having an electrical conductor.

FIG. 124 shows another embodiment for interchangeably mounting graphics panel 31 with respect to housing 26. As described with respect to FIGS. 77-80, graphics panel 31 can have tabs 33 or ears or any other structural, mechanical, magnetic and/or electrical element that allows graphics panel 31 to be interchangeably positioned with respect to housing 26. Other suitable structural, mechanical, electrical, magnetic and/or other systems and/or structures can be used to accomplish the same result of interchangeably positioning or mounting graphics panel 31 with respect to housing 26 and/or any other element of this invention.

In some embodiments according to this invention, such as shown in FIG. 124, whether graphics panel 31 is interchangeably mounted or fixedly mounted with respect to housing 26, graphics panel 31 comprises conductor 55. When graphics panel 31 is mounted with respect to housing 26, conductor 55 can complete a circuit by contacting both terminals 56 and thus allowing PC board 43, battery 41, a switch and/or control module 42 to function or electrically operate as a closed circuit.

In some embodiments according to this invention, conductor 55 comprises a conductive foil, a metal, a strip and/or any other suitable conductor that can electrically conduct between or across both terminals 56. In some embodiments of this invention, conductor 55 acts as an electrical bridge that forms a connection between both terminals 56. In different embodiments of this invention, conductor 55 can be a stamped metal, an edge metal crimp, a hot stamp foil, a die stamped metal crimping and/or any other suitable structure that can conduct electricity.

As shown in FIG. 124, when graphics panel 31 is mounted with respect to housing 26, tab 33 can fit behind or be concealed by a face structural member, such as for aesthetic purposes. Many other suitable structural arrangements are possible.

In some embodiments according to this invention, control module 42, conductor 55 and/or terminal 56 can provide a tamper-proof device, so that it is apparent when graphics panel 31, for example, or another element is removed from its mounted position, with respect to housing 26. In some embodiments according to this invention, conductor 55 and one or more terminals 56 can be at least partially secured with respect to each other in an adhesive manner and/or a mechanical manner and/or an electrical manner and/or a magnetic manner.

In some embodiments according to this invention, removing graphics panel 31 from its mounted position can break the structure of conductor 55 and/or can break an electrical connection between conductor 55 and terminal 56. For example, a glue or another adhesive can be used to secure all or at least a portion of conductor 55 to all or at least a portion of either or both terminals 56, so that when graphics panel 31 is removed, conductor 55 and/or terminal 56 is destroyed and thus opens the closed electrical circuit. In other embodiments according to this invention, tab 33 and/or conductor 55 and/or terminal 56 can have a claw, a hook, or another mechanical device to structurally break or destroy conductor 55 and/or terminal 56 to open the closed electrical circuit, for example if graphics panel 31 is removed from its mounted position with respect to housing 26. In other embodiments according to this invention, contact between conductor 55 and terminal 56 can be broken in any other suitable manner.

An open circuit or a broken electrical connection can trigger or send a signal to control module 42, for example, to transmit an alarm or other signal. In some embodiments according to this invention, the breakable or destroyable contact is also referred to as a fragile wire, which breaks the contact or interface between graphics panel 31 and terminals 56 or control module 42.

While the above description contains much specificity, this specificity should not be construed as limiting the scope of the invention, but rather as an exemplification of the invention. In this last regard, it is contemplated that the present invention preferably and essentially provides a (backlit) graphic display device for illuminating interchangeable graphic panels, which backlit graphic display device preferably and essentially comprises a housing assembly, a light source assembly, a light guide assembly, and device-to-window retainer structures, as summarized in more detail hereinafter.

The housing assembly 26 preferably and essentially comprises a housing top as at 200, a housing bottom as at 201, laterally opposed housing sides as at 202, a housing back as at 203, a housing front as at 204, and a substantially circular peripheral housing edging 205 as generally depicted in FIGS. 99 and 103, for example. The housing back 203 preferably and essentially comprises an assembly-receiving cavity or void as at 206, and the peripheral housing edging 205 preferably and essentially defines a panel-receiving section in anterior adjacency to the assembly-receiving cavity 206.

The light source assembly preferably and essentially comprises, in electrical communication, a power source as exemplified by a battery 41 or battery pack 40; a light source as exemplified by LED type light elements as at 97; and circuitry as exemplified by conductor(s) 55, terminals 56, PC board 43, and control module 42. The power source and circuitry are receivable in the assembly-receiving cavity 206, and the light sources(s) is/are received radially adjacent the peripheral housing edging 205.

The light guide assembly, preferably comprising light guide panel or light guide as at 96 is positionable in anterior adjacency to the power source and circuitry and in edge adjacency to the light source for guiding light emanating from the light source in an anterior direction as at 209, which anterior direction 209 is orthogonal to a light guide plane of the light guide 96.

The device-to-window retainer structures as at 70 are preferably and essentially laterally opposed relative to the housing assembly 26 for fastening the graphic display device to a window 100 or mounting surface as at 78. The device-to-window retainer structures 70 each comprise an edge-receiving opening or void as at 207.

The edge-receiving voids 207 receive and bind to or retain the laterally opposed portions of the peripheral housing edging 205 as at portions 202. The retainer structures thus function to both receive and support the housing assembly 26 such that the light from the light source(s) is/are guided in the anterior direction 206, which direction, as stated, is orthogonal to a plane of the window 100 or mounting surface 78.

The graphic display device according to the present invention may further preferably and essentially comprise a light trap as at 208, which light trap 208 is positionable in anterior adjacency to the light guide 96 within the panel-receiving section for enhancing uniform light transmission from the light guide 96.

The graphic display device may further comprise, in combination, an interchangeable graphic lens as at 31. The graphic lens 31 may preferably and essentially comprise laterally opposed tab structures as at 33; and inner portions of the housing edging 205 may preferably comprise laterally opposed tab-receiving voids as at 207 for receiving said tab structures 33 and thus for removably retaining the graphic lens 31 in anterior adjacency to the light guide 96.

The graphic display device may further preferably and essentially comprise a housing back 203 that comprises integrally formed, laterally opposed, posteriorly extending retainer-engaging projections as at 210. The retainer-engaging projections 210 essentially function as stop structure for engaging upper rearward portions 211 of the retainer structures 70. The retainer-engaging projections 210 and retainer structures 70 enhance support of the housing assembly adjacent the window 100 or mounting surface 78.

The retainer-engaging projections may preferably be formed at a point substantially equidistant intermediate the housing top 200 and the housing bottom 201 of the housing assembly 26 for enhancing support of the housing assembly adjacent the window 100 or mounting surface 78. The retainer structures 70 each preferably extend an arc length (cooperable with the substantially circular peripheral housing edging 205) toward the housing bottom 201 from the housing sides 202. The peripheral housing edging 205 is thus seatable in and upwardly supportable by medially extending portions (as at 212) of the laterally opposed retainer structures 70 and the retainer-engaging projections 211.

The graphic display device of claim may further comprise retainer structures 70 each comprising a frontal retainer structure portion as at 213, which frontal retainer structure portions 213 extending in laterally opposed arc lengths, which laterally opposed arc lengths are substantially equidistant intermediate the housing top 200 and the housing bottom 201 for enhancing support of the housing assembly 26 adjacent the window 100 or mounting surface 78.

Accordingly, although the invention has been described in detail in connection with certain embodiments or examples, which illustrate or simulate various aspects involved in the practice of this invention, it is to be understood that all changes that come within the spirit of this invention are desired to be protected as claimed hereinafter, and thus this invention is not to be construed as limited by example or embodiment.

What is claimed is:

1. A backlit graphic display device for illuminating a graphic panel, the backlit graphic display device comprising: a housing assembly, the housing assembly comprising a housing top, a housing bottom, a housing back, a housing front, and peripheral housing edging, the homing back comprising an assembly-receiving cavity, the housing edging defining a panel-receiving section in anterior adjacency to the assembly-receiving cavity; a light source assembly, the light source assembly comprising, in electrical communication: a power source, a light source, and a switch, portions of the light source assembly being receivable in the assembly-receiving cavity; a light guide assembly, the light guide being positionable in anterior adjacency to the power source in edge adjacency to the light source for guiding light from the light source in an anterior direction orthogonal to a light guide plate of the light guide; and device-to-window fastening means for fastening the graphic display device to a window, the device-to-window fastening means being cooperably associated with the peripheral housing edging for supporting the housing assembly such that the light from the light source is guided in the anterior direction, the anterior direction being orthogonal to a window plane of the window, wherein the laterally opposed retainer structures comprise hook and loop type fastening means for fastening the graphic display device to the window, the laterally opposed retainer structures being integrally formed with the housing back for receiving the hook and loop fastening means within a matable fastening means gap, the matable fastening means gap being structurally situated intermediate anterior surfacing of the laterally opposed retainer structures and a forward most anterior plane of the housing front, the laterally opposed retainer structures and the book and loop fastening means thus for mounting the anterior plane flush against a window plane of the window.

2. The graphic display device of claim 1 comprising a light trap, the light trap being positionable in anterior adjacency to the light guide within the panel-receiving section for enhancing uniform light transmission from the light guide.

3. The graphic display device of claim 2 comprising, in combination, a graphic lens, the graphic lens comprising laterally opposed tab structures, the housing edging comprising laterally opposed tab-receiving voids for receiving said tab structures and thus for removably retaining the graphic lens in anterior adjacency to the light guide.

4. The graphic display device of claim 3 wherein the device-to-window fastening means are defined by laterally opposed retainer structures.

5. The graphic display device of claim 4 wherein the retainer structures each comprise an edge-receiving void, the edge-receiving voids for receiving and retaining laterally opposed portions of the peripheral housing edging.

6. The graphic display device of claim 5 wherein the housing back comprises integrally formed, laterally opposed retainer-engaging projections, the retainer-engaging projections being formed at a point substantially equidistant intermediate the housing top and the housing bottom for engaging upper rearward portions of the retainer structures, the retainer-engaging projections and retainer structures for enhancing support of the housing assembly adjacent the window.

7. The graphic display device of claim 6 wherein the peripheral housing edging is substantially circular, and the retainer structures each extend an arc length, the peripheral housing edging thereby being seatable and supportable by the laterally opposed retainer structures and retainer-engaging projections, the retainer structures thus for enhancing support of the housing assembly adjacent the window.

8. The graphic display device of claim 7 wherein the retainer structures each comprise a frontal retainer structure portion, the frontal retainer structure portions extending in laterally opposed arc lengths, the laterally opposed arc lengths being substantially equidistant intermediate the housing top and the housing bottom for enhancing support oldie housing assembly adjacent the window.

9. A backlit graphic display device for illuminating a graphic panel, the backlit graphic display device comprising: a housing assembly, the housing assembly comprising a housing back, a housing front, and peripheral housing edging, the housing back comprising an assembly-receiving cavity, the housing edging defining a panel-receiving section in anterior adjacency to the assembly-receiving cavity; a light source assembly, the light source assembly comprising, in electrical communication: a power source, a light source, and a switch, the light source assembly being receivable in the assembly-receiving cavity; a light guide assembly, the light guide being positionable in anterior adjacency to the power source in edge adjacency to the light source for guiding light from the light source in an anterior direction orthogonal to the plane of the light guide; and device-to-surface fastening means for fastening the graphic display device to a mounting, the device-to-surface fastening means being cooperably associated with the peripheral housing edging for supporting the housing assembly such that the light from the light source is guided in a direction orthogonal to the plane of the mounting surface, wherein the device-to-surface fastening means comprise laterally opposed retainer structures and hook and loop fastening means for fastening the graphic display device to the mounting surface, the laterally opposed retainer structures berg integrally formed with the housing back for receiving the hook and loop fastening means within a matable fastening means gap, the rentable fastening means gap being structurally situated intermediate anterior surfacing of the laterally opposed retainer structures and a forward most anterior plane of the housing front, the laterally opposed retainer structures and the hook and loop fastening means thus for mounting the anterior plane flush against a surface plane of the mounting surface.

10. The graphic display device of claim 9 wherein the device-to-surface fastening means are defined by laterally opposed retainer structures, the retainer structures each comprising an edge-receiving void, the edge-receiving voids for receiving and retaining laterally opposed portions of the peripheral housing edging.

11. The graphic display device of claim 10 wherein the housing back comprises integrally formed, laterally opposed retainer-engaging projections, the retainer-engaging projections for engaging rearward portions of the retainer structures, the retainer-engaging projections and retainer structures for enhancing support of the housing assembly adjacent the mounting surface.

12. The graphic display device of claim 11 wherein the retainer-engaging projections are formed at a point substantially equidistant intermediate a housing top and a housing bottom of the housing assembly for enhancing support of the housing assembly adjacent the mounting surface.

13. The graphic display device of claim 12 wherein, the retainer structures each comprise a frontal retainer structure portion, the frontal retainer structure portions extending in laterally opposed arc lengths, the laterally opposed arc lengths being substantially equidistant intermediate the housing top and the housing bottom for enhancing support of the housing assembly adjacent the mounting surface.

* * * * *